US009022251B2

(12) United States Patent
Hechmati

(10) Patent No.: US 9,022,251 B2
(45) Date of Patent: May 5, 2015

(54) FOLDABLE AIR INSULATING SLEEVE

(76) Inventor: Laurent Hechmati, Los Angeles, CA (US)

( * ) Notice: Subject to any disclaimer, the term of this patent is extended or adjusted under 35 U.S.C. 154(b) by 0 days.

(21) Appl. No.: 12/471,624

(22) Filed: May 26, 2009

(65) Prior Publication Data

US 2009/0223984 A1 Sep. 10, 2009

Related U.S. Application Data

(62) Division of application No. 10/938,276, filed on Sep. 10, 2004, now Pat. No. 7,537,136.

(60) Provisional application No. 60/501,683, filed on Sep. 10, 2003, provisional application No. 60/577,699, filed on Jun. 7, 2004, provisional application No. 60/587,783, filed on Jul. 14, 2004, provisional application No. 60/604,366, filed on Aug. 25, 2004.

(51) Int. Cl.

| | |
|---|---|
| ***B65D 90/06*** | (2006.01) |
| ***B65D 37/00*** | (2006.01) |
| ***A47G 23/02*** | (2006.01) |
| ***B65D 81/38*** | (2006.01) |

(52) U.S. Cl.

CPC ..... *A47G 23/0216* (2013.01); *B65D 81/3876* (2013.01); *B65D 81/3881* (2013.01)

(58) Field of Classification Search

CPC ..... A47G 23/0216; A47G 23/0258; B60N 3/103; B65D 81/3876; B65D 81/3886; B65D 81/3879

USPC ..... 220/521, 522, 737–739

See application file for complete search history.

(56) References Cited

U.S. PATENT DOCUMENTS

| | | | | |
|---|---|---|---|---|
| 2,028,566 | A * | 1/1936 | Seipel et al. | 294/31.2 |
| 2,483,168 | A | 9/1949 | Amberg | |
| 3,337,109 | A | 8/1967 | Shumrak | |
| 3,908,523 | A | 9/1975 | Shikaya | |
| 3,977,562 | A | 8/1976 | Wedzik | |
| 3,994,411 | A | 11/1976 | Elfelt et al. | |
| D243,231 | S | 2/1977 | Smith | |
| 4,056,210 | A | 11/1977 | Boyle | |
| 4,074,827 | A | 2/1978 | Labe, III | |
| 4,090,660 | A | 5/1978 | Schram et al. | |
| 4,106,660 | A | 8/1978 | Boyle | |

(Continued)

*Primary Examiner* — Fenn Mathew
*Assistant Examiner* — Kevin Castillo
(74) *Attorney, Agent, or Firm* — Michael F. Krieger; Kirton McConkie

(57) ABSTRACT

A foldable air insulating sleeve for insulating beverage and food containers is herein provided. More particularly, the foldable air insulating sleeve secures a cup in a manner that leaves a pocket of air surrounding the cup. This provides for improved temperature regulation and sufficient thermal insulation to assist the user in firmly grasping and handling the cup despite excess heat or condensation caused by the temperature of the cup's contents. Because the bases of most disposable cups are narrower than their respective rims, more air and thus greater insulation is found towards the bottom of cups secured by foldable air insulating sleeves. The wider base also gives such cups more stability. Support rings may be placed medially in on the inside of the sleeve to strengthen the sleeve and prevent it from collapsing when held by a user. The sleeve may also be short so as to insulate a medial portion of a cup. Printable material can also be affixed on the foldable air insulating sleeve's outer surface for advertising or other purposes. Some embodiments of the foldable air insulating sleeve include a lid to further improve thermal insulation.

2 Claims, 59 Drawing Sheets

(56) References Cited

U.S. PATENT DOCUMENTS 4,117,971 A 10/1978 Itoh
4,183,443 A 1/1980 Deparales et al.
4,183,444 A 1/1980 English et al.
4,186,842 A 2/1980 Albert
D256,887 S 9/1980 Swade et al.
D256,888 S 9/1980 Swade et al.
D256,889 S 9/1980 Swade et al.
4,261,501 A 4/1981 Watkins et al.
4,280,652 A 7/1981 Schmidt
4,285,442 A 8/1981 Wedzik
4,288,026 A 9/1981 Wilhelm
4,303,170 A 12/1981 Panicci
4,319,691 A 3/1982 Hament
4,322,015 A 3/1982 Bailey
4,345,695 A 8/1982 Galloway et al.
4,388,996 A 6/1983 Panicci
4,394,905 A 7/1983 Hackenberg
D271,857 S 12/1983 Callahan
4,421,244 A 12/1983 Van Melle
4,428,498 A 1/1984 Obey
4,438,865 A 3/1984 Scattaregia
RE31,650 E 8/1984 Serritella
4,473,167 A 9/1984 Bailey
4,502,608 A 3/1985 Mills
4,503,992 A 3/1985 Sitko et al.
4,518,096 A 5/1985 Winstead
4,548,349 A 10/1985 Tunberg
4,573,631 A 3/1986 Reeves
4,582,214 A 4/1986 Dart et al.
4,586,625 A 5/1986 Garrett
4,589,569 A 5/1986 Clements
D284,563 S 7/1986 Merino
4,615,459 A 10/1986 Clements
4,631,715 A 12/1986 Hoover
4,632,273 A 12/1986 Rhine
D287,919 S 1/1987 Clements
D292,676 S 11/1987 Mileto
4,712,725 A 12/1987 Moore
4,715,633 A 12/1987 Brink et al.
4,726,487 A 2/1988 Mitri
4,726,553 A 2/1988 Wischusen, III
4,738,373 A 4/1988 Deparales
4,741,450 A 5/1988 Braude
4,753,365 A 6/1988 Seppala
4,756,440 A 7/1988 Gartner
4,767,019 A 8/1988 Horner
D299,010 S 12/1988 Wall
4,791,030 A 12/1988 Demars
4,795,052 A 1/1989 Hayes, Jr.
4,877,151 A 10/1989 Rush et al.
4,898,299 A 2/1990 Herbst et al.
4,915,250 A 4/1990 Hayes, Jr.
4,919,381 A 4/1990 Buist
4,925,051 A 5/1990 Herbst
4,934,558 A 6/1990 Vargas
4,978,024 A 12/1990 Newman et al.
4,997,156 A 3/1991 Allen
5,050,759 A 9/1991 Marble
D320,560 S 10/1991 Allen
5,065,880 A 11/1991 Horner
5,079,013 A 1/1992 Belanger
5,090,584 A 2/1992 Roberts et al.
5,092,485 A 3/1992 Lee
5,102,036 A * 4/1992 Orr et al. ..... 229/89
5,111,961 A 5/1992 Van Melle
5,145,107 A 9/1992 Silver et al.
5,147,065 A 9/1992 Rush et al.
5,147,066 A 9/1992 Snider
5,197,624 A 3/1993 Dodaro
5,205,473 A 4/1993 Coffin, Sr.
5,222,656 A 6/1993 Carlson
5,226,585 A 7/1993 Varano
D339,027 S 9/1993 Mack et al.
5,253,781 A 10/1993 Van Melle et al.
5,259,529 A 11/1993 Coale
5,326,019 A 7/1994 Wolff
5,348,181 A 9/1994 Smith et al.
5,361,935 A 11/1994 Sagucio
5,363,982 A 11/1994 Sadlier
5,375,828 A 12/1994 Shikami
5,385,255 A * 1/1995 Varano et al. ..... 229/404
D355,846 S 2/1995 Denney et al.
5,392,949 A 2/1995 Mckenna
5,397,023 A 3/1995 Toczek et al.
5,398,843 A 3/1995 Warden et al.
D358,294 S 5/1995 Letica
5,415,002 A 5/1995 Koenig
5,415,312 A 5/1995 Mueller
5,415,339 A 5/1995 Howard
5,425,497 A 6/1995 Sorensen
5,431,276 A 7/1995 Lialin
D361,469 S 8/1995 Young
5,445,315 A 8/1995 Shelby
5,454,484 A 10/1995 Chelossi
5,460,286 A 10/1995 Rush et al.
D363,852 S 11/1995 Young
5,465,891 A 11/1995 Bridges
5,469,983 A 11/1995 Yawata
5,485,938 A 1/1996 Boersma
5,490,609 A 2/1996 Lane et al.
5,492,269 A 2/1996 Sung
D368,624 S 4/1996 Forrer
5,509,568 A 4/1996 Warden et al.
5,529,202 A 6/1996 Shamis
5,538,180 A 7/1996 Lo
5,543,599 A 8/1996 Sobol
5,579,949 A 12/1996 Dykes et al.
5,588,552 A 12/1996 Johnson
5,613,619 A 3/1997 Van Melle
5,624,053 A 4/1997 Freek et al.
5,628,453 A 5/1997 Maclaughlin
D379,738 S 6/1997 Liming et al.
D379,928 S 6/1997 Freek et al.
D381,267 S 7/1997 Rush et al.
D381,268 S 7/1997 Rush et al.
5,657,898 A 8/1997 Portman et al.
5,660,326 A 8/1997 Varano et al.
5,667,135 A 9/1997 Schaefer
5,669,553 A 9/1997 Smith
5,676,306 A 10/1997 Lankin et al.
5,678,720 A 10/1997 Van Melle
5,685,480 A 11/1997 Choi
5,692,616 A 12/1997 Baker
5,697,550 A 12/1997 Varano et al.
5,699,927 A 12/1997 Lane et al.
5,702,024 A 12/1997 Riso
5,706,972 A 1/1998 Sousa
5,713,512 A 2/1998 Barrett
5,746,372 A 5/1998 Spence
5,752,653 A 5/1998 Razzaghi
RE35,830 E 6/1998 Sadlier
5,765,716 A 6/1998 Cai et al.
5,769,311 A 6/1998 Morita et al.
5,772,069 A 6/1998 Price
5,772,111 A 6/1998 Kirsch
5,791,509 A 8/1998 Rush et al.
5,794,843 A 8/1998 Sanchez
5,820,016 A 10/1998 Stropkay
5,826,786 A * 10/1998 Dickert ..... 229/403
5,839,601 A 11/1998 Van Melle
5,839,653 A 11/1998 Zadravetz
5,842,633 A 12/1998 Nurse
5,845,806 A 12/1998 Parchman
5,894,952 A 4/1999 Mendenhall et al.
5,934,501 A 8/1999 Wright
5,947,323 A 9/1999 Freek et al.
5,952,068 A 9/1999 Neale et al.
D415,654 S 10/1999 Forrer
5,964,400 A 10/1999 Varano et al.
D417,360 S 12/1999 Bickert et al.
5,996,837 A 12/1999 Freek et al.
6,003,711 A 12/1999 Bilewitz
D418,363 S 1/2000 Barnes et al.
6,047,852 A 4/2000 Evans et al.

(56) References Cited

U.S. PATENT DOCUMENTS

| | | | | |
|---|---|---|---|---|
| 6,050,445 | A | 4/2000 | Manganiello | |
| 6,053,352 | A | 4/2000 | Cai | |
| 6,056,144 | A | 5/2000 | Strange et al. | |
| 6,059,140 | A | 5/2000 | Hicks | |
| 6,070,755 | A | 6/2000 | Evans et al. | |
| 6,076,450 | A | 6/2000 | Digiorgio, Jr. | |
| 6,085,970 | A * | 7/2000 | Sadlier | 229/403 |
| 6,089,397 | A | 7/2000 | Van Melle | |
| D429,443 | S | 8/2000 | DAlessio | |
| 6,102,245 | A | 8/2000 | Haberman | |
| 6,129,653 | A | 10/2000 | Fredricks | |
| 6,138,862 | A | 10/2000 | Tai | |
| 6,139,665 | A | 10/2000 | Schmelzer et al. | |
| 6,142,335 | A | 11/2000 | Query, Jr. | |
| 6,152,363 | A | 11/2000 | Rule, Jr. | |
| 6,164,484 | A * | 12/2000 | Fiore et al. | 220/521 |
| 6,176,390 | B1 | 1/2001 | Kemp | |
| 6,176,420 | B1 | 1/2001 | Sarson et al. | |
| 6,182,855 | B1 | 2/2001 | Alpert | |
| 6,196,454 | B1 | 3/2001 | Sadlier | |
| 6,207,100 | B1 | 3/2001 | Weiss et al. | |
| 6,230,924 | B1 | 5/2001 | Weiss et al. | |
| 6,250,545 | B1 | 6/2001 | Mazzarolo et al. | |
| 6,253,995 | B1 | 7/2001 | Blok et al. | |
| 6,257,485 | B1 | 7/2001 | Sadlier et al. | |
| 6,260,727 | B1 | 7/2001 | Durdon | |
| 6,260,731 | B1 | 7/2001 | Cummings | |
| 6,260,756 | B1 | 7/2001 | Mochizuki et al. | |
| D447,412 | S | 9/2001 | Durdon | |
| 6,286,709 | B1 | 9/2001 | Hudson | |
| 6,286,754 | B1 * | 9/2001 | Stier et al. | 229/403 |
| 6,296,141 | B1 | 10/2001 | Lukacevic | |
| 6,299,014 | B1 * | 10/2001 | Nava et al. | 220/521 |
| 6,308,883 | B1 | 10/2001 | Schmelzer et al. | |
| D449,986 | S | 11/2001 | Schaefer | |
| 6,343,735 | B1 | 2/2002 | Cai | |
| 6,357,619 | B1 | 3/2002 | Schaefer | |
| 6,367,652 | B1 | 4/2002 | Toida et al. | |
| 6,378,766 | B2 | 4/2002 | Sadlier | |
| D457,778 | S | 5/2002 | Randolph et al. | |
| 6,394,302 | B1 | 5/2002 | Query, Jr. | |
| 6,416,829 | B2 | 7/2002 | Breining et al. | |
| 6,482,481 | B1 | 11/2002 | Fredricks et al. | |
| 6,505,753 | B1 | 1/2003 | Freek et al. | |
| 6,513,379 | B2 | 2/2003 | Meyers et al. | |
| 6,533,139 | B2 | 3/2003 | Lukacevic | |
| 6,536,657 | B2 | 3/2003 | Van Handel | |
| D472,424 | S | 4/2003 | Shumway et al. | |
| D473,791 | S | 4/2003 | Loris | |
| 2001/0013537 | A1 | 8/2001 | Sadlier | |
| 2002/0004110 | A1 | 1/2002 | Breining et al. | |
| 2002/0014524 | A1 | 2/2002 | Willis | |
| 2002/0113072 | A1 | 8/2002 | Lane | |
| 2002/0148832 | A1 | 10/2002 | Breining et al. | |
| 2002/0148888 | A1 | 10/2002 | Kim | |
| 2002/0150705 | A1 | 10/2002 | Breining et al. | |
| 2002/0170912 | A1 | 11/2002 | Clarke | |
| 2002/0172818 | A1 | 11/2002 | DeBraal et al. | |
| 2002/0185496 | A1 | 12/2002 | Puerini | |
| 2002/0187286 | A1 | 12/2002 | Breining et al. | |
| 2003/0015582 | A1 | 1/2003 | Handel | |
| 2003/0021921 | A1 | 1/2003 | Debraal et al. | |
| 2003/0052127 | A1 | 3/2003 | Mazzarolo | |
| 2003/0089726 | A1 | 5/2003 | Mazzarolo | |
| 2003/0141302 | A1 | 7/2003 | Ryan et al. | |

* cited by examiner

FOLDABLE AIR INSULATING SLEEVE

CLAIM OF PRIORITY

This application is a divisional of Continuation-In-Part application Ser. No. 10/938,276, now U.S. Pat. No. 7,537,136, which claims priority to U.S. patent application Ser. No. 10/459,337, now U.S. Pat. No. 7,290,679 and U.S. Provisional Patent Application Nos. 60/501,683, 60/577,699, 60/587,783, and 60/604,366.

BACKGROUND OF THE INVENTION

1. Field of the Invention

The present invention relates to insulating devices for beverage containers and more particularly, to insulating beverages and foods by using air as the insulator.

2. Background and Related Art

Disposable cups are routinely used in fast food and roadside restaurants to contain both hot and cold drinks. Because such cups have relatively thin walls, insulation is poor. As a result, the cups in which hot beverages are served are often too hot to hold comfortably, and the outside surface of cups in which cold beverages are served often accumulate moisture also making the cups difficult to hold, thus causing the holder's hand and the table to become wet. In addition, cold drinks warm quickly and hot drinks lose heat rapidly.

In response to the need for a better beverage insulator, various types of disposable cardboard and paper sleeves have been used. The sleeves are sized to slide onto the outside of a beverage cup and are held in place by friction. The wide-diameter end of the typical beverage cup prevents the sleeve from sliding off the cup while the cup is being held. However, such devices are poor insulators because they are generally thin. Moreover, the close contact with the cup causes additional heat transfer to the outside of the insulator. Additional insulation is needed at the bottom of beverage cups because the fluid has been there for a longer period of time. Also, such devices typically cover any printable material on the outside of the cup, resulting in a lost opportunity for advertising. While some transparent insulators have been created, they also lose effectiveness as insulators because of the close contact with the cups and the conductive material out of which they are typically made. Some of the more effective insulators are too bulky and take up too much storage space in small convenience stores, thus making the disposable cups too big to fit in most cup-holders. Another problem with most disposable cups is that since typical cups have narrow bases, they are unstable. Thus, there is a great need in the beverage industry for cups with better insulation and overall improvement.

To solve the problem of difficulty in gripping either hot drinks or cold drinks that accumulate moisture on the outside of the cup, some disposable cups include handles. Unfortunately, the problem with handles is that they are typically made out of paper or other sheet-like material and they lack sufficient strength to hold the cup in an upright position when the user is holding the cup by the handle. In other words, the weight of the cup can cause the handle to sag or tear such that the cup will tilt, spilling the beverage.

SUMMARY OF THE INVENTION

The present invention relates to insulating devices for beverage containers and more particularly, to insulating beverages and foods by using air as the insulator.

The preferred embodiment of the present invention involves a foldable air insulating sleeve configured to slidably receive and secure a beverage cup. The foldable air insulating sleeve secures the cup in a manner that allows for a pocket of air to surround the cup. This pocket of air insulates the beverage. The user can hold the cup by grasping the outer surface of the foldable air insulating sleeve, thus avoiding contact with a hot or wet cup surface. Because the bases of most disposable cups are narrower than their respective rims, more air and thus greater insulation is possible, especially towards the bottom of cups secured by the foldable air insulating sleeve. The wider base also gives the cup greater stability. Furthermore, the material out of which the foldable air insulating sleeve is made allows for advertisements or other printable material to be affixed on its outer surface. The foldable air insulating sleeve can be made out of many materials, including plastic or paper. The foldable air insulating sleeve is also foldable into a substantially flat position.

In this embodiment, the base of the cup rests on an inner base of the foldable air insulating sleeve. The inner base is connected to an outer base, which is in contact with the outer surface and supports the entire sleeve-cup configuration. The space between the inner and outer base is filled with air and further acts to insulate the contents of the cup.

In another embodiment, the foldable air insulating sleeve's outer base is in contact with the outer surface and supports the entire sleeve-cup configuration.

In yet another embodiment, the foldable air insulating sleeve's inner base has an opening through which the cup enters until the cup is either too wide and is stopped from further passage or until the cup meets the outer base of the foldable air insulating sleeve and is supported by it.

In even another embodiment, the foldable air insulating sleeve's outer base, while wider than the cup it supports, is narrow enough to fit into most cup holders. In an additional embodiment, the foldable air insulating sleeve includes a lid that attaches to the top rim of the cup. The lid is substantially hollow, providing an air chamber, which further insulates the contents of the cup. When the foldable air insulating sleeve is used with food, the lid has no openings. When used with a cold drink, the lid has an opening through which a straw is placed. Finally, when used with a hot drink, the lid has a rounded mouth piece and a cap, the mouthpiece and cap being either separate or tethered.

While the methods and processes of the present invention have proven to be particularly useful in association with beverage containers, those skilled in the art will appreciate that the methods and processes can be used in a variety of different applications to insulate a variety of different kinds of temperature sensitive substances (e.g. soups and other foods).

These and other features and advantages of the present invention will be set forth or will become more fully apparent in the description that follows and in the appended claims.

The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which:

FIGS. 45A-46A illustrate an exemplary alternative embodiment of an insulating sleeve.

FIGS. 48A-52A illustrate an exemplary alternative embodiment of an insulating sleeve.

FIGS. 52B-58 illustrate an exemplary mouthpiece.

DETAILED DESCRIPTION OF THE INVENTION

Figure 1B:
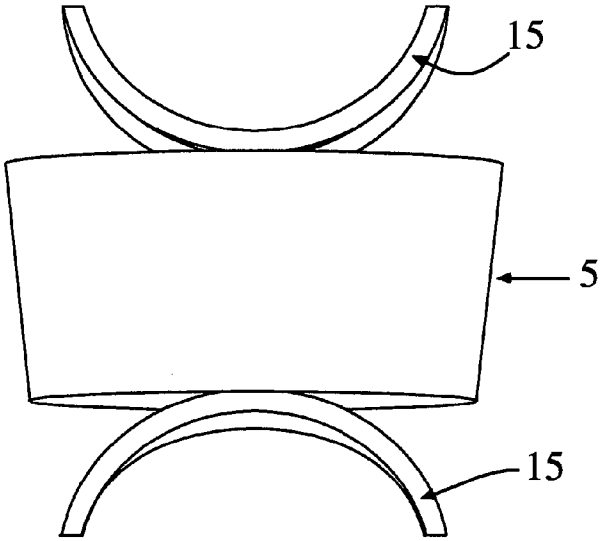
FIG. 1B illustrates a folded short sleeve insulator.
Figure 1A:
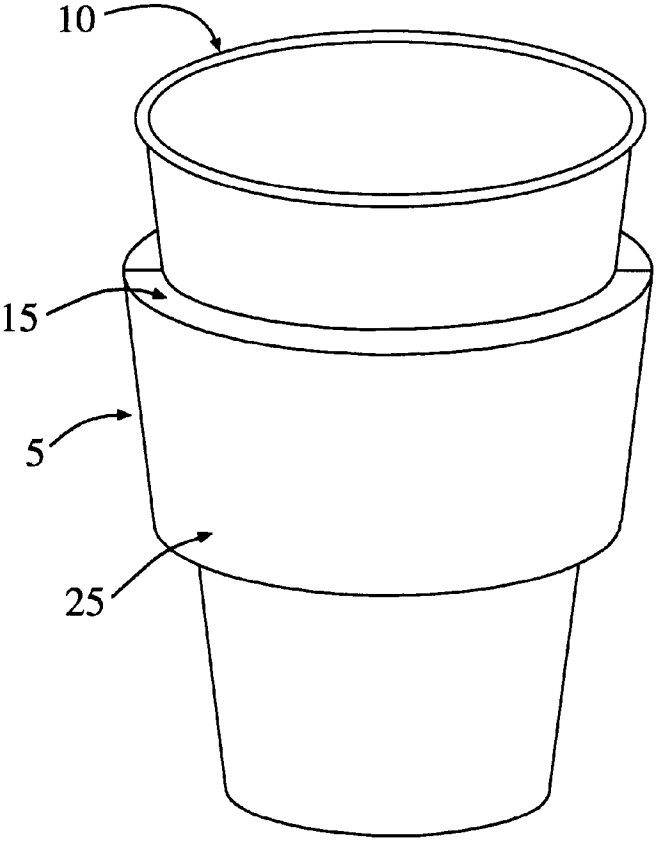
FIG. 1A illustrates a short sleeve insulator with cup inserted.

The present invention relates to insulating devices for beverage containers, and more particularly, to insulating beverages and foods by using air as the insulator.

In the disclosure and in the claims the term "cup" shall refer to any container used to house consumable liquids and solids, or for insulating dishes full of food or liquid. Examples of cups include disposable cups, buckets, food storage containers, leftover food container, casserole dish containers, small soup bowls and any other similarly shaped container from which one drinks or eats that is in need of insulation.

By way of general description of the embodiments of the present invention, there is an air insulation barrier used to create a temperature gradient around the contents of a cup. The barrier may be an insulating sleeve that is placed around the exterior of a cup, or it may be a lid placed on the top of a cup. The barrier material may comprise paper, plastic, or a combination of the two. The invention as taught minimizes the amount of material needed to create the insulation barrier, as well as provide a user maximum choice in how to insulate the cup, making an insulating sleeve optional with the insulating lid, and vice versa. In addition, some embodiments of the present invention teach forming barrier shapes that can be folded to compact forms, and selectively expanded to a functional form. Finally, the invention teaches modifying the surface by applying material with a high friction coefficient to improve the user's grip of the invention.

Referring to FIGS. 1A-5B illustrating two exemplary embodiments of a short insulating sleeve 5 wherein said sleeve can selectively receive a cup 10, the cup 10 and sleeve 5 having support rings 15 and forming an insulating air chamber 20 with a temperature gradient from the outer surface of the sleeve 25 to the temperature of the cup. The support rings 15 support the weight of the cup 10 while sheathed by the sleeve 5, and provide the contact points between the cup 10 and the sleeve 5. In addition, the support medially positioned support ring 15 provides increased support to the user gripping the sleeve, thus preventing the sleeve collapsing when held, and preventing the sleeve's outer wall 25 from contacting the cup 10. The outer surface area 25 of the short sleeve is large enough to shield a user's hand from the surface of the cup 10. Advantages of the short length of the sleeve are reduced manufacturing cost as well as the amount of storage space needed for several sleeves.

Figure 4B:
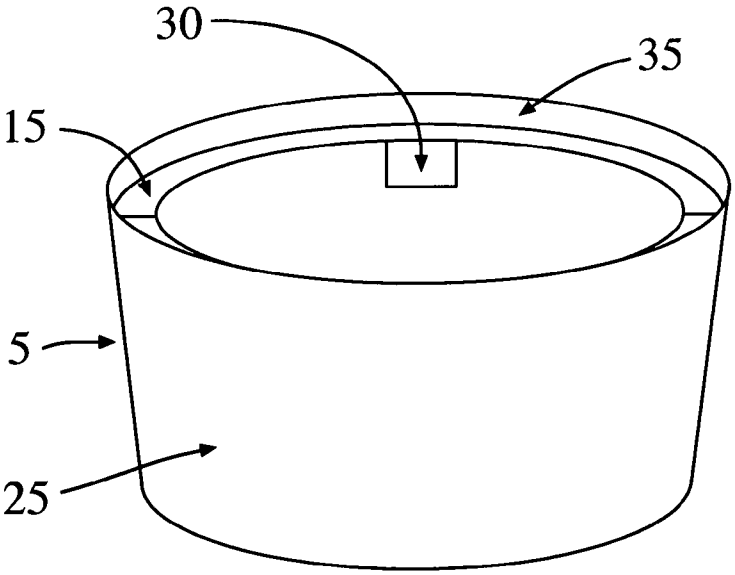
FIG. 4B illustrates a view of an extended opened short insulating sleeve.
Figure 4A:
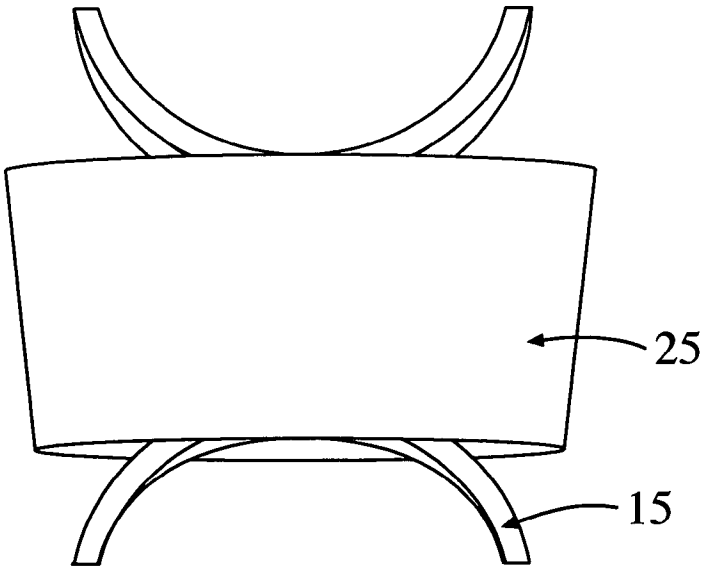
FIG. 4A illustrates a view of an extended folded short insulating sleeve.
Figure 5B:
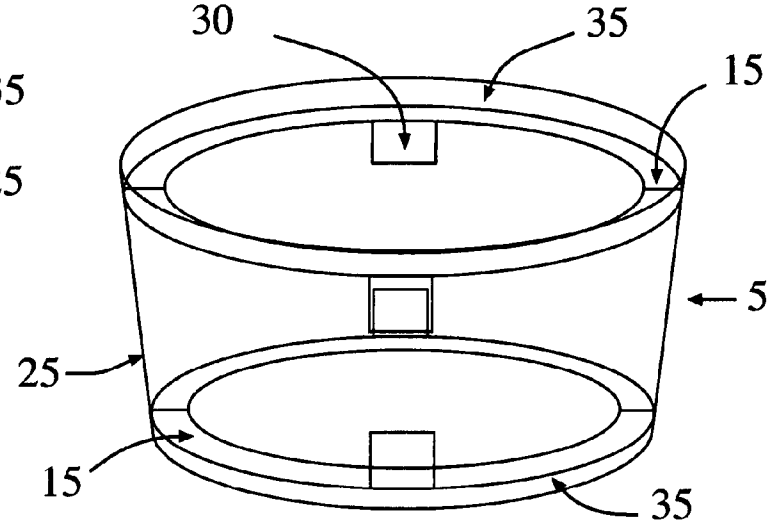
FIG. 5B illustrates a transparent view of an extended short insulating sleeve.
Figure 5A:
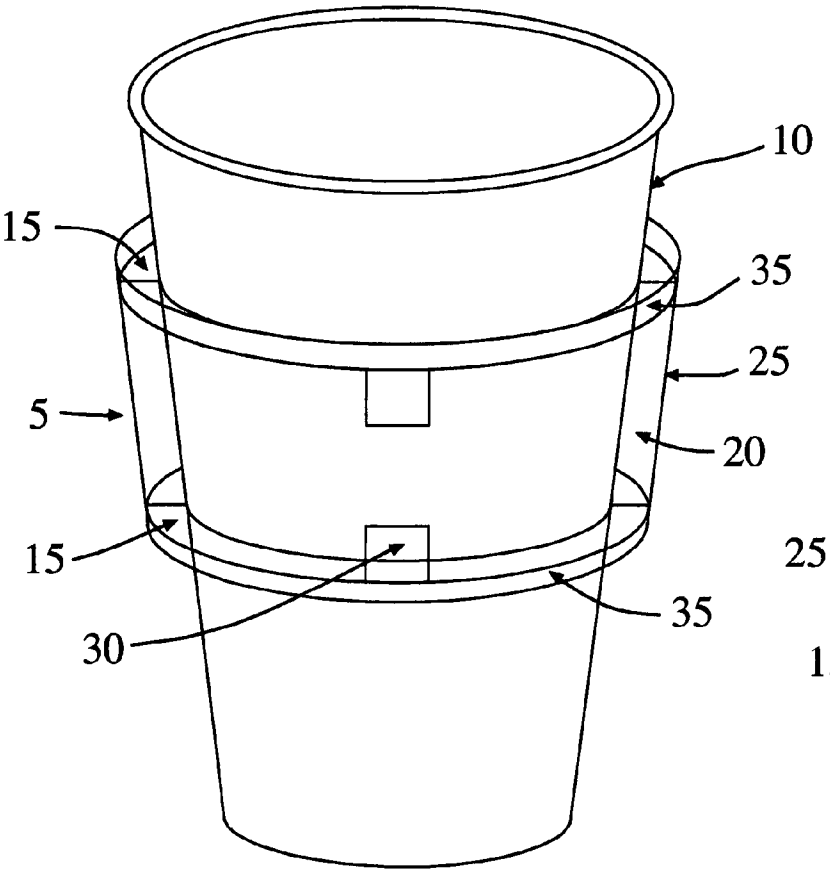
FIG. 5A illustrates a transparent view of an extended opened short insulating sleeve with cup inserted.
Figure 6B:
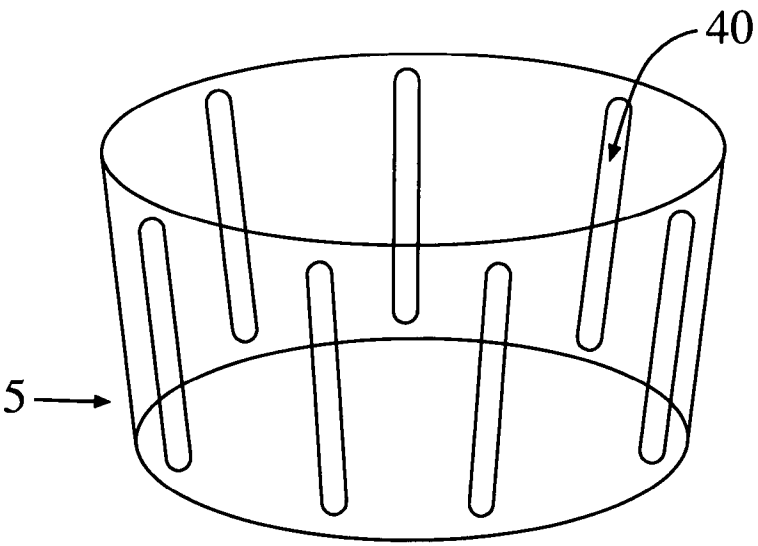
FIGS. 6A-20B illustrate exemplary embodiments of the short sleeve insulator.
Figure 6A:
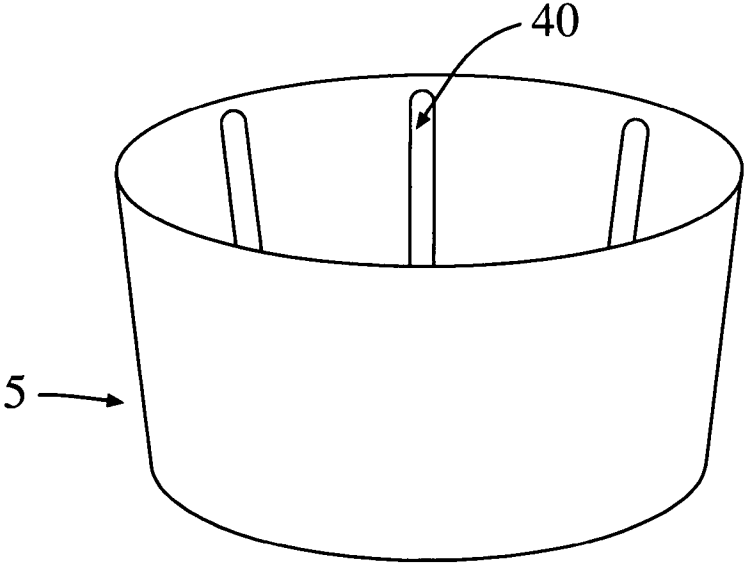

As illustrated in FIGS. 1B and 4A, the sleeve may be folded to minimize the profile of the sleeve. In addition, the sleeve may have indentations to allow the sleeve to fold along a desired axis.

Figure 2B:
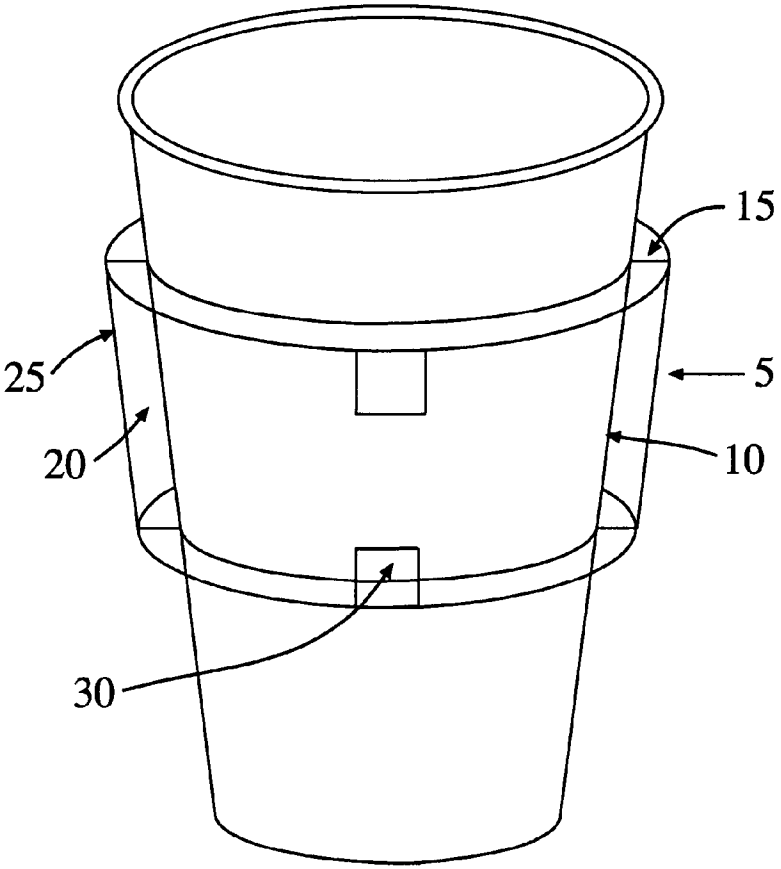
FIG. 2B illustrates a transparent view of an opened short sleeve insulator with cup inserted.
Figure 2A:
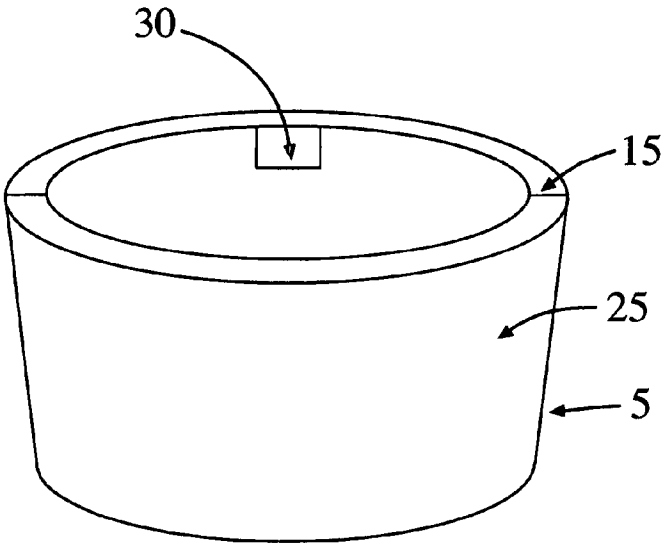
FIG. 2A illustrates an opened short sleeve insulator.

FIG. 2A illustrates a sleeve without a cup inserted therein. The support ring 15 can support is rigid enough to keep the sleeve in an open form even when a cup is not inserted into the center of the sleeve. A manufacturing tab or tab 30 is on the outer edge of the ring and connects the ring 15 to the outer surface 25.

FIG. 2B's partially transparent view illustrates the insulating air chamber 20 that forms between the cup 10 and the sleeve 5. Air is known as a superior insulation because of the difficulty gaseous molecules have in transferring kinetic energy.

Figure 3B:
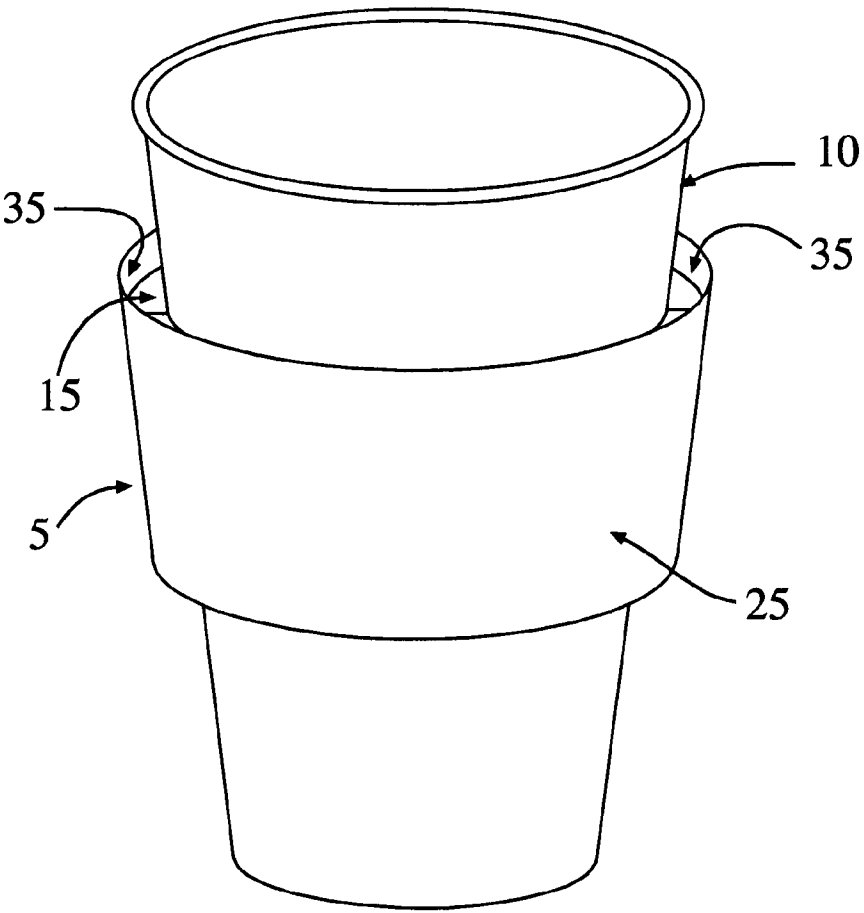
FIG. 3B illustrates a view of an extended opened short sleeve insulator with cup inserted.
Figure 3A:
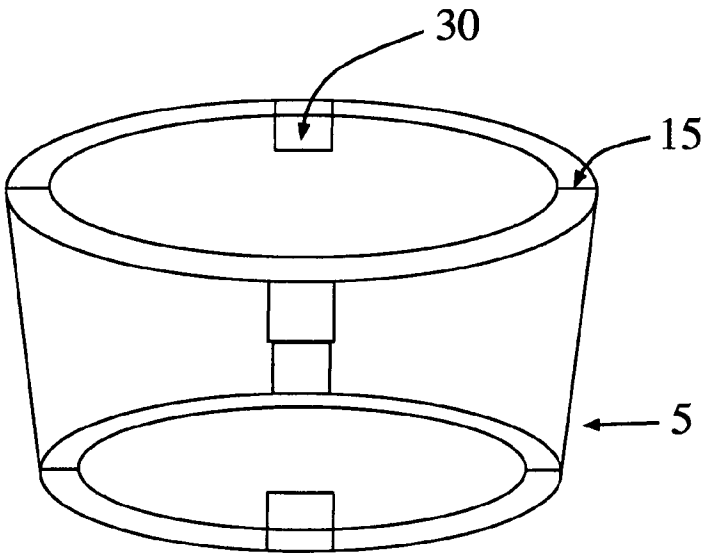
FIG. 3A illustrates a transparent view of an opened short sleeve insulator.

FIG. 3B illustrates a sleeve 5 with a surface area 25 that extends 35 beyond the support rings 15. This embodiment allows the rings 15 to be closer together while still providing a users' hand sufficient area to shield it from the temperature of the cup 10.

Referring now to FIGS. 6A-20B illustrating several embodiments of the insulating sleeve 5 with a plurality of structural beams 40 to support the weight of the cup 10. While the structural beams create more contact than other embodiments described herein, the beams provide superior support, thus allowing the user to sheath a cup of a variety of weights. The cup may be large or small and contain food or drink, and an appropriately sized insulating sleeve can still support the weight of the cup 10.

Figure 7B:
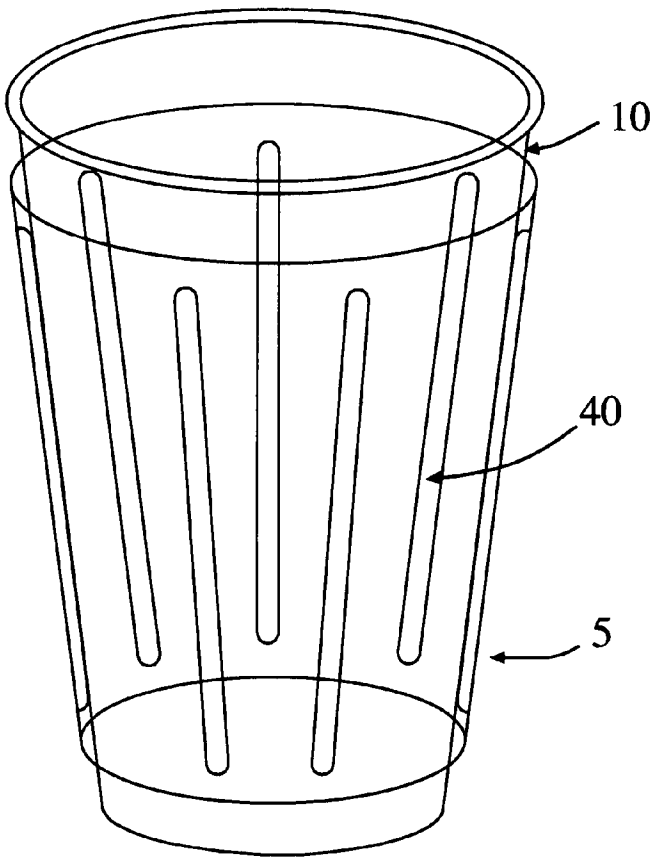
Figure 7A:
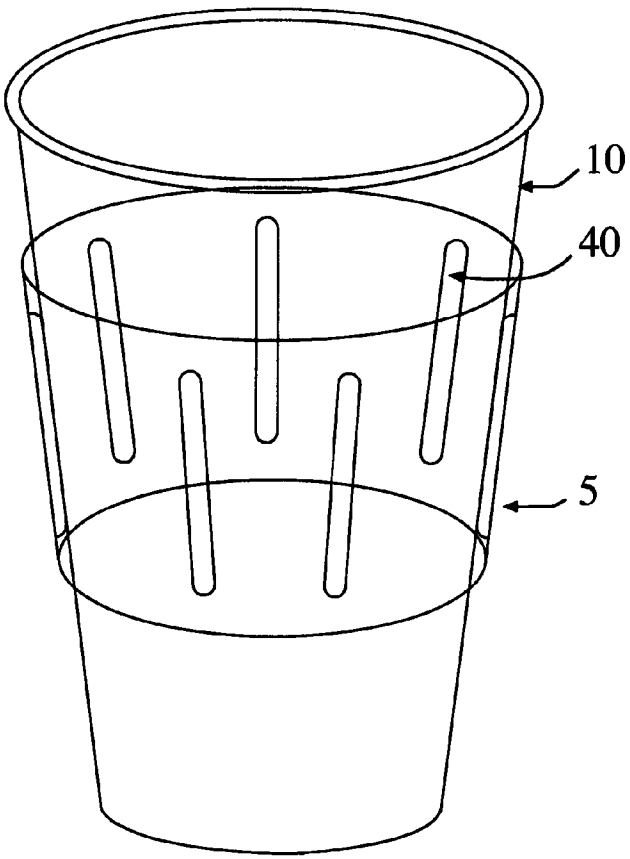
Figure 8A:
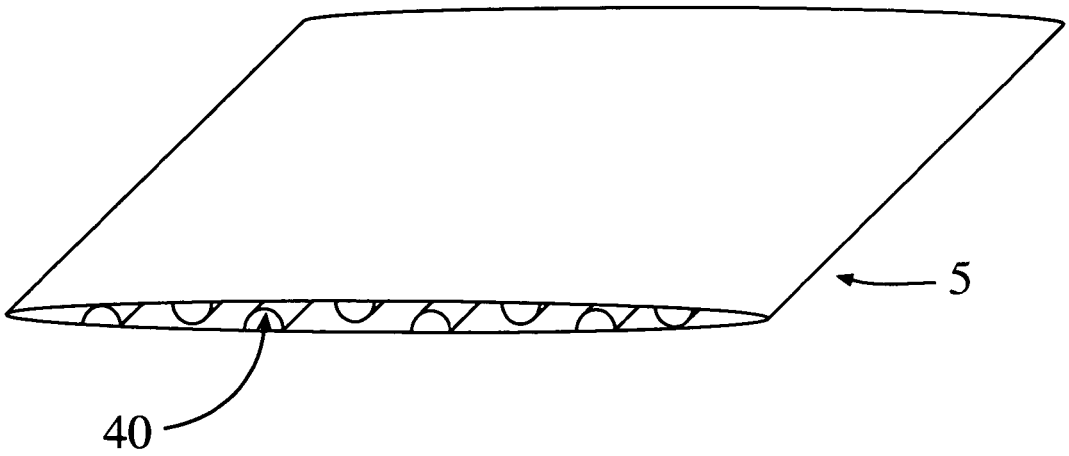
Figure 8B:
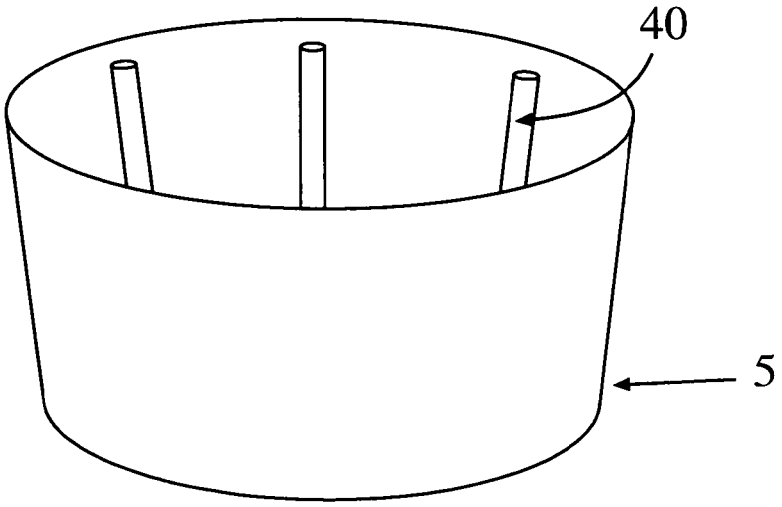

FIGS. 6A through 7A show a short insulating sleeve that uses minimal material and provides minimal protection and insulation, while FIG. 7B illustrates a long insulated sleeve that provides the contents of the cup greater insulation by covering more of the cup's surface area, as well as provide greater protection for the user's hand.

FIGS. 8A, 10B, 13B, 15B, 18B and 20B illustrate the insulating sleeve 5 folded to minimizing the storage area for the sleeve.

Figure 9B:
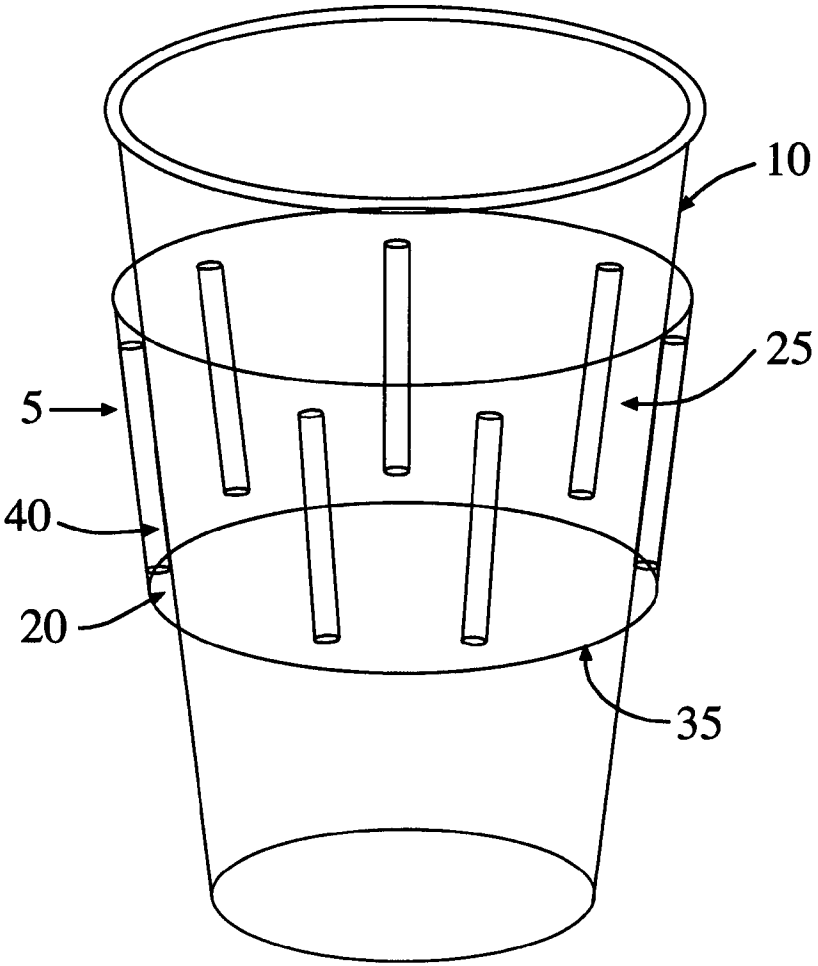
Figure 9A:
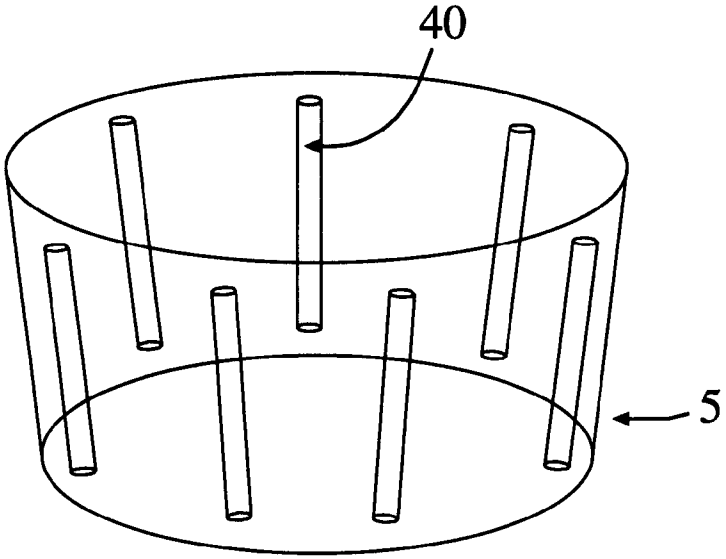
Figure 10A:
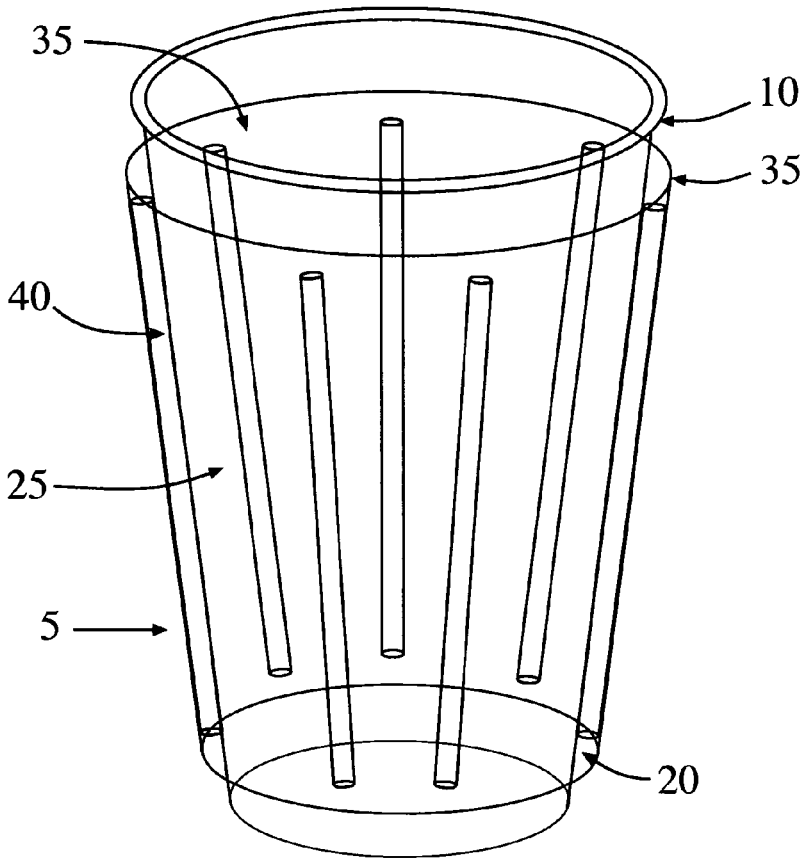
Figure 10B:
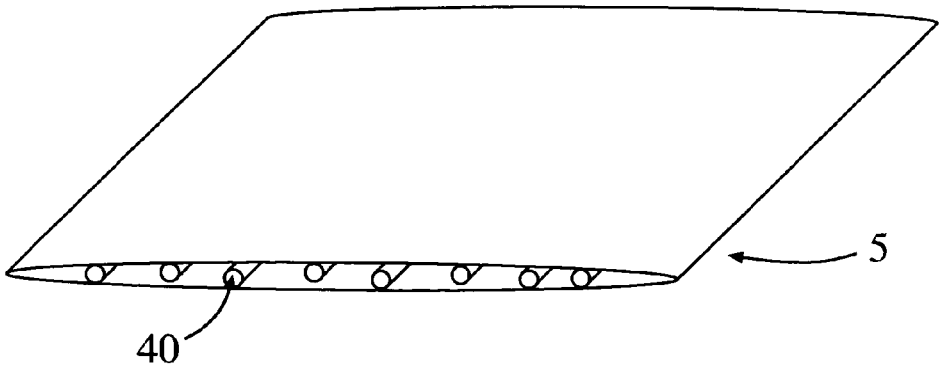

FIGS. 9B and 10A's transparent view of the cup 10 supported by the sleeve's 5 structural beams shows in detail the insulating air chamber 20 formed between the outer surface of the sleeve 25 and the surface of the cup 10. Additionally illustrated is the extension of the sleeve 35 beyond the structural members 40 that allow the manufacturer to minimize the amount of material used in creating the structural members 40 while still providing the amount of surface area 25 needed to shield the user's hand from the cup. As illustrated, the sleeve may cover only a portion of the cup, or it may cover substantially all the cup.

Figure 11B:
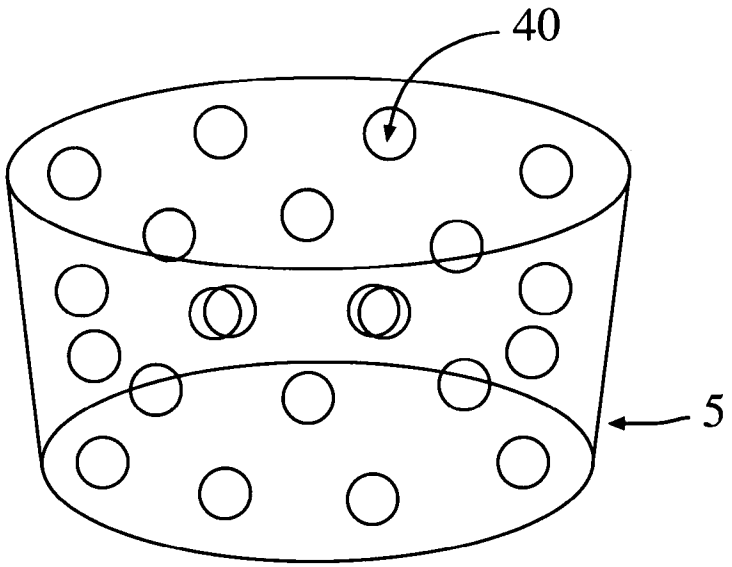
Figure 11A:
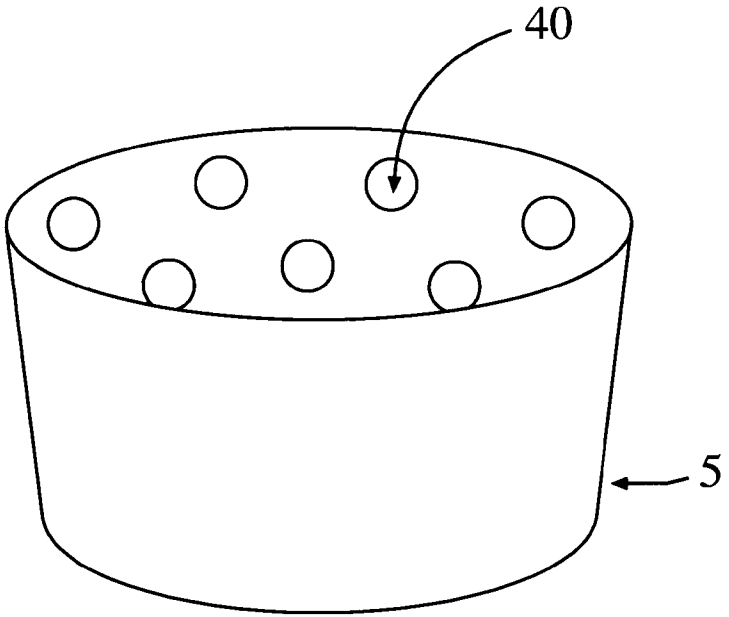

FIG. 11A illustrates round half-spheres as structural members. Using round half-spheres to create the insulating air chamber further minimizes the amount of material needed to create the sleeve as well as the simplicity of mating the cup and sleeve. Using round half-spheres allows the user to slip the cup into the sleeve while it is still partially folded, because there are no rings or members to align.

Figure 12B:
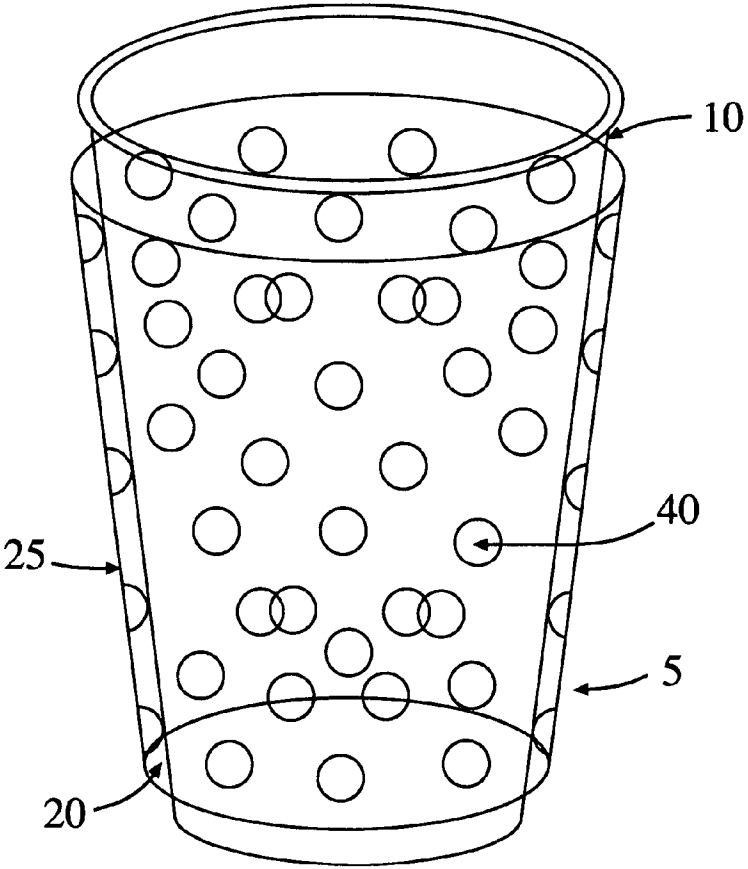
Figure 12A:
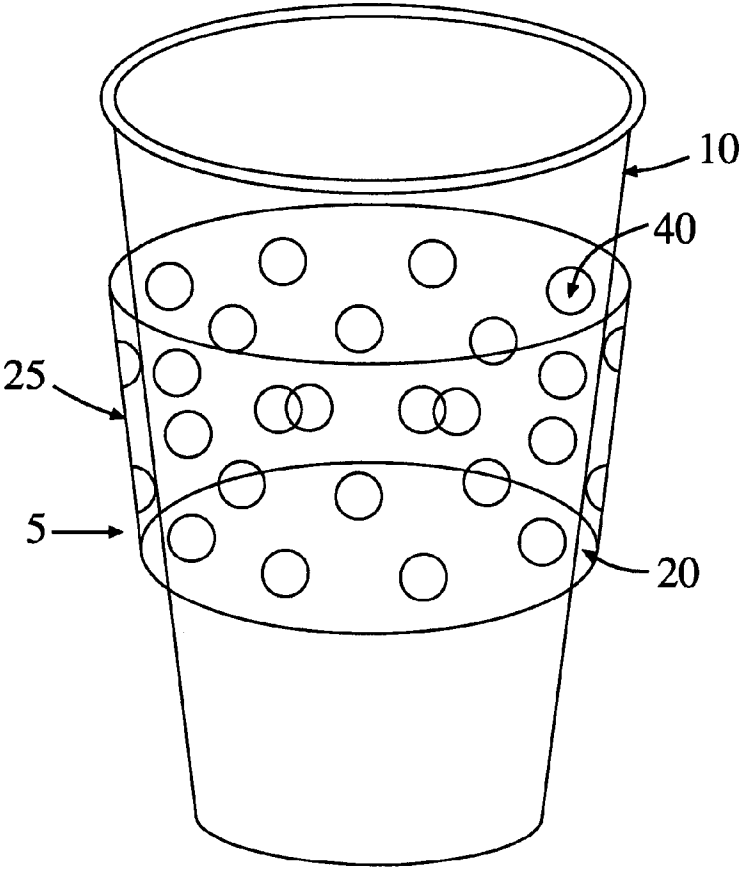
Figure 13A:
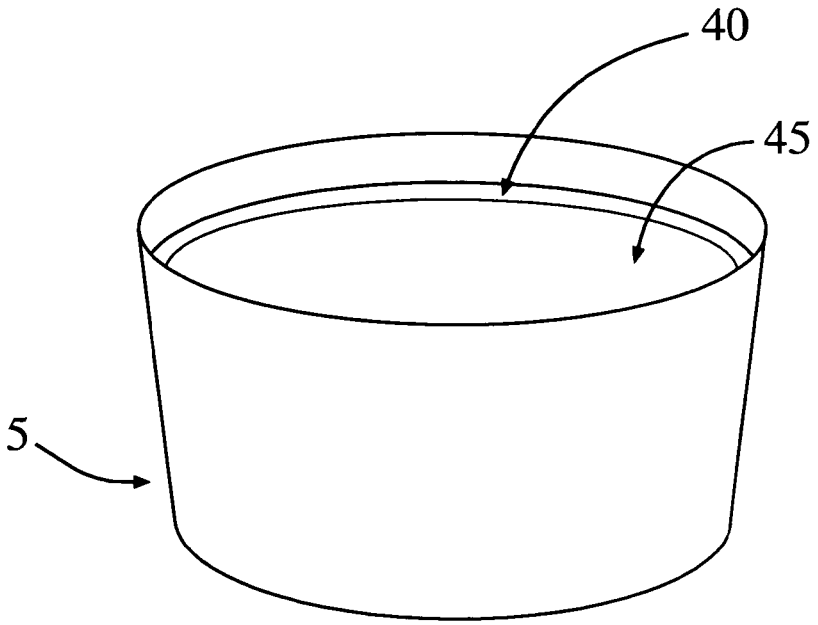
Figure 13B:
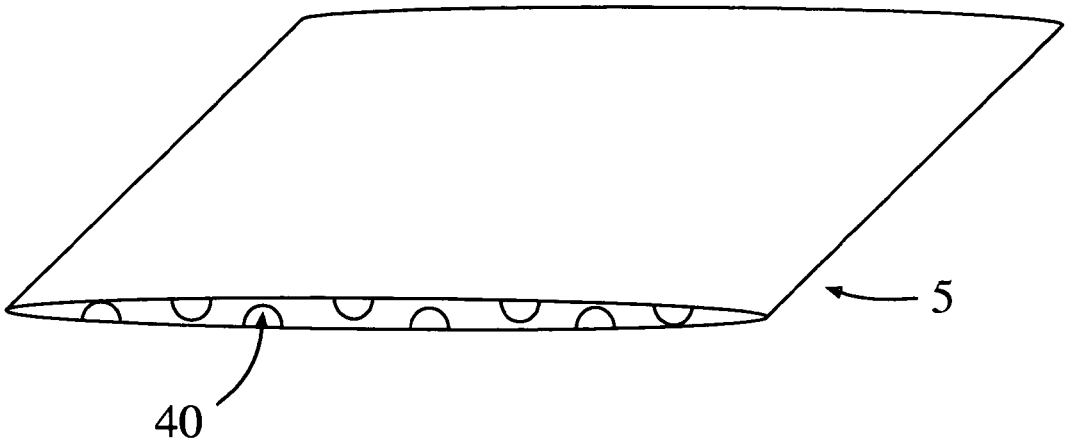
Figure 14B:
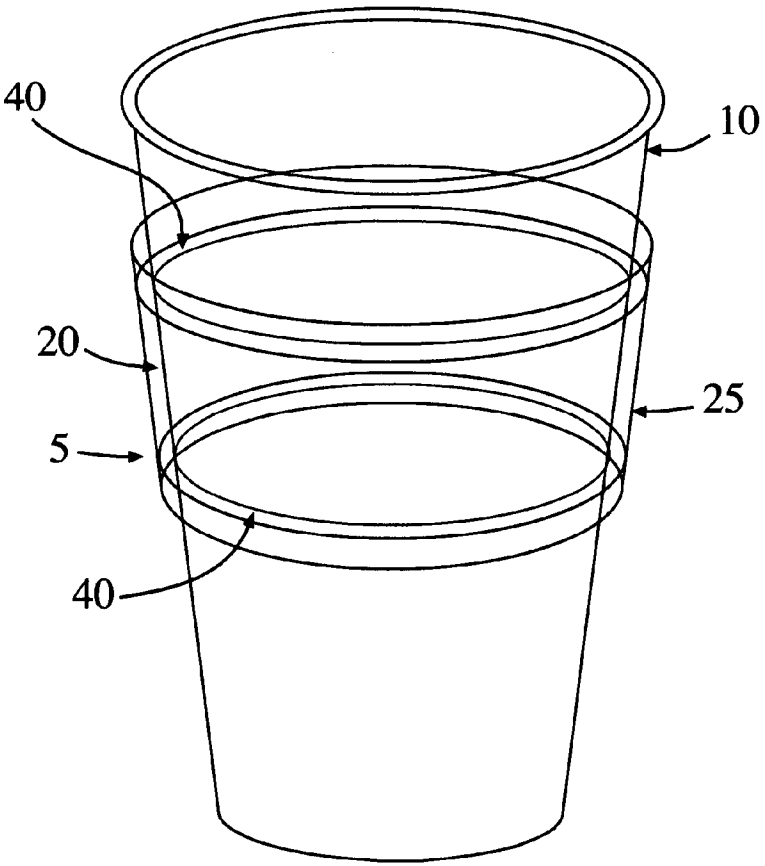
Figure 14A:
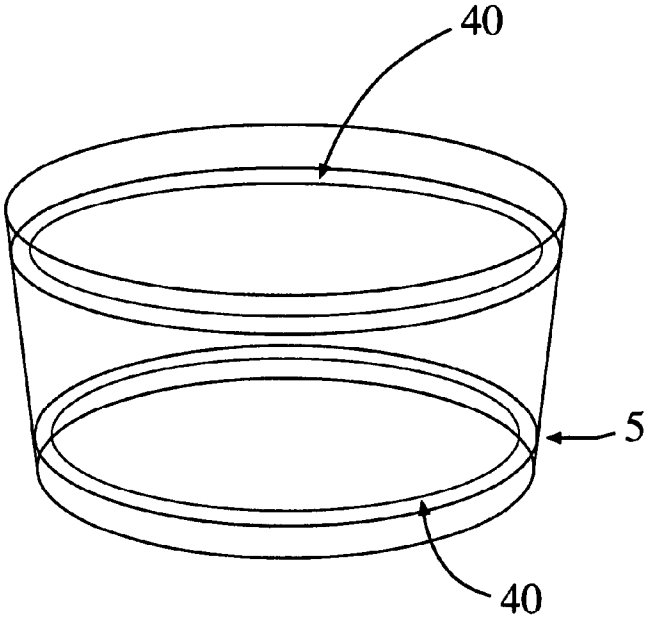

FIGS. 12A and 12B illustrate an embodiment where the structural members 40 are round half spheres that create the insulating air chamber 20 between the surface of the sleeve 25 and the surface of the cup 10. The length may be either short, covering only a portion of the cup's surface, or long covering substantially the entire length of the cup.

FIGS. 13A, and 14A through 15B illustrate a support structure comprising a tubular circle 40 along the sleeve's inner wall 45. The continuous contact between the structural member 40 and the cup 10 provides greater support to the cup 10 when the weight of the cup 10 is great. In addition, the continuous contact of the structural member 40 with the cup 10 creates an insulating air chamber 20 with less air moving between the cup 10 and the sleeve 5, thus providing insulation for the cup 10.

Figure 15A:
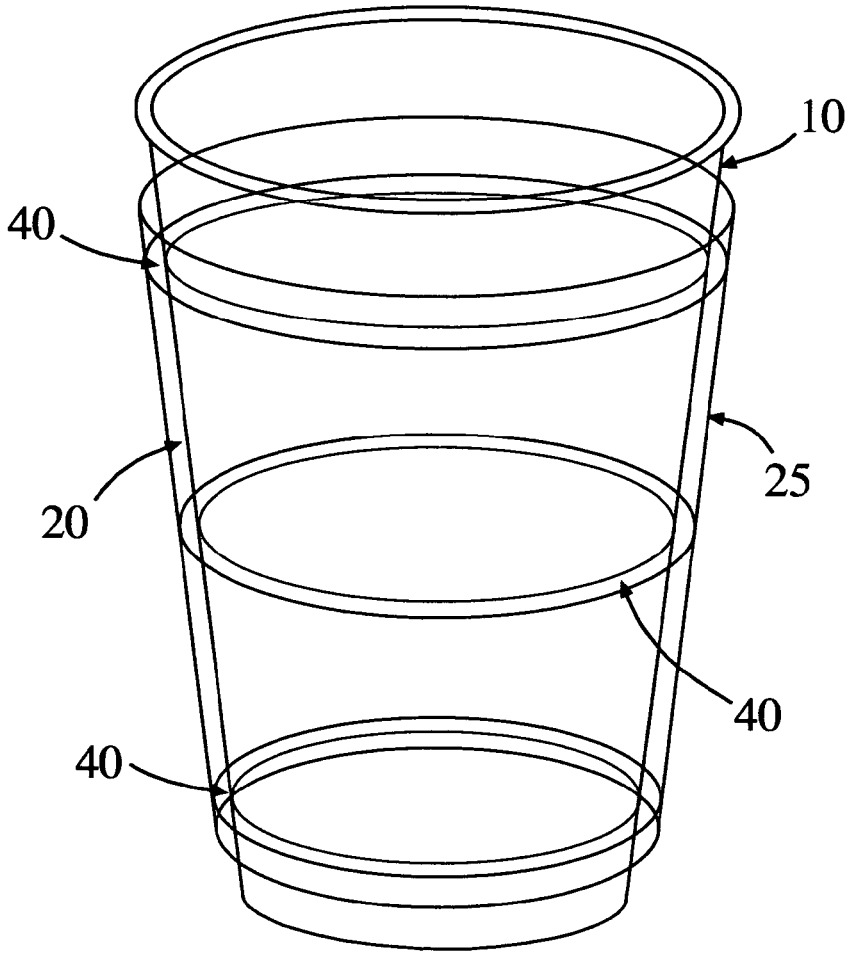
Figure 15B:
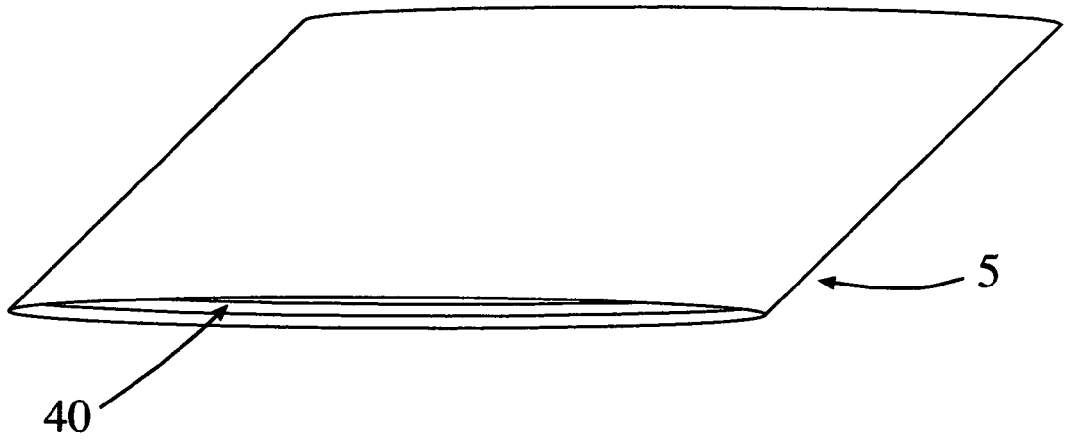
Figure 16B:
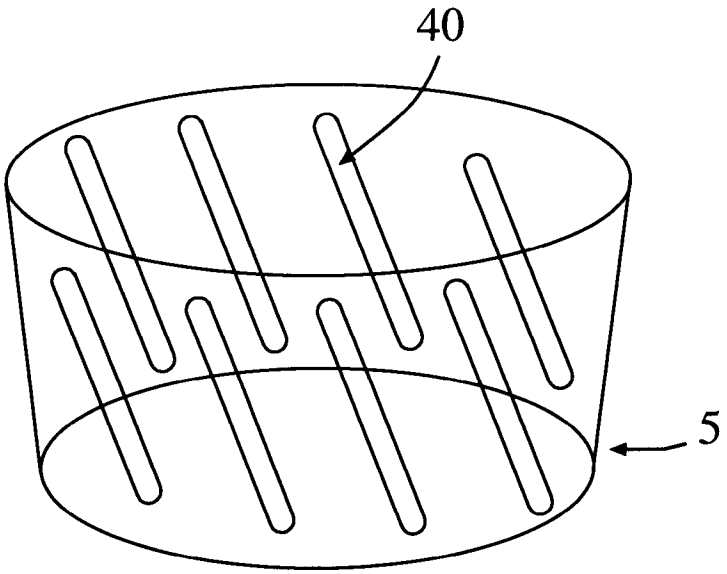
Figure 16A:
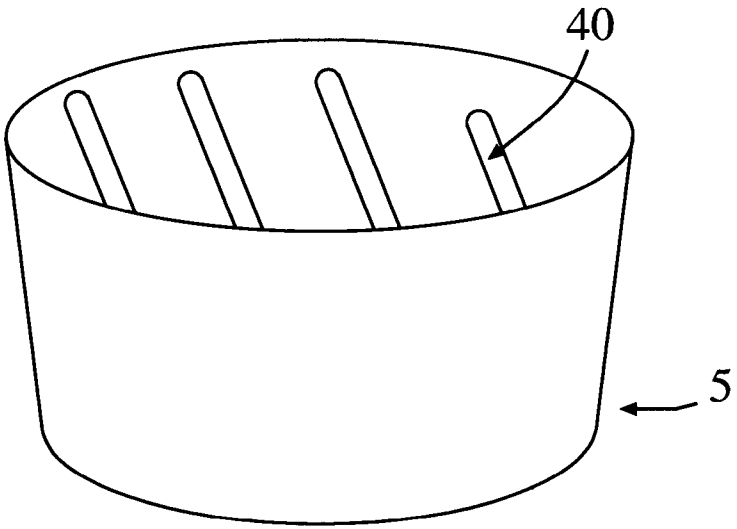
Figure 17B:
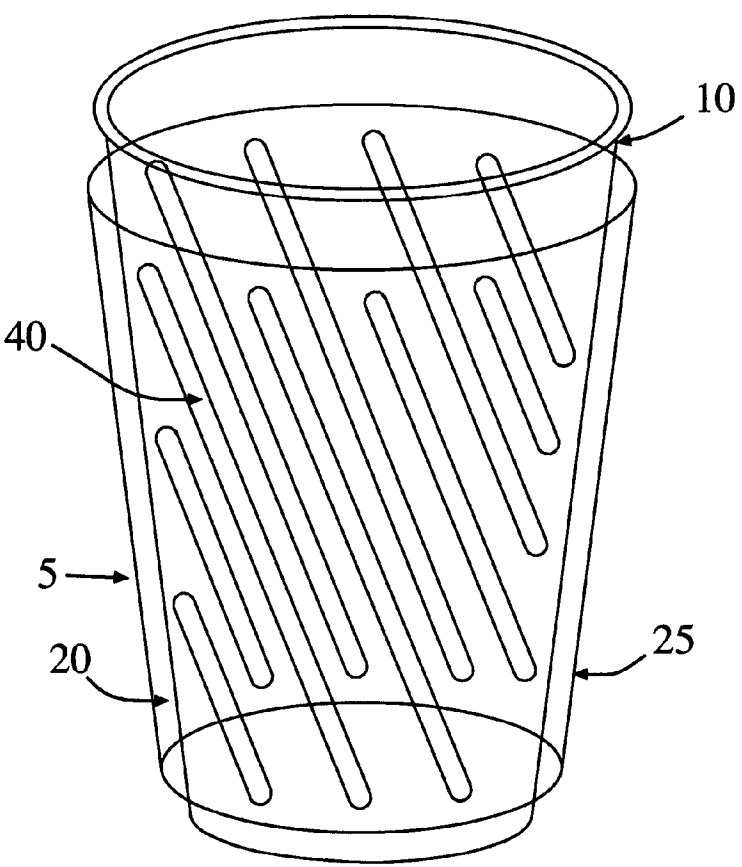
Figure 17A:
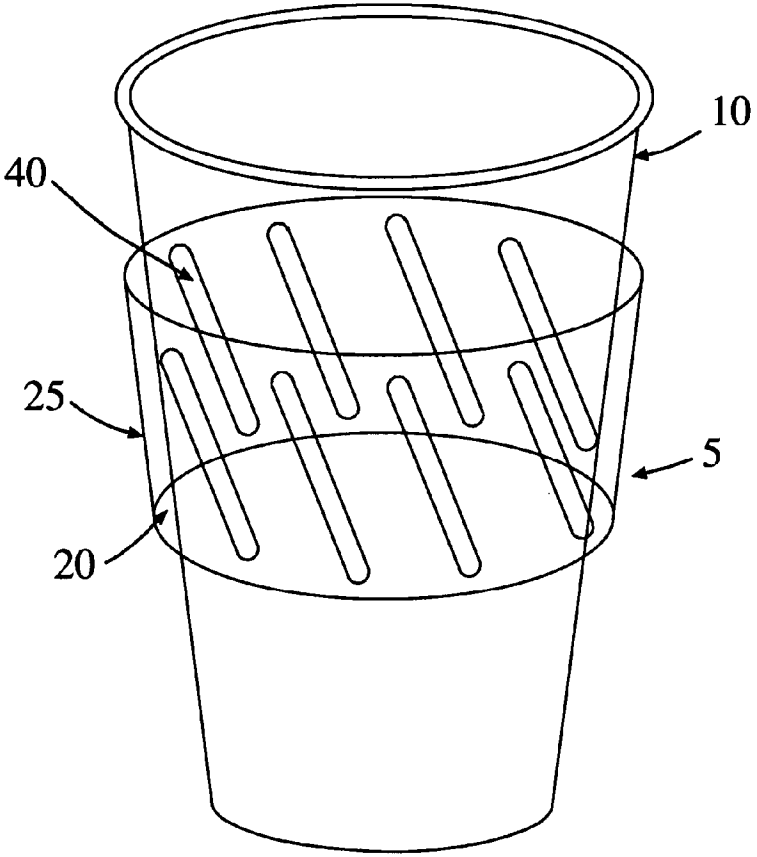
Figure 18A:
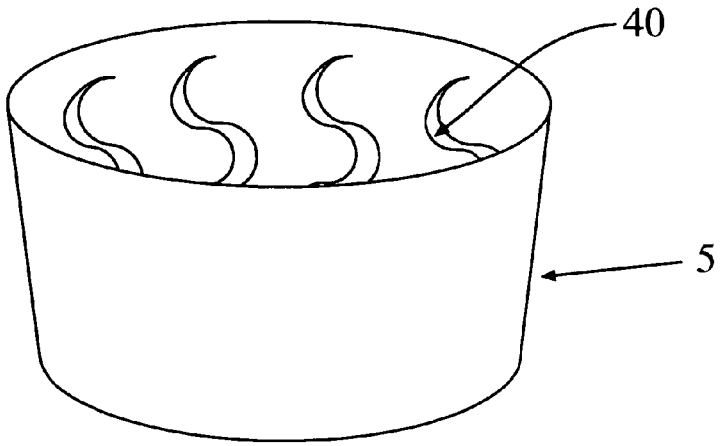
Figure 18B:
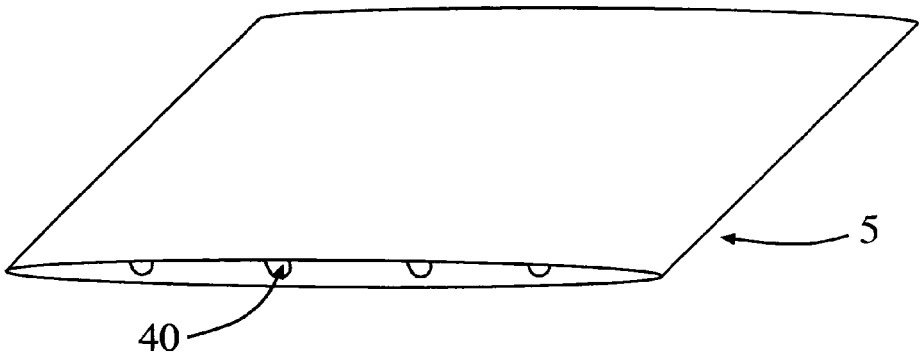
Figure 19B:
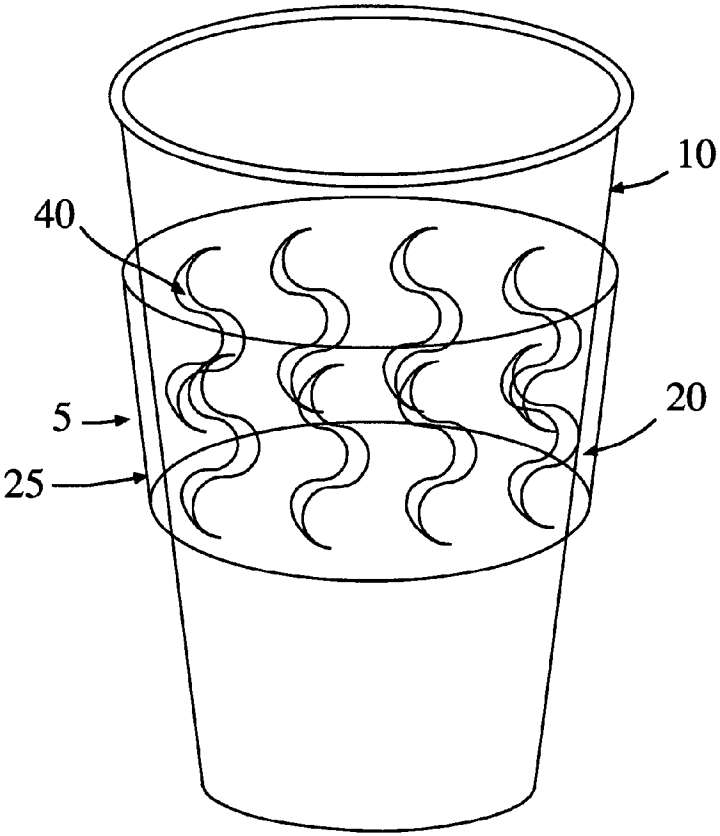
Figure 19A:
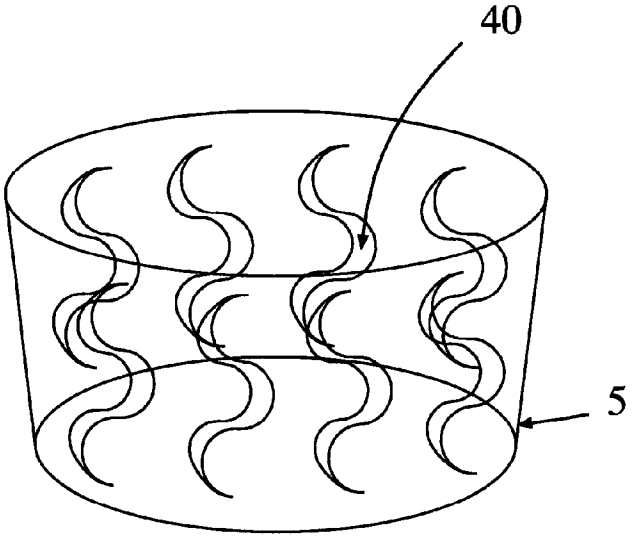
Figure 20A:
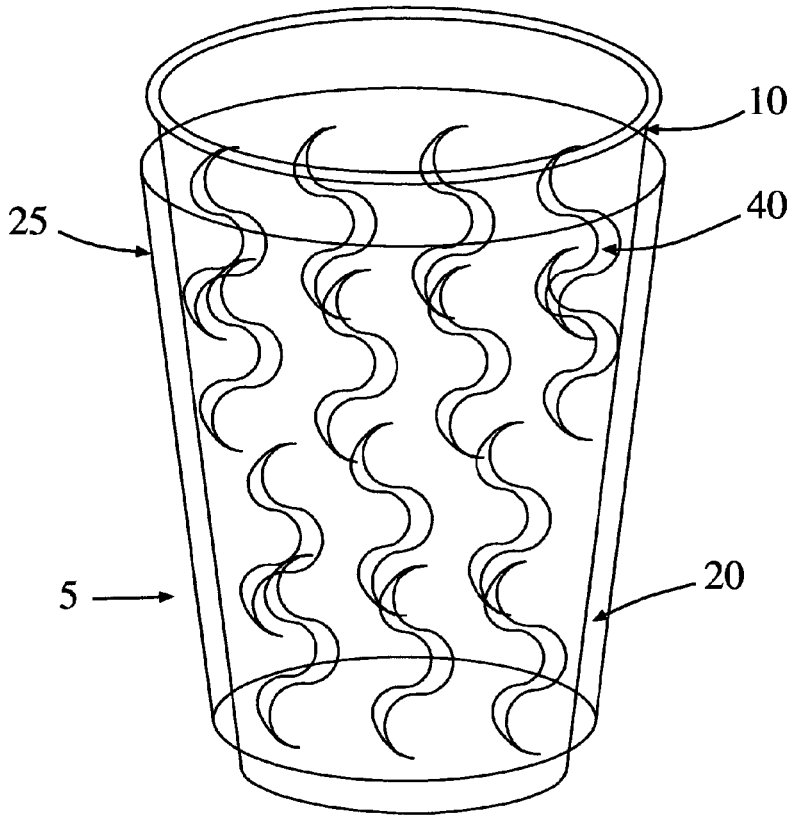
Figure 20B:
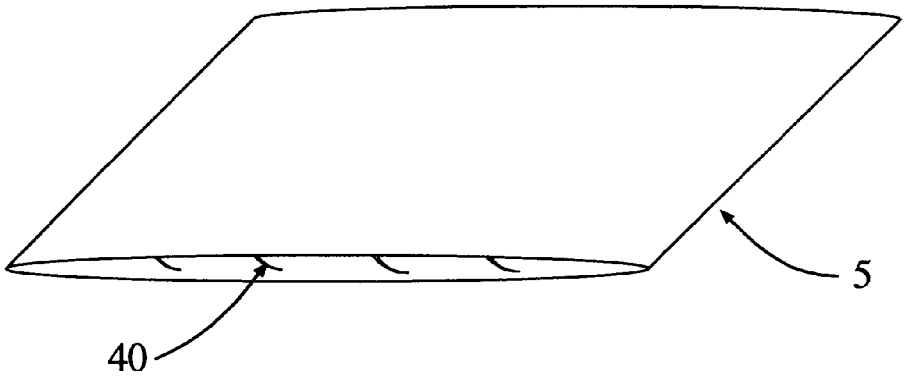

FIG. 15A illustrates the teaching of the present invention wherein the number of structural support tubular rings 40 in increased with the length of the sleeve 5 to provide support for the user when gripping the sleeve 5 and cup 10.

FIGS. 16A through 17B illustrate slanted half-circle structural beams 40 as both short and long.

FIGS. 18A and 19A-20B illustrate a flame structural beam 40, which provides increased multi-directional friction between the cup 10 and both a short and long sleeve.

Figure 21B:
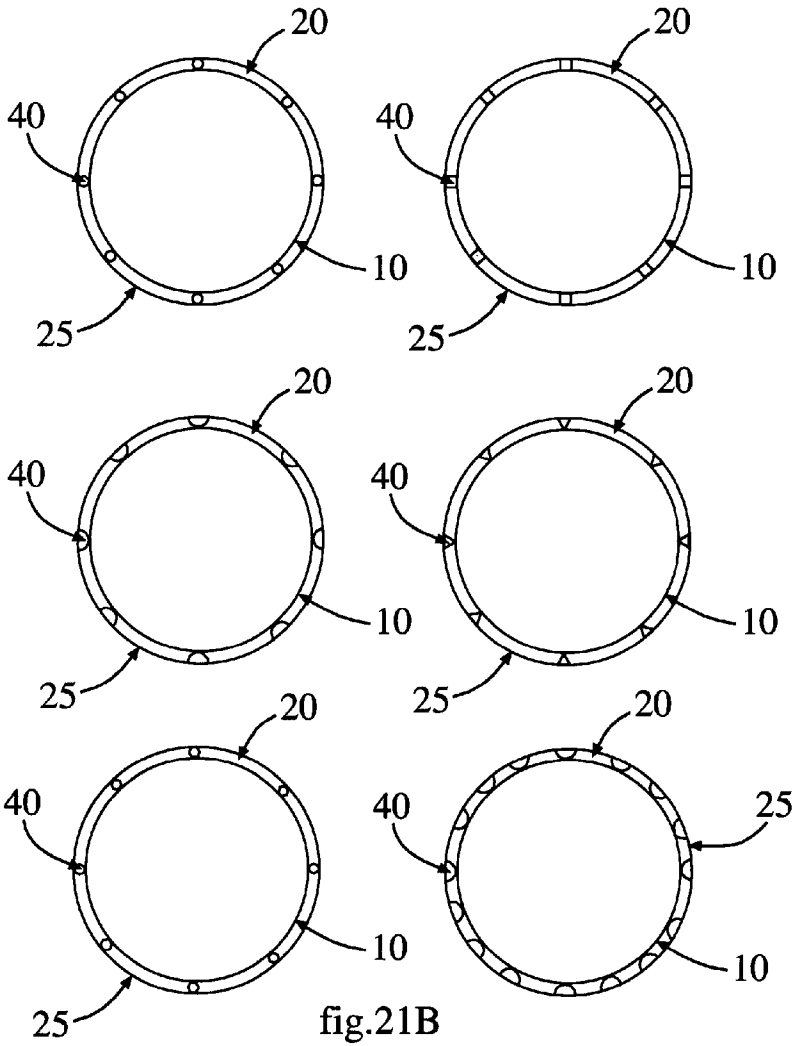
FIG. 21B illustrates an exemplary selection of structural beams in insulating sleeve wall.
Figure 21A:
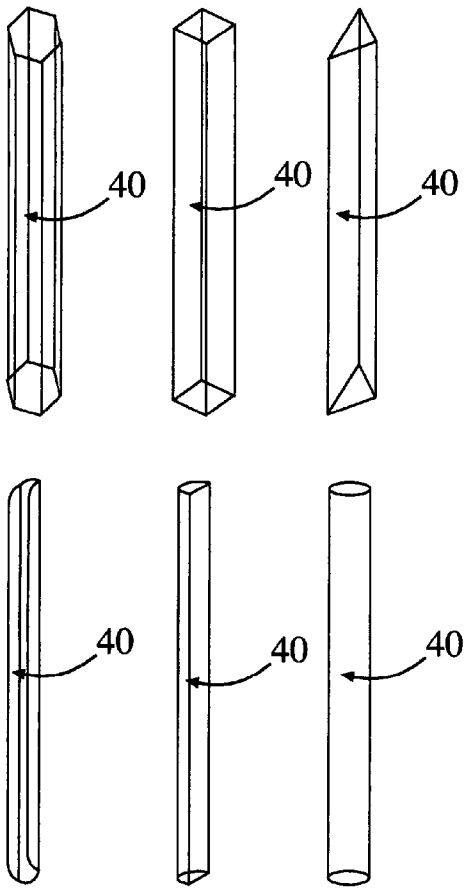
FIG. 21A illustrates an exemplary selection of structural beams for wall of sleeve insulator.

FIGS. 21A and 21B illustrate an exemplary selection of cross-sections used as structural members 40.

Figure 22B:
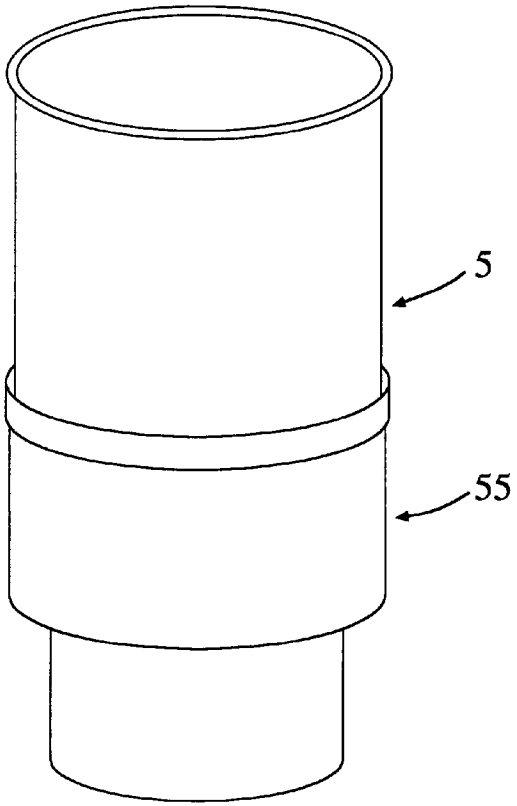
FIG. 22B illustrates an exemplary embodiment of an insulating sleeve inside adapted holder.
Figure 22A:
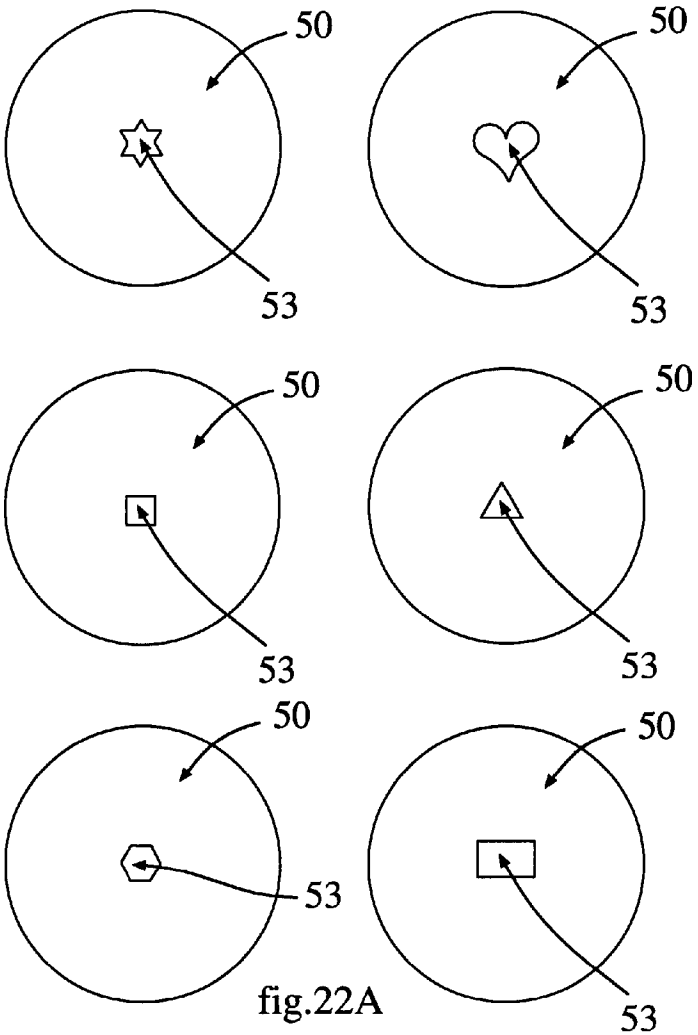
FIG. 22A illustrates an exemplary selection of openings for insulated lids.

FIG. 22A illustrates an exemplary selection of shaped openings in insulating lids 50. The openings may be used for venting, passing a straw, or passing the contents of the cup. The insulating lid 50, described below, helps create another temperature gradient around the cup to help insulate the cup's contents.

FIG. 22B illustrates an embodiment of an insulating sleeve 5 with cup inside in an adaptor 55 adapted to fit the sleeve 5 into a cup holder (not shown). Often, cup holders are sized so a cup fits snugly into the holder. If an insulating sleeve substantially increases the circumference of a cup, the user may be precluded from using the cup holder. By providing this embodiment, the user may use both an insulating sleeve 5 and a cup holder.

Figure 23B:
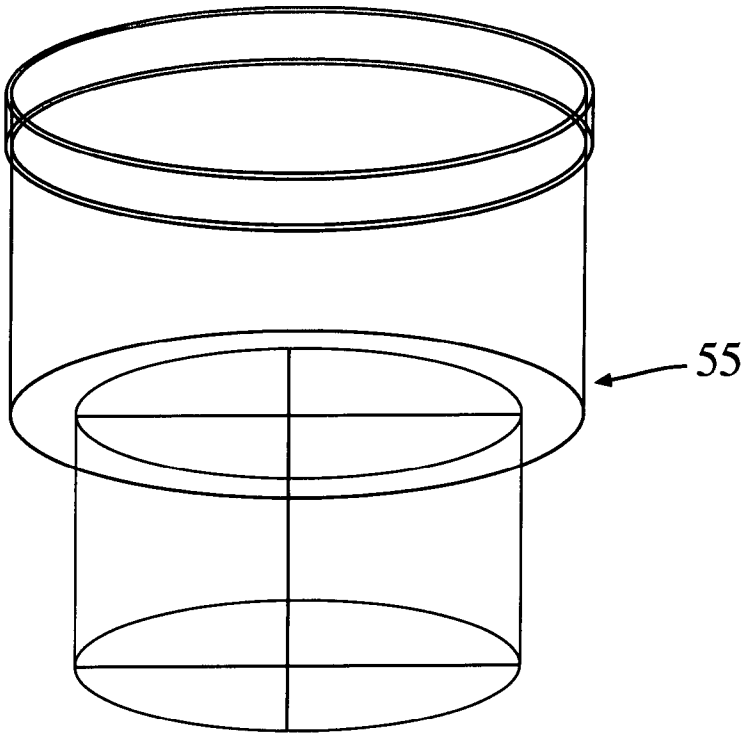
FIG. 23B illustrates a transparent view of an exemplary embodiment of an adapted holder.
Figure 23A:
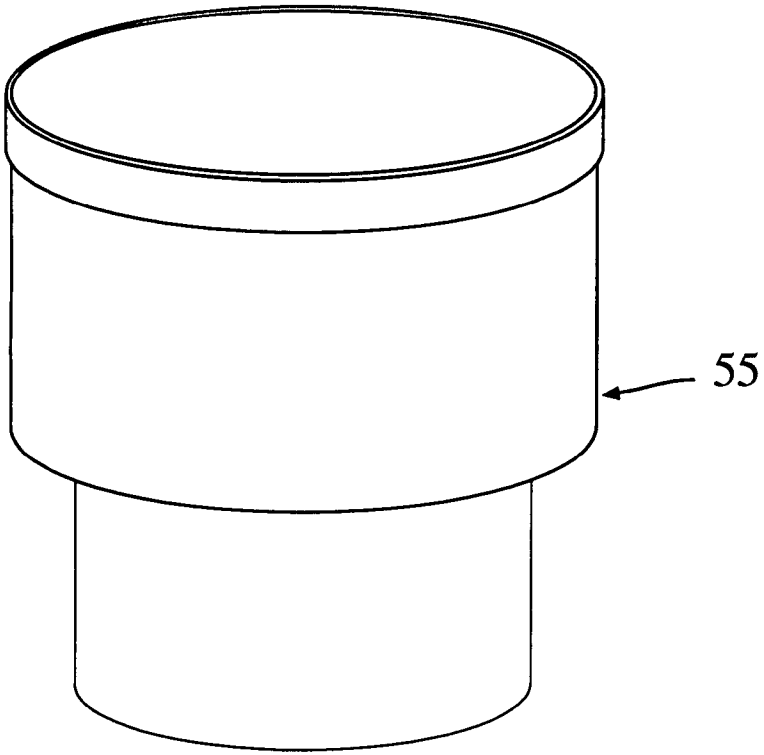
FIG. 23A illustrates an exemplary embodiment of an adapted holder.

FIGS. 23A and 23B illustrate the adapter 55 used to fit the sleeve and cup into a cup holder. The adapter provides a wide receiving end for receiving the cup and insulating sleeve. In addition, the adapter adapts the wide end to a narrower end to fit into a standard cup holder. It is anticipated that the narrower end can be adapted to fit any size cup holder, including widening the cup and sleeve combination, including widening the base to fit between two armrests 60.

Figure 24B:
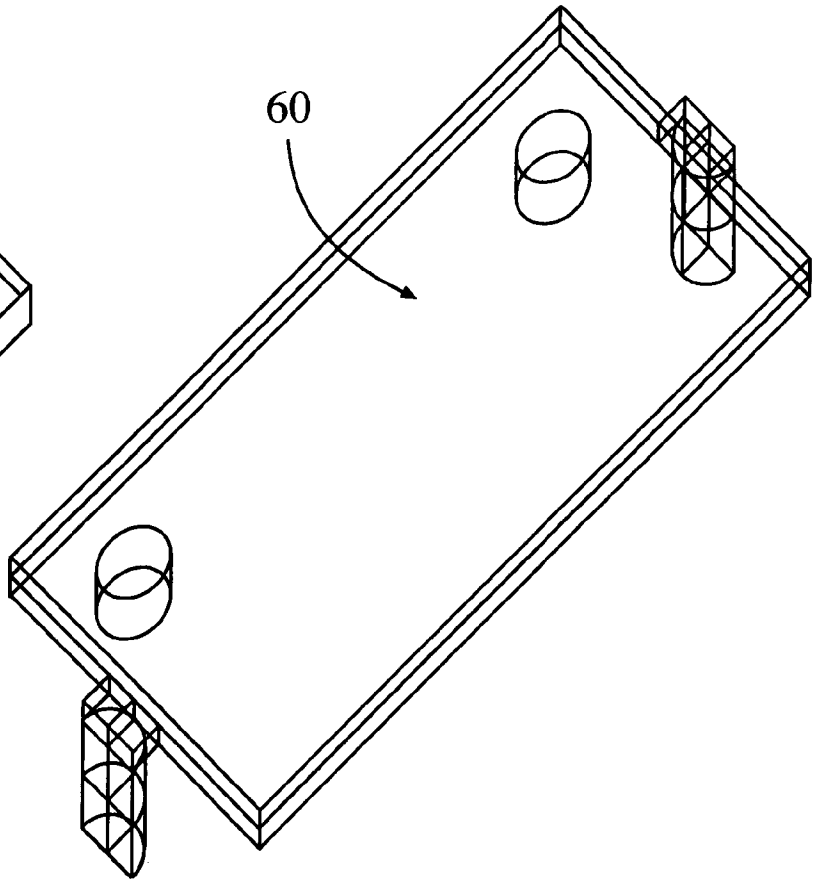
FIGS. 24A-24B illustrate an adapted holder.
Figure 24A:
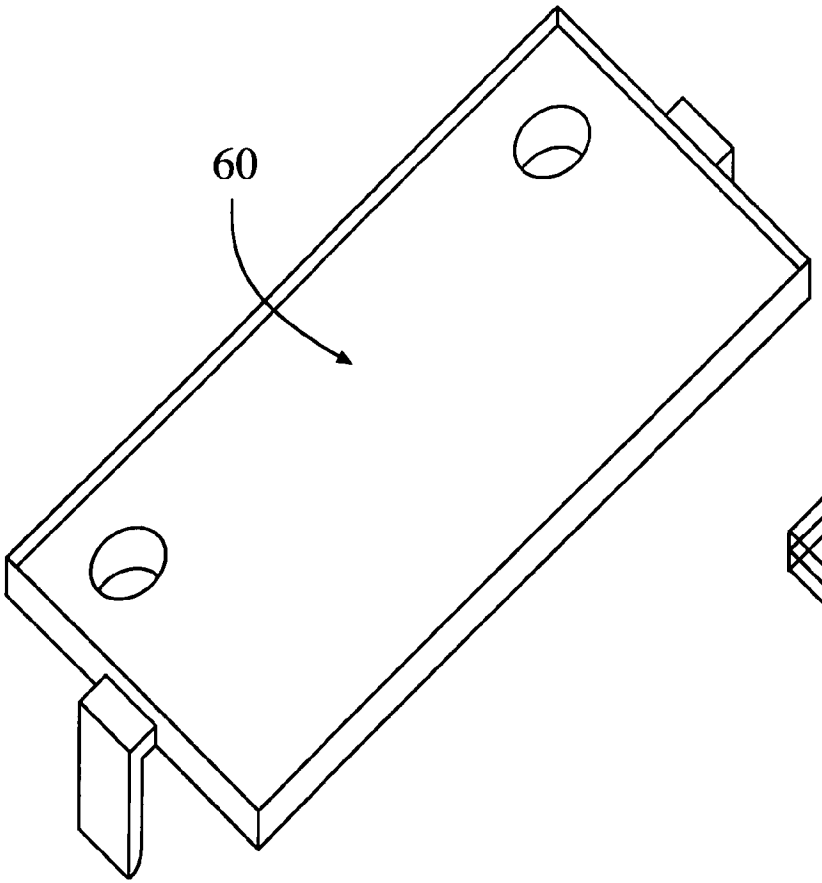

FIGS. 24A through 24B illustrate adapter 55 widened to support 60 a drink and provide a working or resting surface in a theatre. Also anticipated are cup holders in cars, on airliners, at bars, as well as any other place commonly known in the art.

Figure 25A:
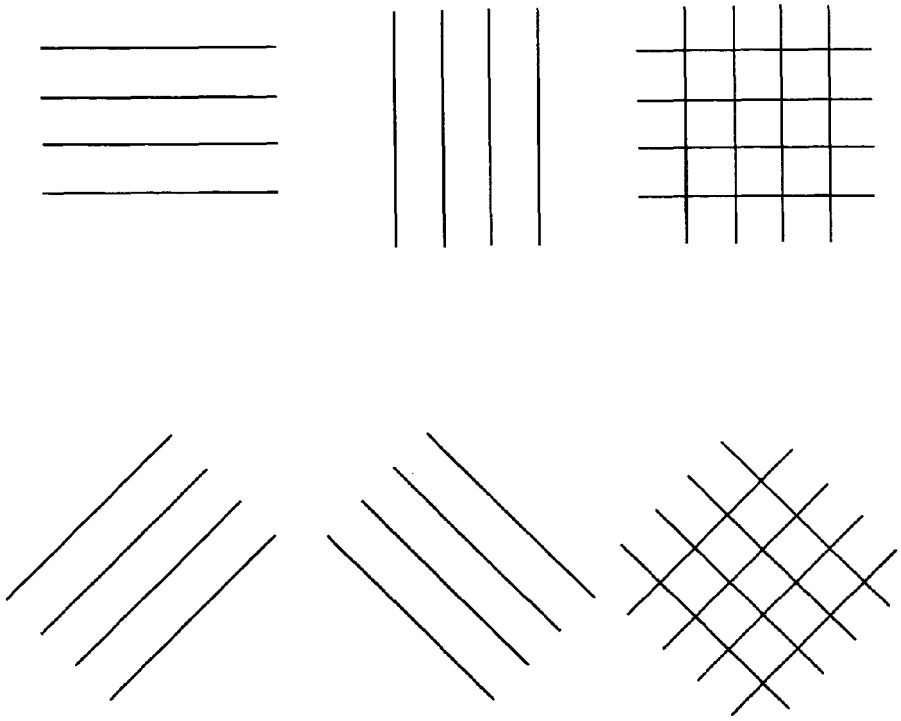
FIGS. 25A-25B illustrate an exemplary selection of structural beam layouts.
Figure 25B:
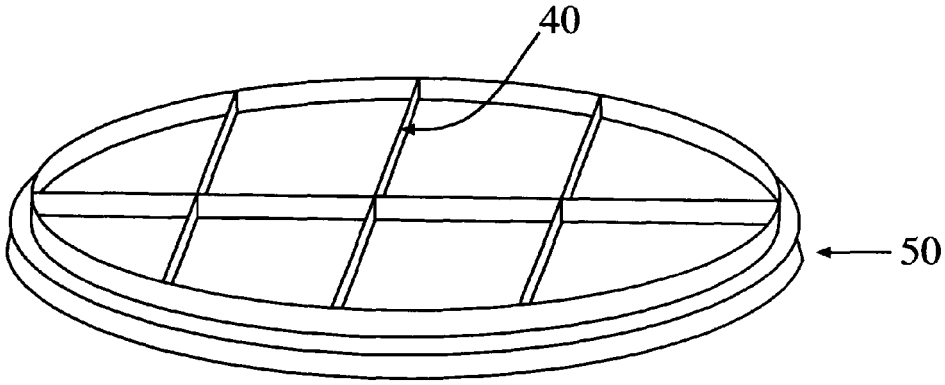
Figure 26B:
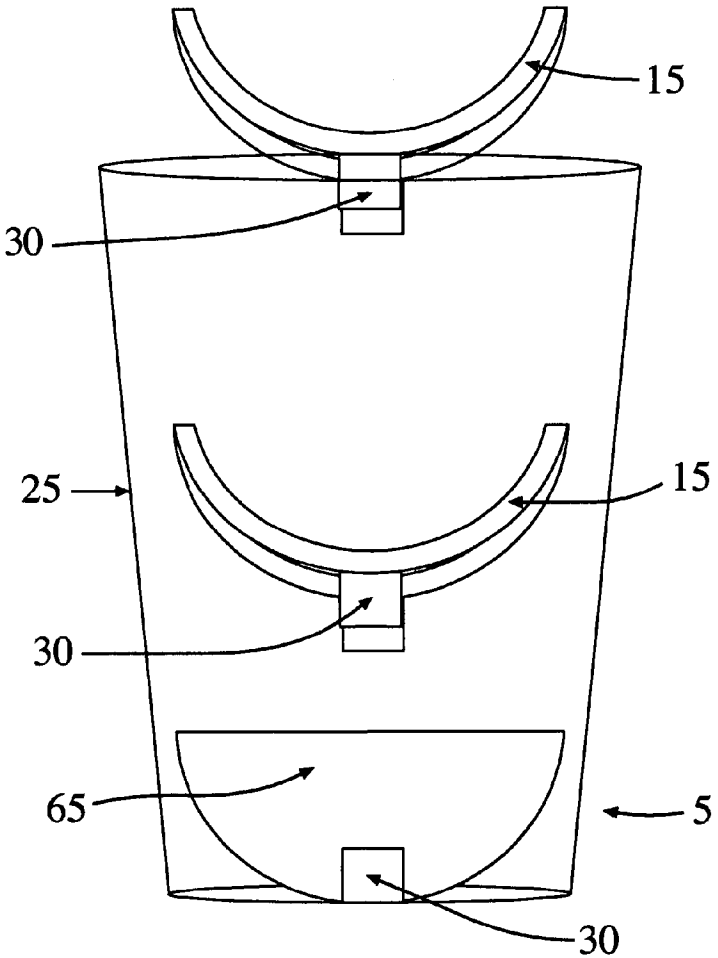
FIGS. 26A-29B illustrate an insulated sleeve with supports.
Figure 26A:
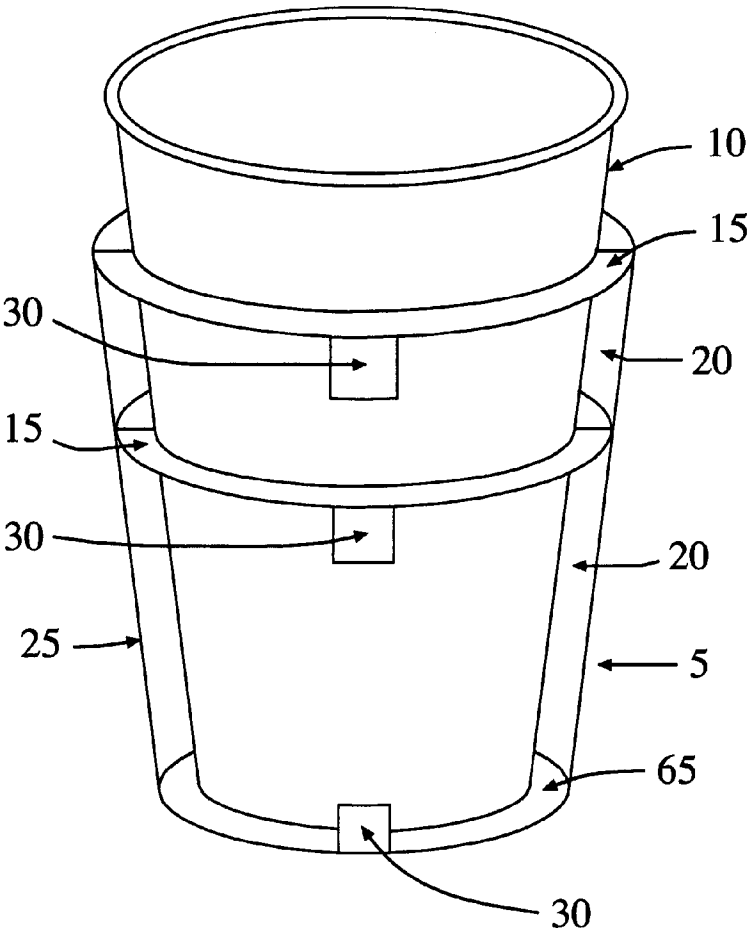
Figure 27B:
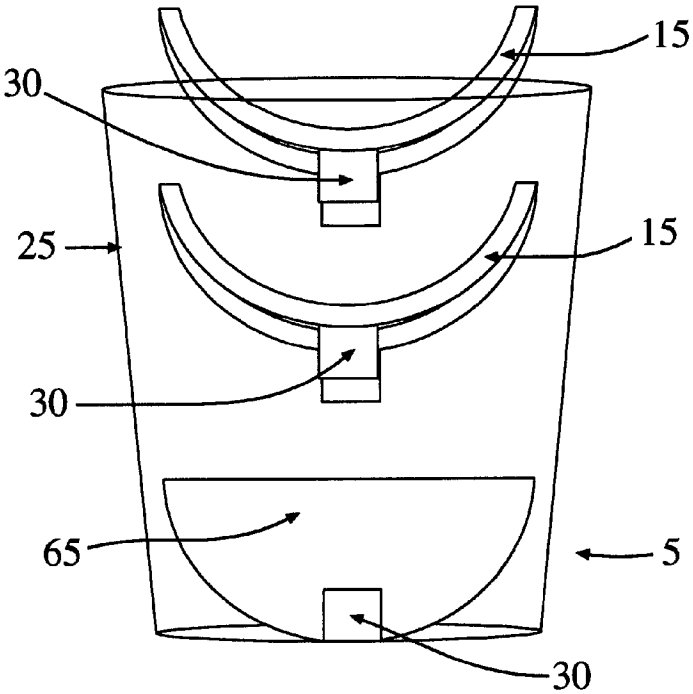
Figure 27A:
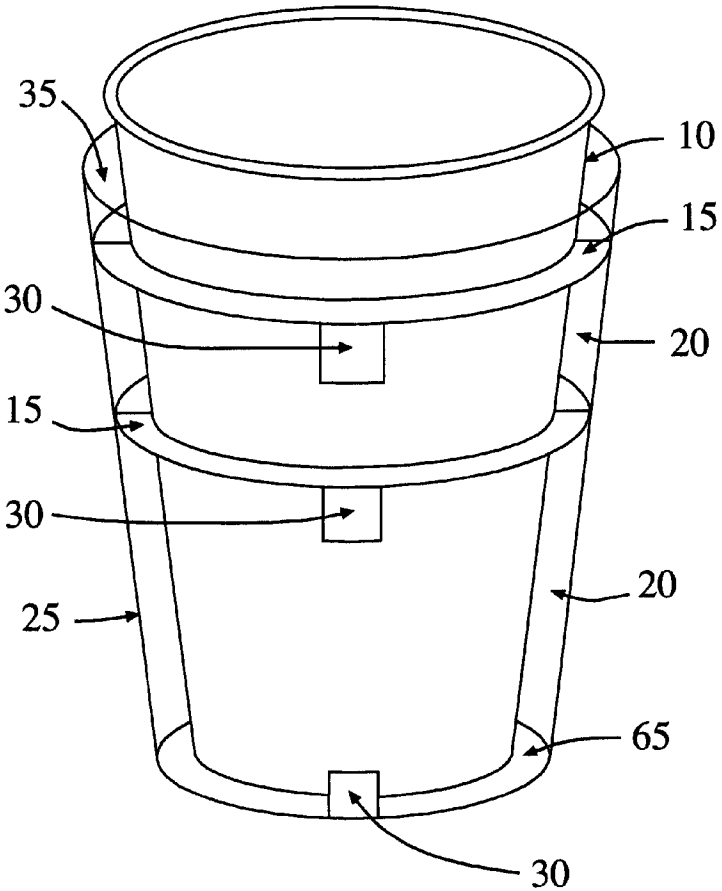
Figure 28B:
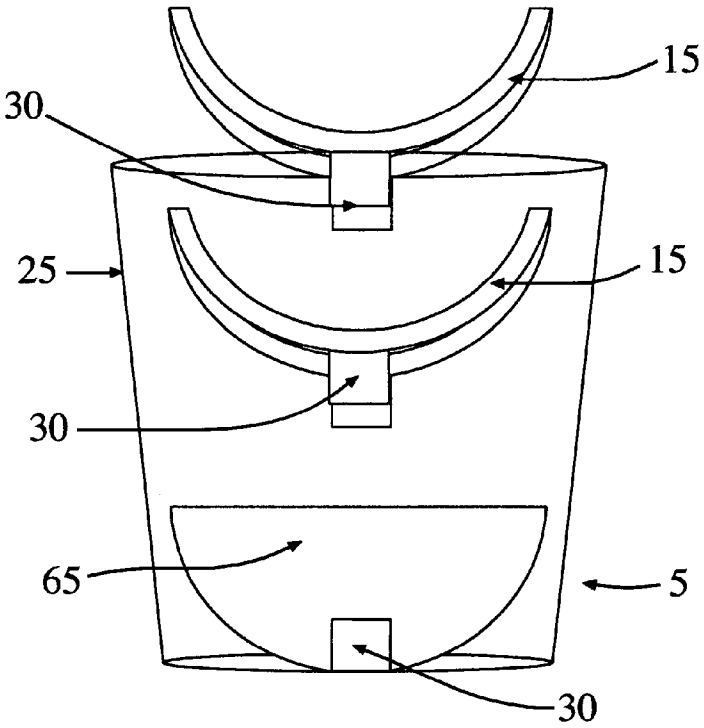
Figure 28A:
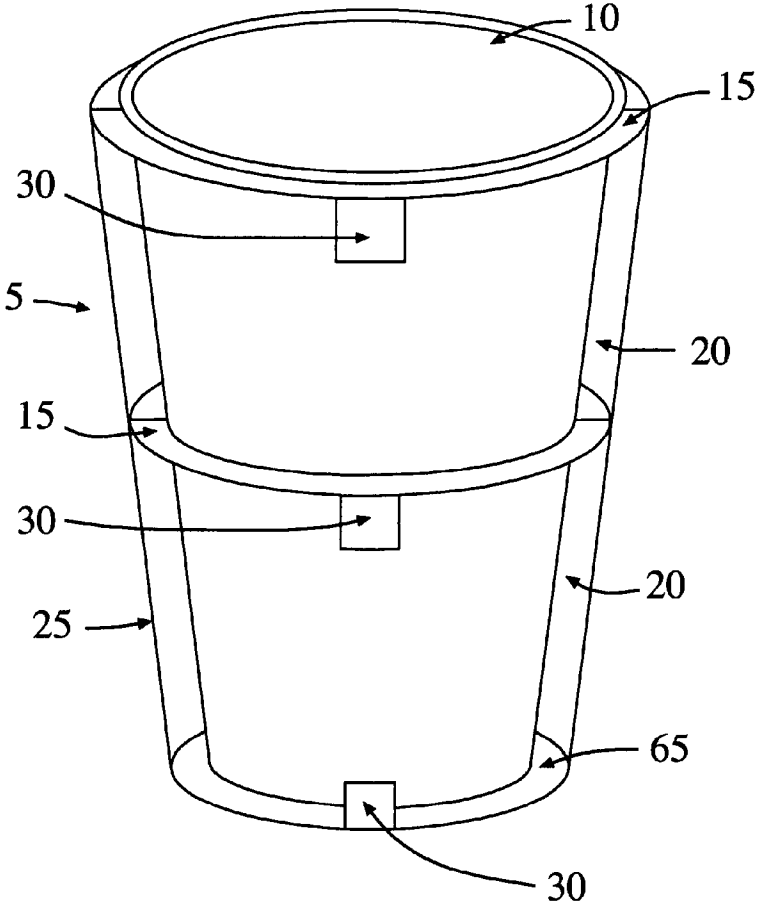
Figure 29B:
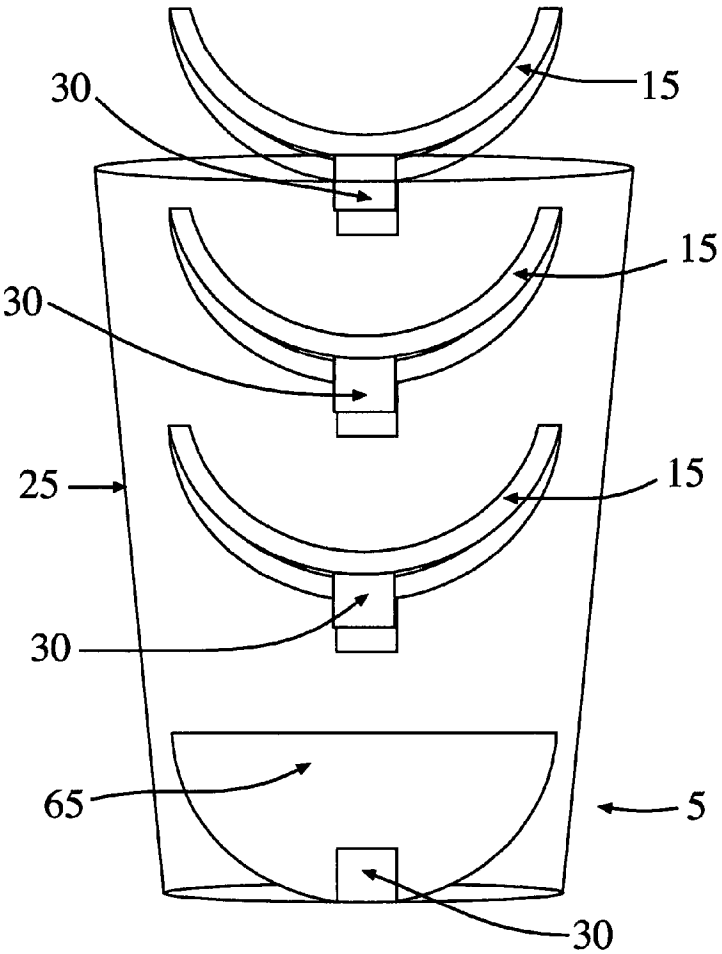
Figure 29A:
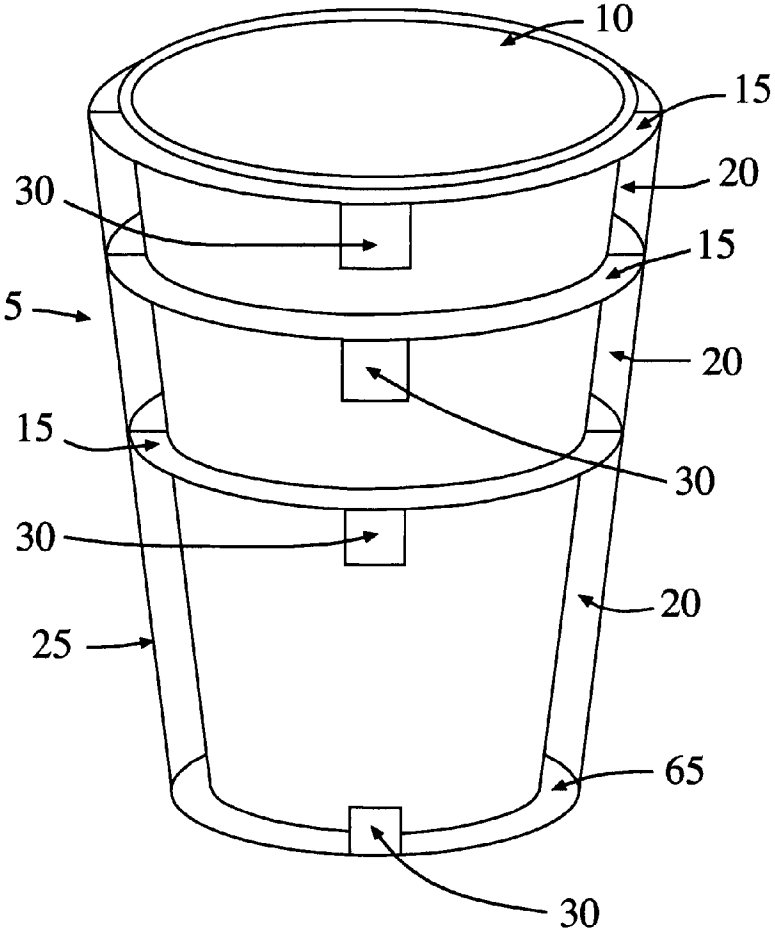
Figure 30B:
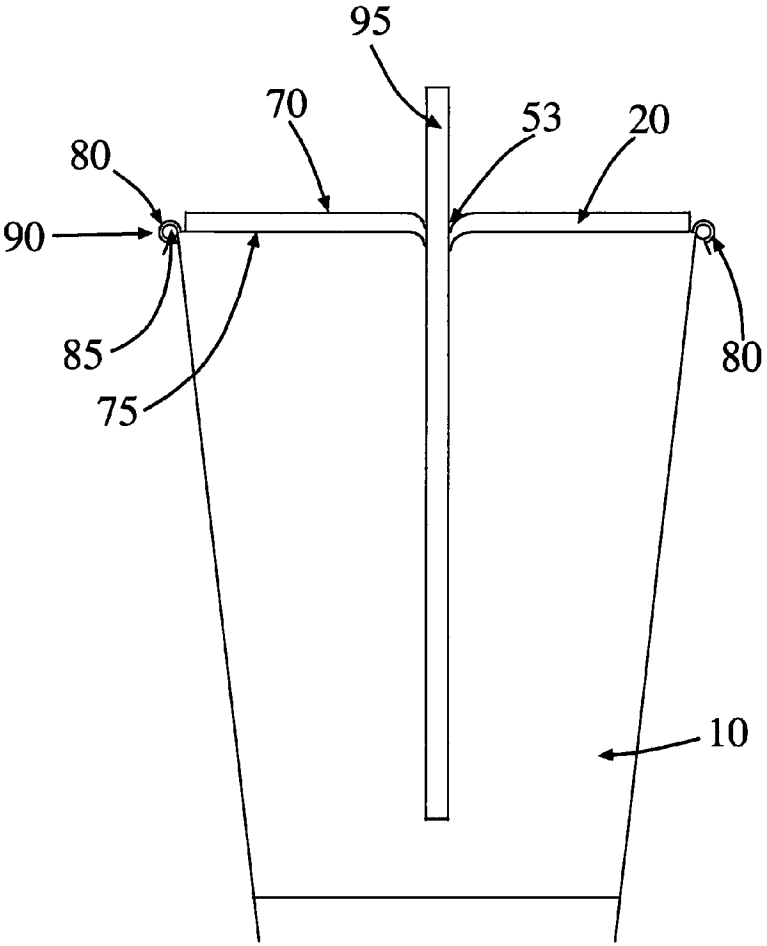
FIG. 30B provides an illustration of a cross-sectional view of a flat insulating lid.
Figure 30A:
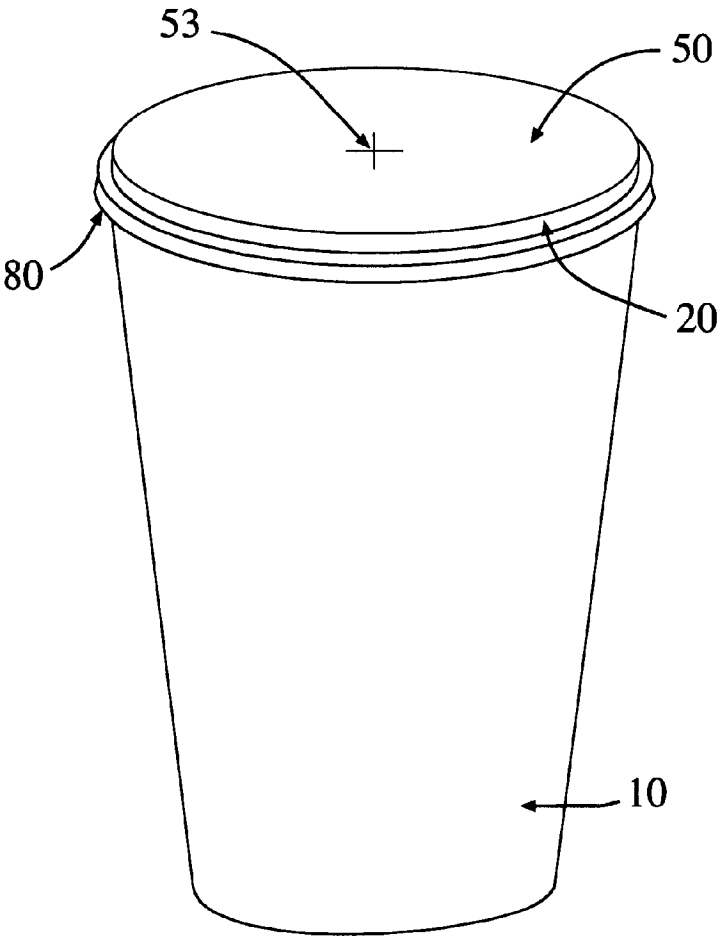
FIG. 30A provides an illustration of a flat insulating lid.
Figure 30D:
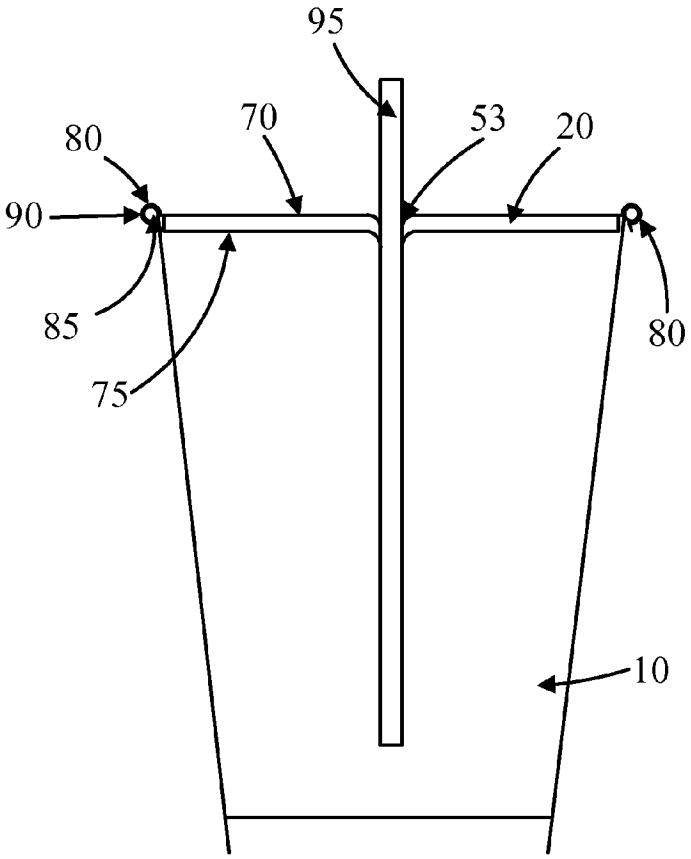
FIG. 30D provides an illustration of a cross-sectional view of a flat insulating lid.
Figure 30C:
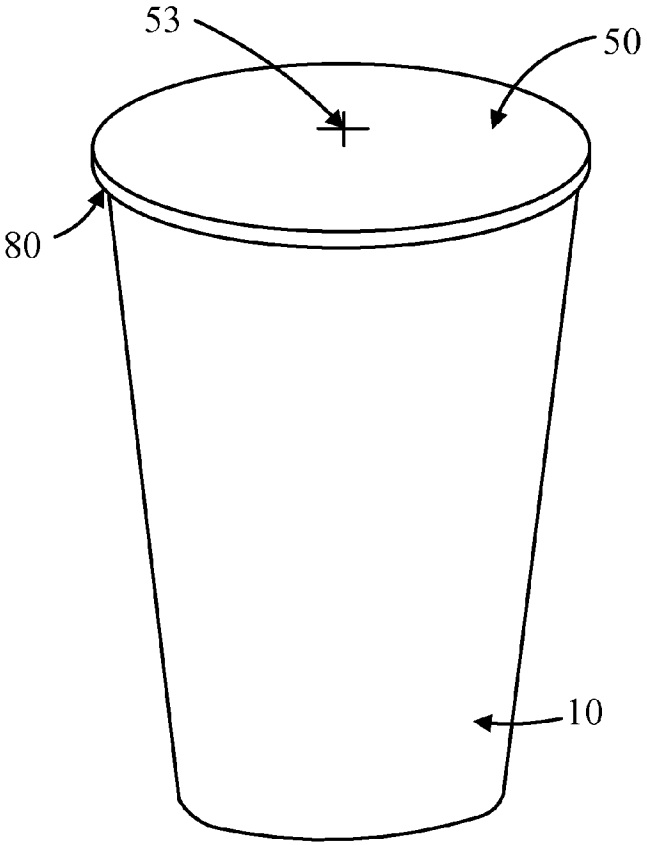
FIG. 30C provides an illustration of a flat insulating lid.

Referring now to FIGS. 25A and 25B, there is illustrated an exemplary selection of layouts for structural beams 40 on an insulating sleeve wall 25 and insulating lid 50. In addition to those illustrated here, the present invention teaches any formation of structural beams commonly known in the art to provide rigidity and support to the sleeve and lid.

FIGS. 26A, 27A, 28A, and 29A illustrate an exemplary selection of insulating sleeves 5 with a cup 10 inserted into the sleeve 5, with the number of support rings 15 optimized to support the weight and size of the cup 10. As discussed above, the support rings 15 create an insulating air chamber 20 between a set of support rings 15 or between a support ring 15 and the base 65, that helps prevent the contents of the cup 10 from warming or cooling, as well as shield the hand of a person holding the cup 10. The insulating sleeve 5 may cover part or substantially all the side of the cup 10, depending on cost, manufacturing and storage considerations. The tabs 30 provide a support to attach the support rings 15 to the insulation sleeve. In addition, each ring makes a closed insulating air chamber 20.

FIGS. 26B, 27B, 28B, and 29B illustrate a folded insulated sleeve 5 as well as the positioning of the support rings 15 when folded. When the user unfolds the sleeve 5 and inserts the cup 10, all the support rings are simultaneously forced open thus allowing the cup to slide inside the sleeve. The present invention teaches a foldable insulating sleeve 5, modifiable to include the number of support rings 15 and an optional base 65 necessary to support the desired cup weight. As such, the number or arrangement and placement of support rings is taught by the present invention as such placement optimizes the performance of the sleeve 5.

Referring to FIGS. 30A-35B which illustrate a cup 10 with the insulating lid 50. The lid 50 is comprised of a top wall 70, a bottom wall 75, a brim clasp 80 that is releaseable coupleable to the brim 85 of the cup 10. The top wall 70 and bottom wall 75 form the walls of the insulating air chamber 20, the bottom wall lying in the brim plane 90 so as to allow the cup 10 to be filled to capacity with content, and not have to save space for the insulating chamber 20. The lid 50 maximizes the storage capacity of the cup 10 by not filling the storages space with the insulating air chamber. However, the present invention also teaches minimizing the profile of the lid 50 by placing the insulating air chamber 20 below the brim plane 90, such as illustrated in FIGS. 30C-30D.

As discussed above in FIG. 25B, structural beams 40 may be placed in the air chamber 20 of the lid 50 to improve its structural integrity, as well as provide additional support to the container as a whole. Additional support may be necessary when the lid 50 performs functions in addition to covering the cup. Such functions may be providing a defined opening 53 through which a straw 95 may be inserted. A structural beam 40 would provide the necessary strength to prevent the allow the user to use a straw 95 without compromising the structural integrity of the lid.

Figure 33B:
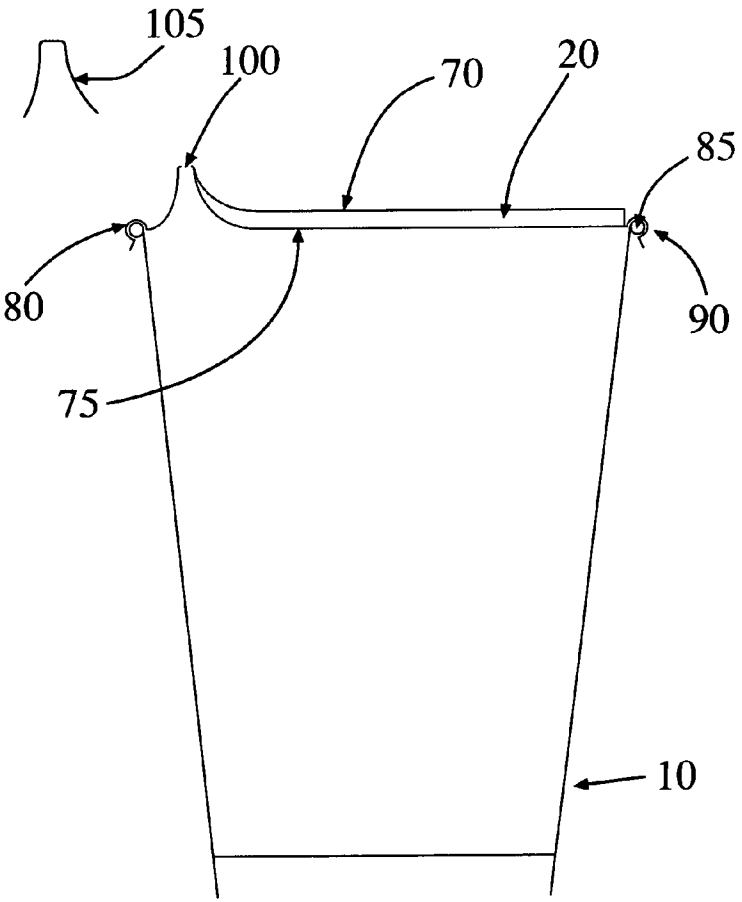
FIG. 33B illustrates a side view of the insulating lid.
Figure 33A:
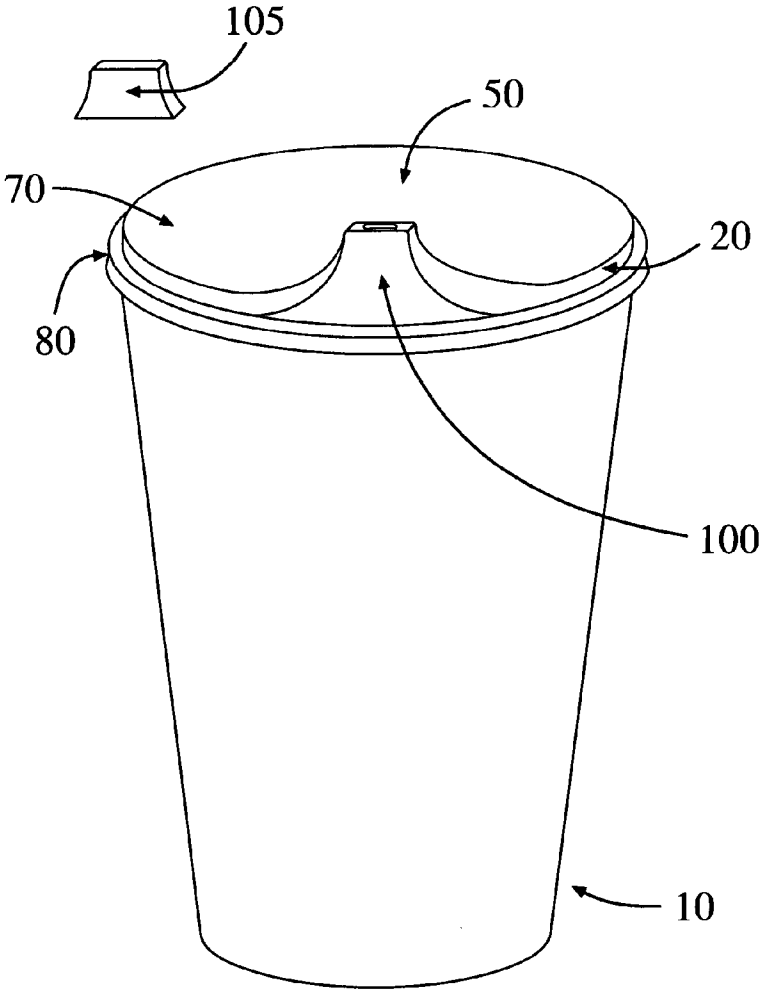
FIG. 33A illustrates an alternative embodiment of the insulating lid.
Figure 34B:
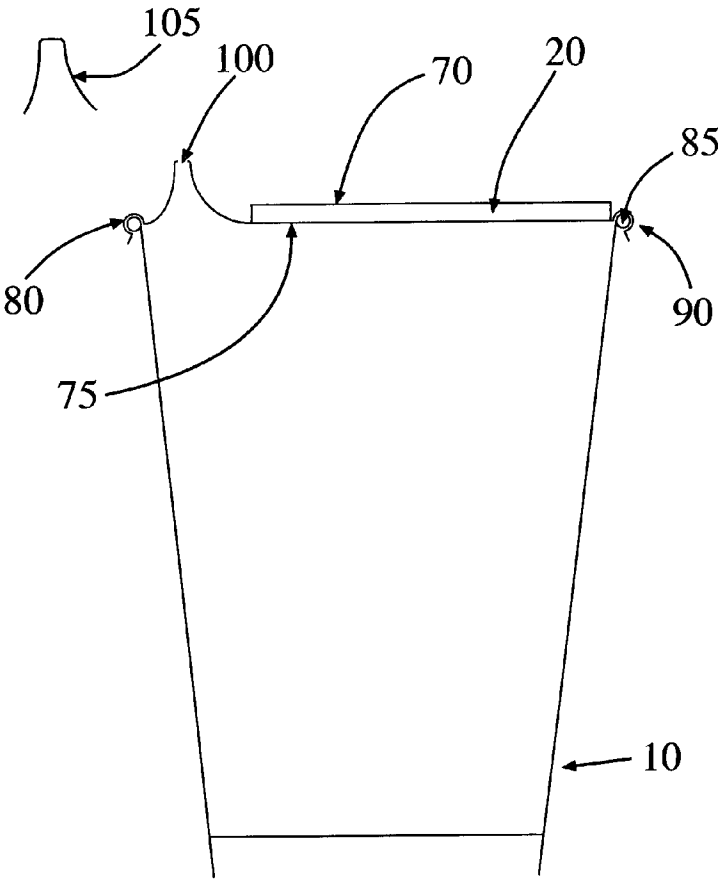
FIG. 34B illustrates a side view of the alternative embodiment of the insulating lid.
Figure 34A:
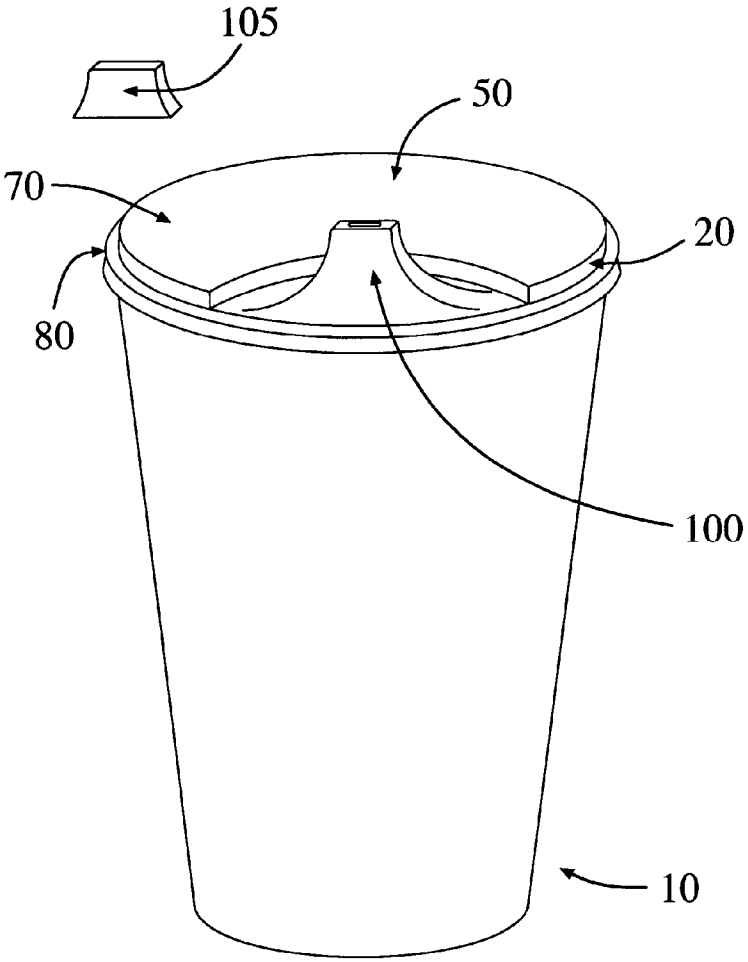
FIG. 34A illustrates an alternative embodiment of the insulated lid.

An additional function may be to provide a content funnel 100 through which the contents of the cup may be funneled to the user's mouth. The content funnel 100 may be part of the insulating air chamber 20, as shown in FIG. 33B, or the chamber 20 may end before reaching the funnel 100 as shown in FIG. 34B. To prevent cooling and spills, the funnel has a cap 105.

Figure 31B:
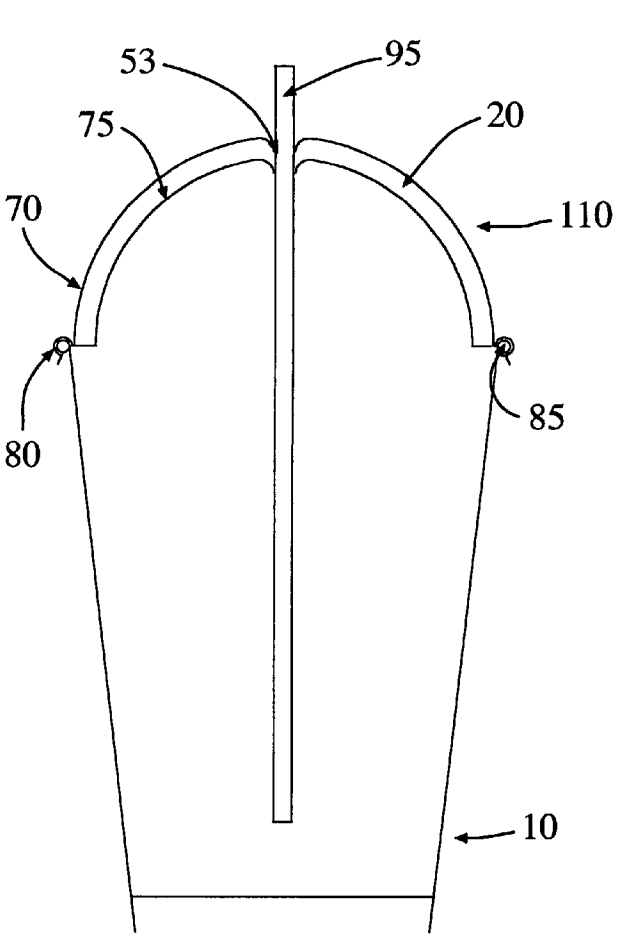
FIG. 31B illustrates a cross sectional view of a bubble lid.
Figure 31A:
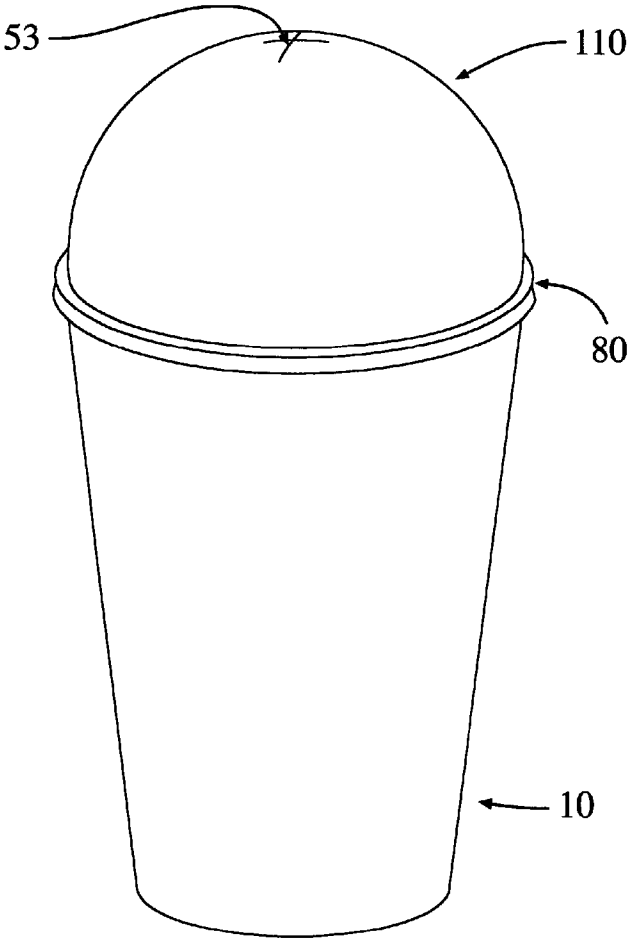
FIG. 31A illustrates an insulated bubble lid.
Figure 32B:
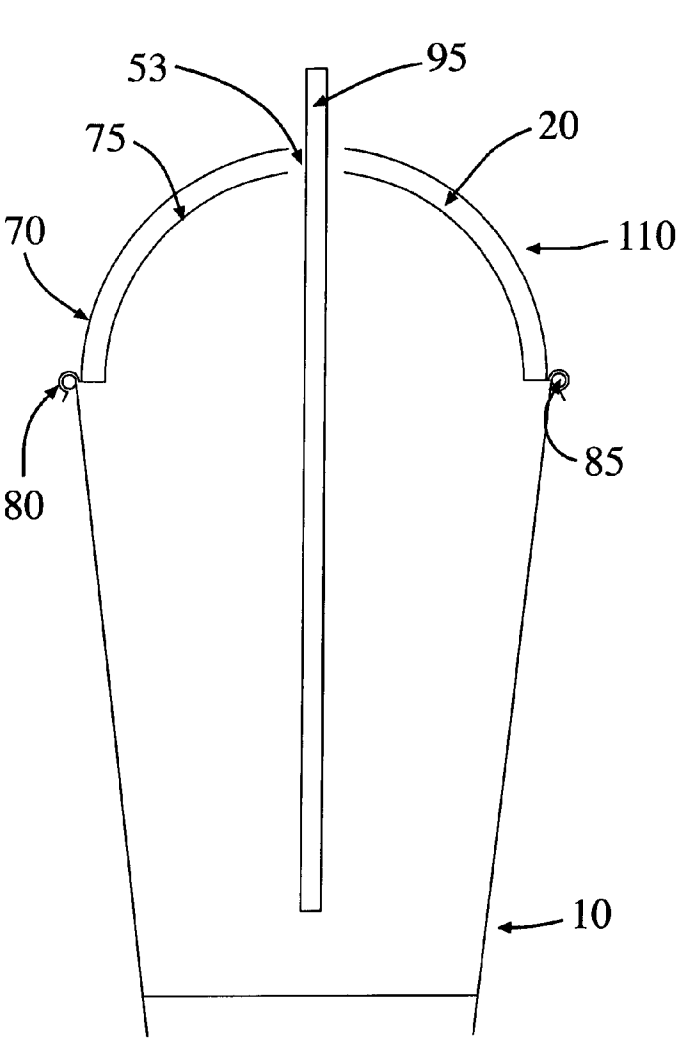
FIG. 32B illustrates an cross sectional view of the alternative exemplary embodiment of the bubble lid.
Figure 32A:
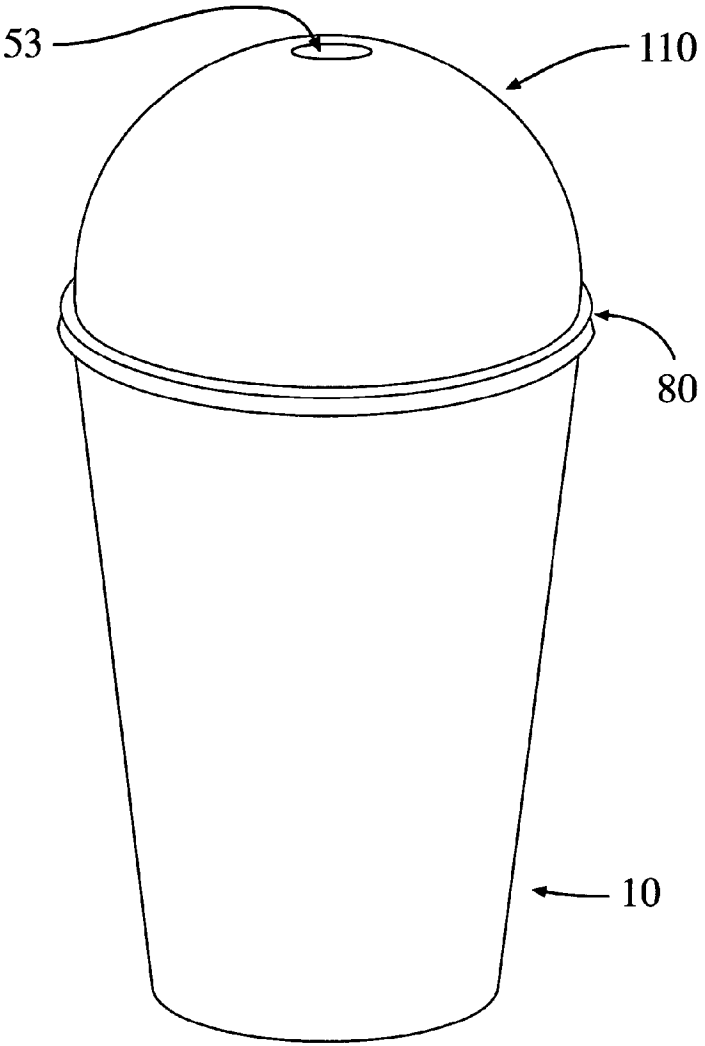
FIG. 32A illustrates an alternative exemplary embodiment of the bubble lid.

FIGS. 31A and 31B illustrate another embodiment of the lid where structural supports 40 may improve the function of the bubble lid 110. Due to the bubble lid's 110 concave up shape, structural beams 40 enhance the functionality of the lid, allowing contents to extend above the brim plane 90, effectively increasing the storage capacity of the cup 10, while still being insulated and covered by the bubble lid 110. Again, the insulating air chamber 20 may be either on inside the lid to minimize the profile of the lid, as shown in FIG. 31B, or it may be outside on the outside of the lid to maximize the capacity of the cup. A defined opening 53 in the bubble lid 110 allows the user to insert a straw 95.

Figure 35B:
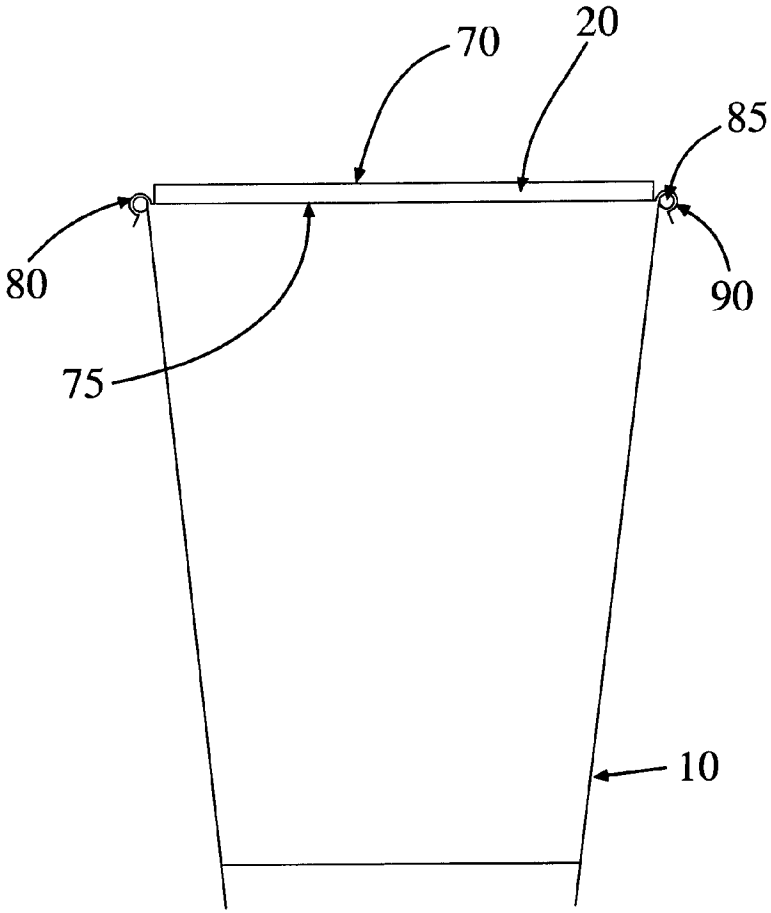
FIG. 35B illustrates an alternative side illustration of the insulating lid.
Figure 35A:
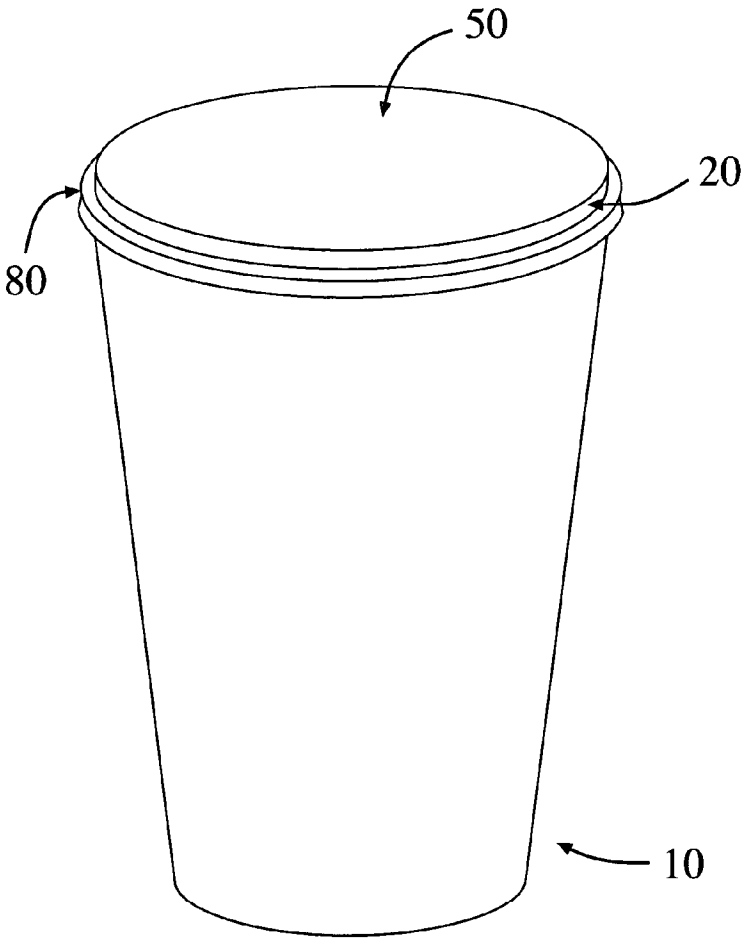
FIG. 35A illustrates an alternative illustration of the insulating lid.
Figure 36B:
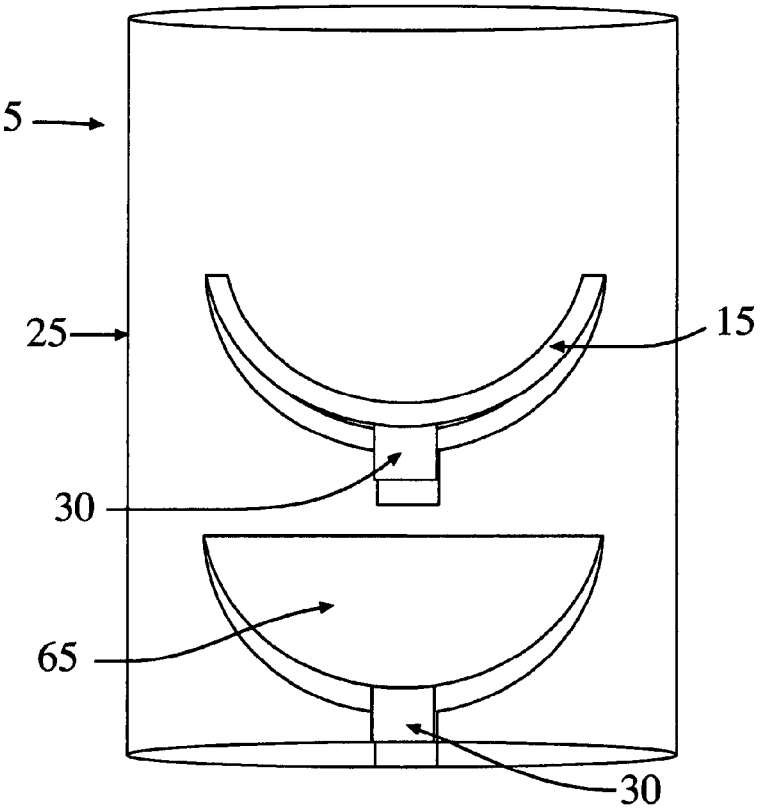
FIGS. 36A-37B illustrate an exemplary insulating sleeve.
Figure 36A:
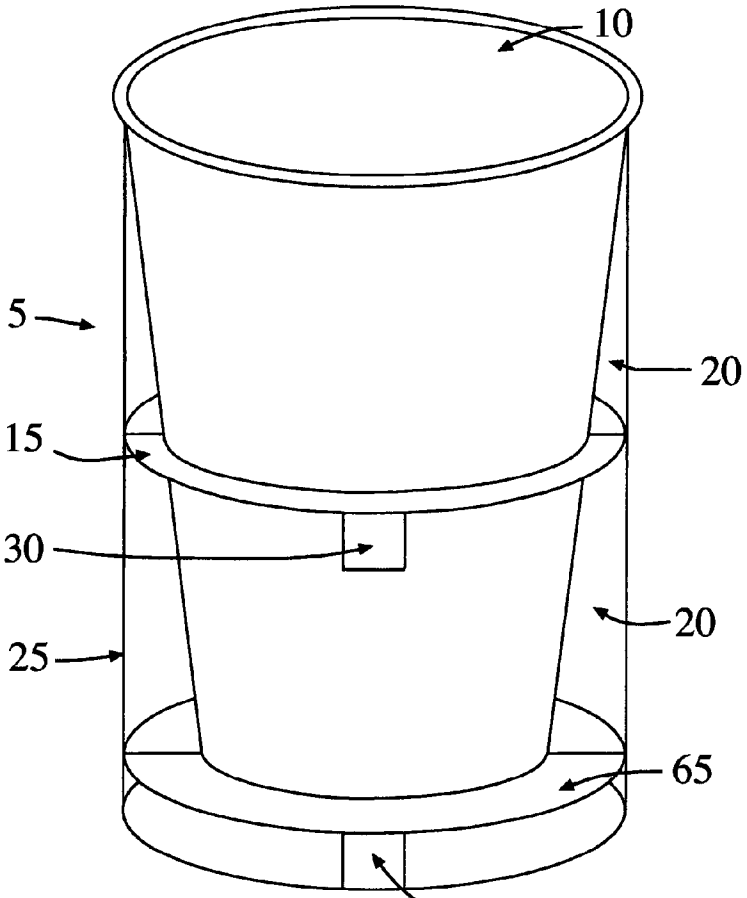
Figure 37B:
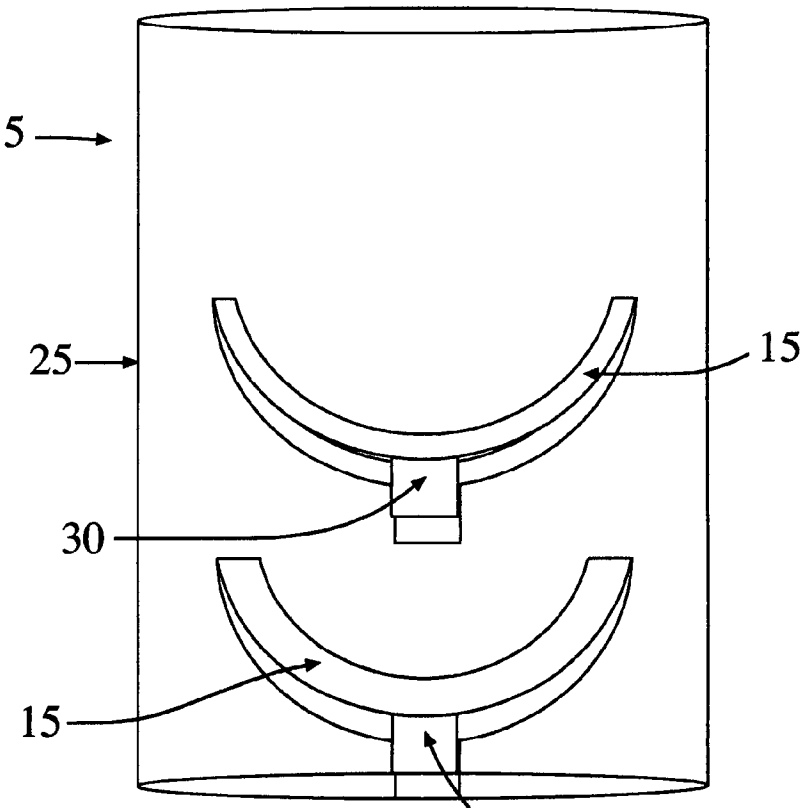
Figure 37A:
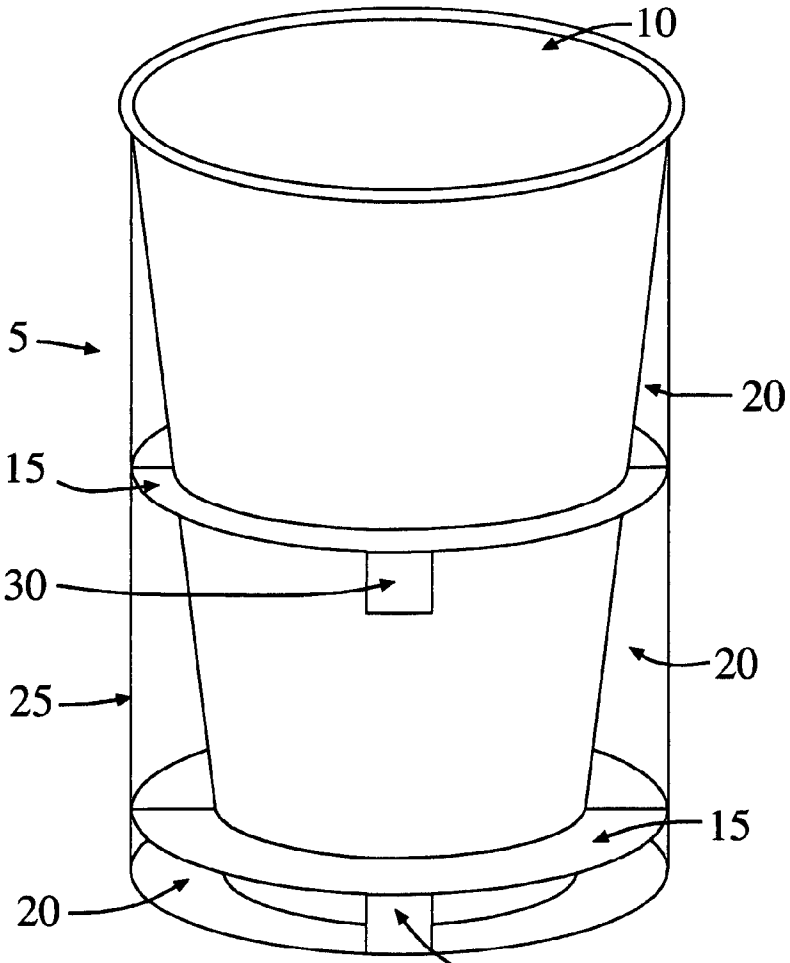
Figure 38B:
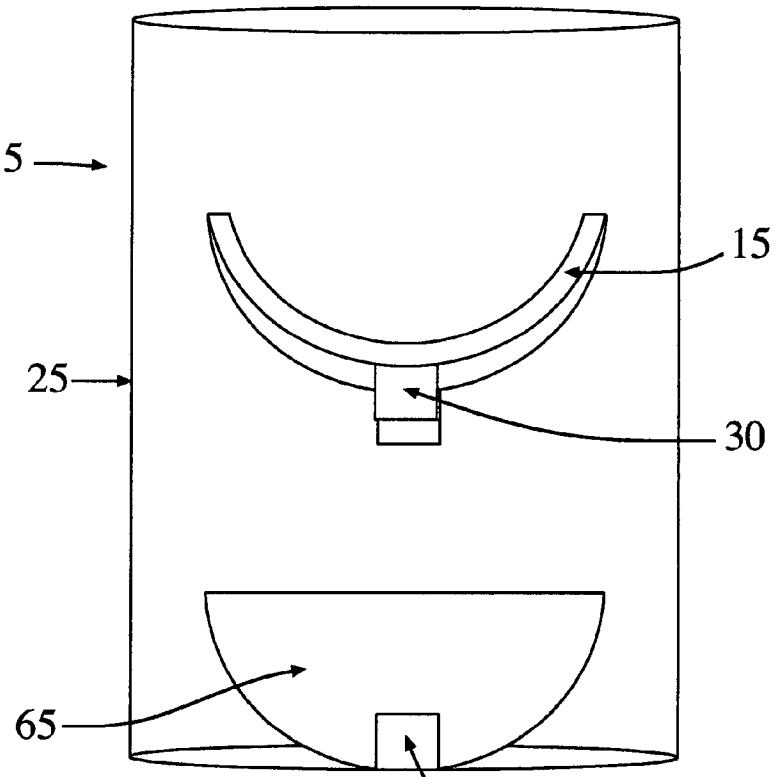
FIGS. 38A-39B illustrate an exemplary alternative embodiment of an insulating sleeve.
Figure 38A:
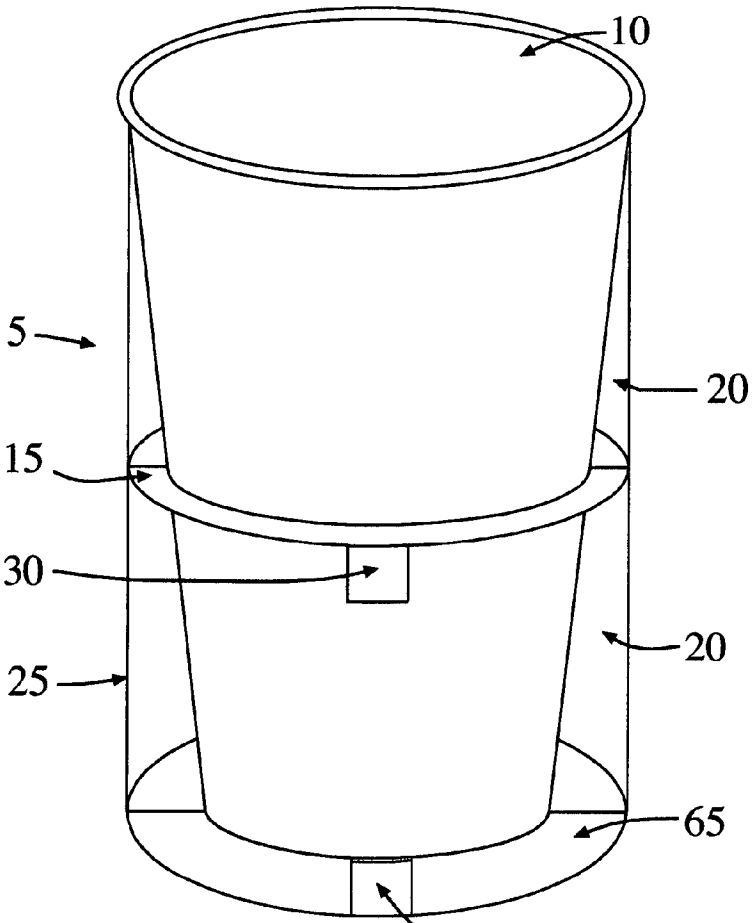
Figure 39B:
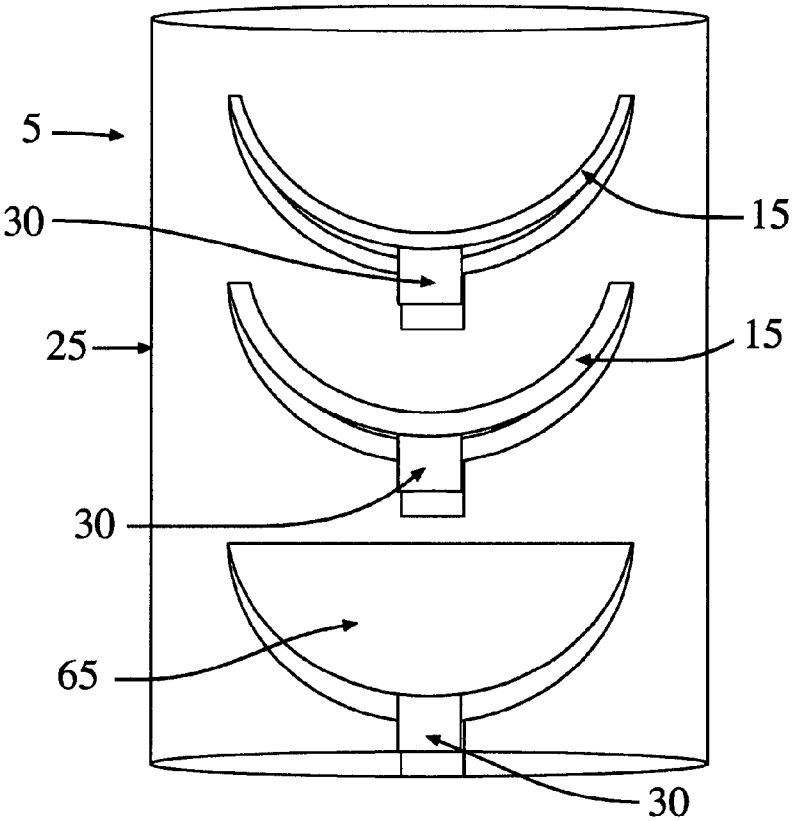
Figure 39A:
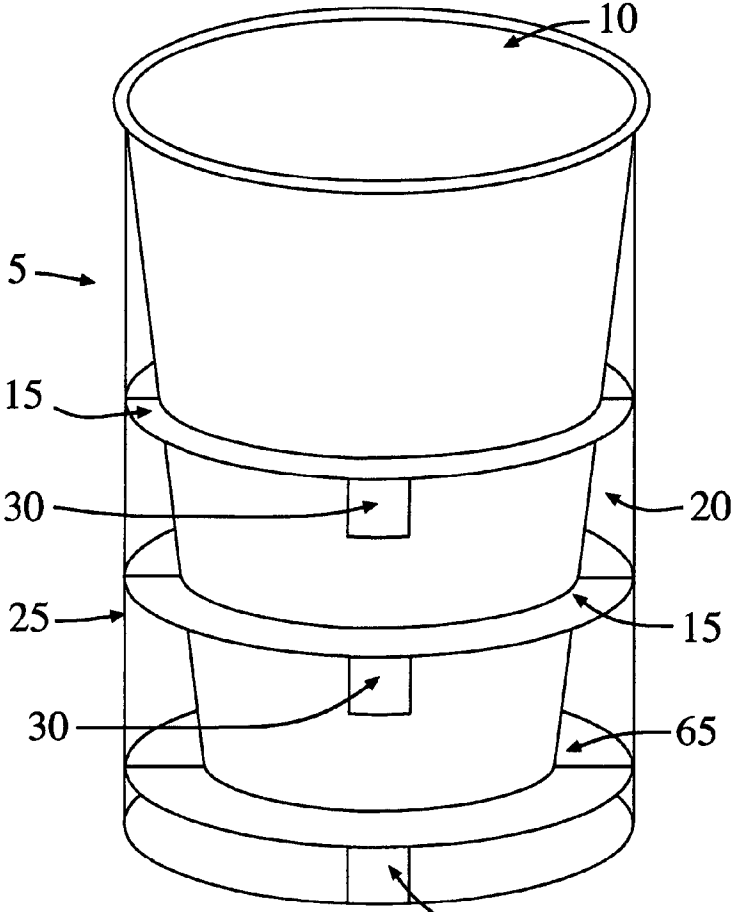
Figure 40B:
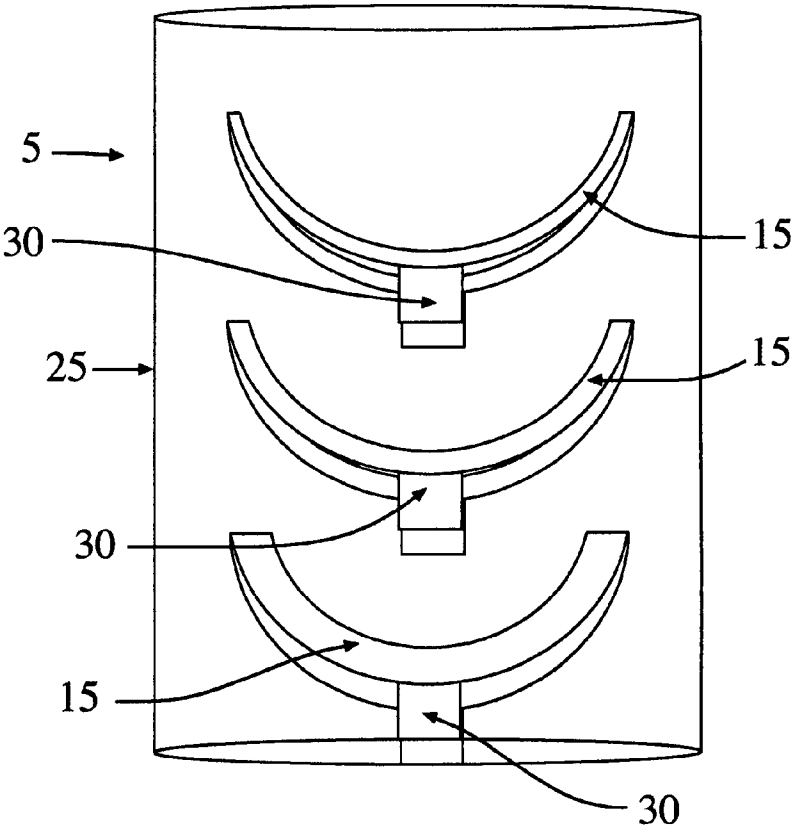
FIGS. 40A-41B illustrate an exemplary alternative embodiment of an insulating sleeve.
Figure 40A:
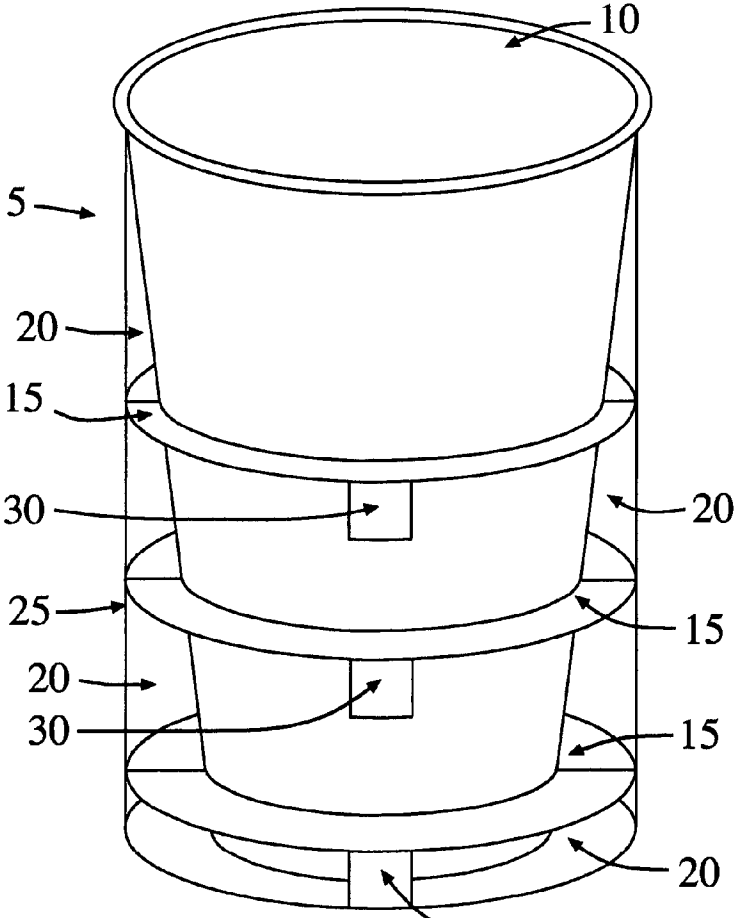
Figure 41B:
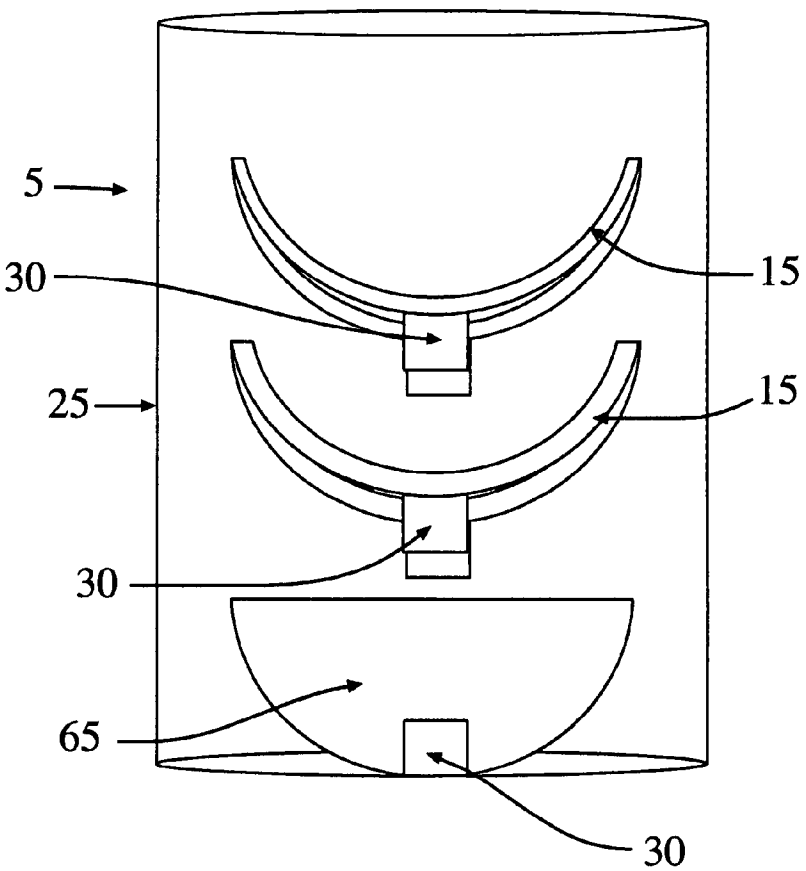
Figure 41A:
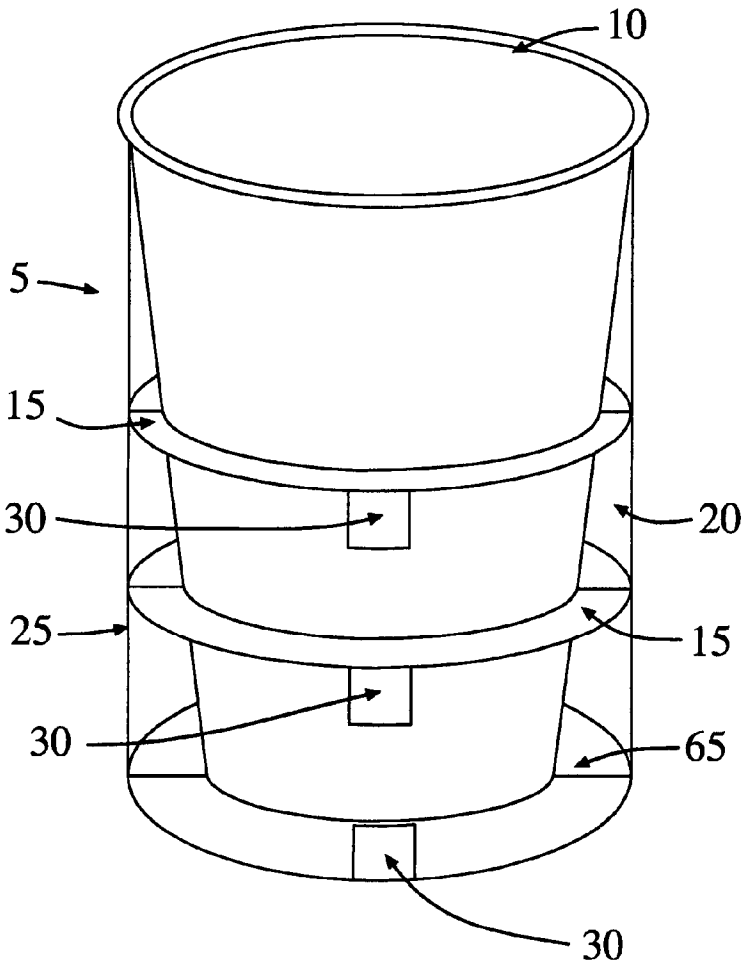
Figure 42B:
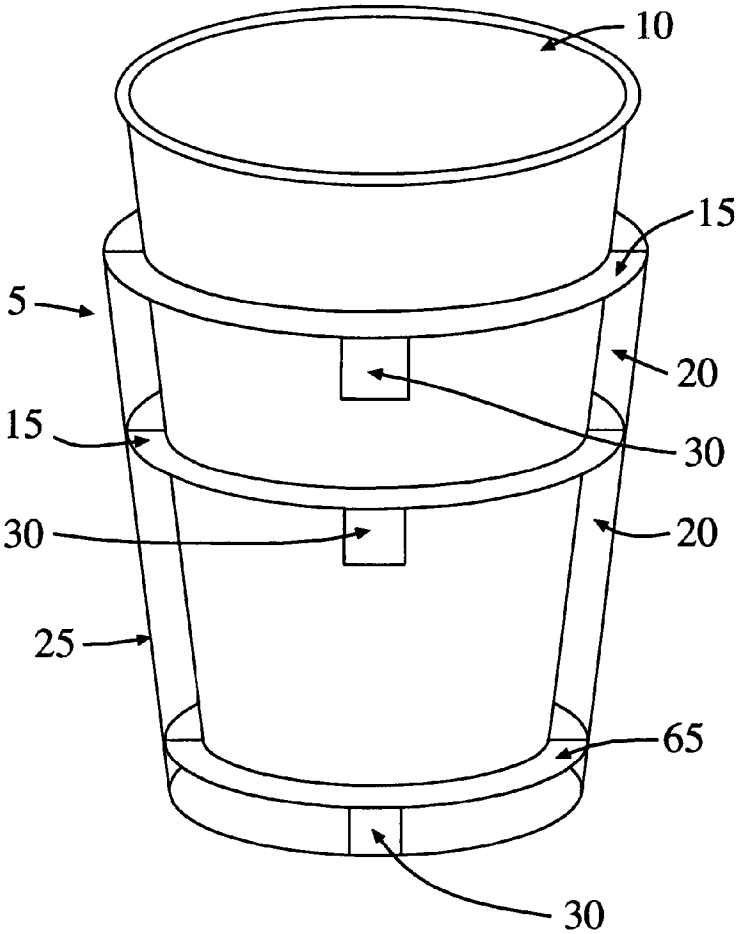
FIGS. 42A-43B illustrate an exemplary alternative embodiment of an insulating sleeve.
Figure 42A:
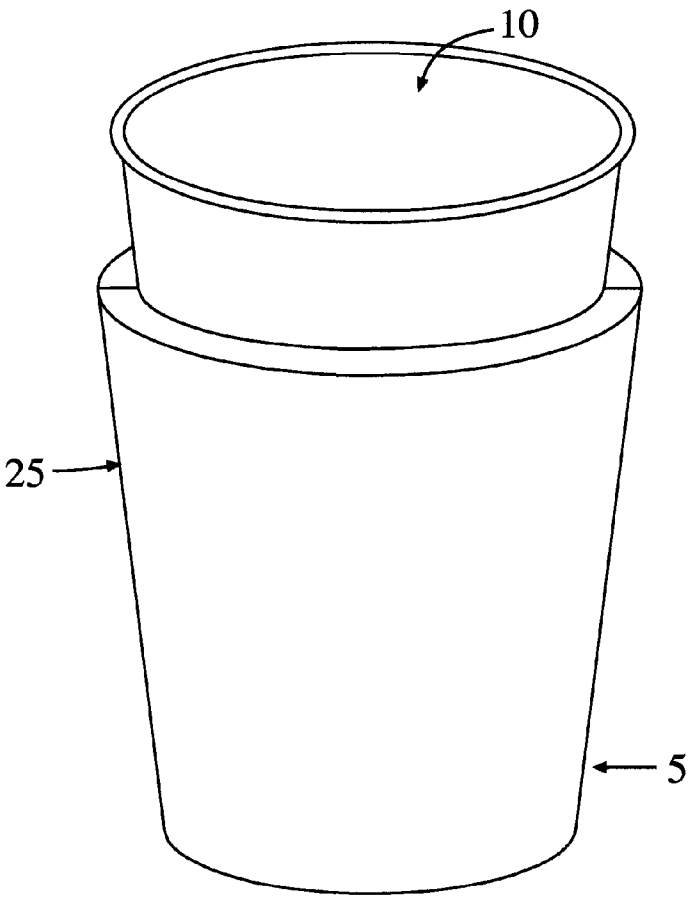
Figure 43B:
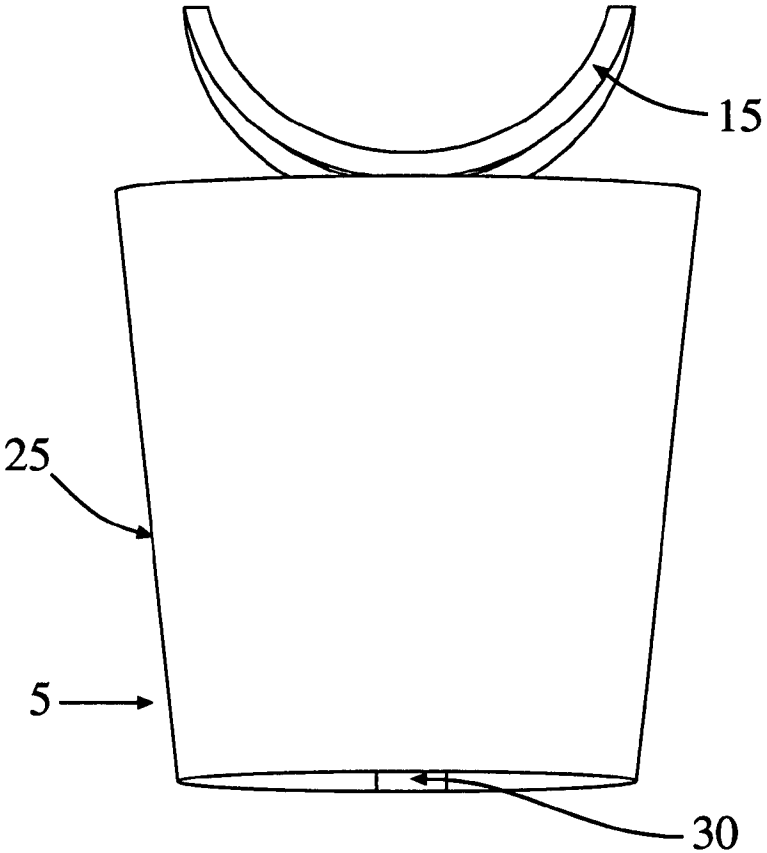
Figure 43A:
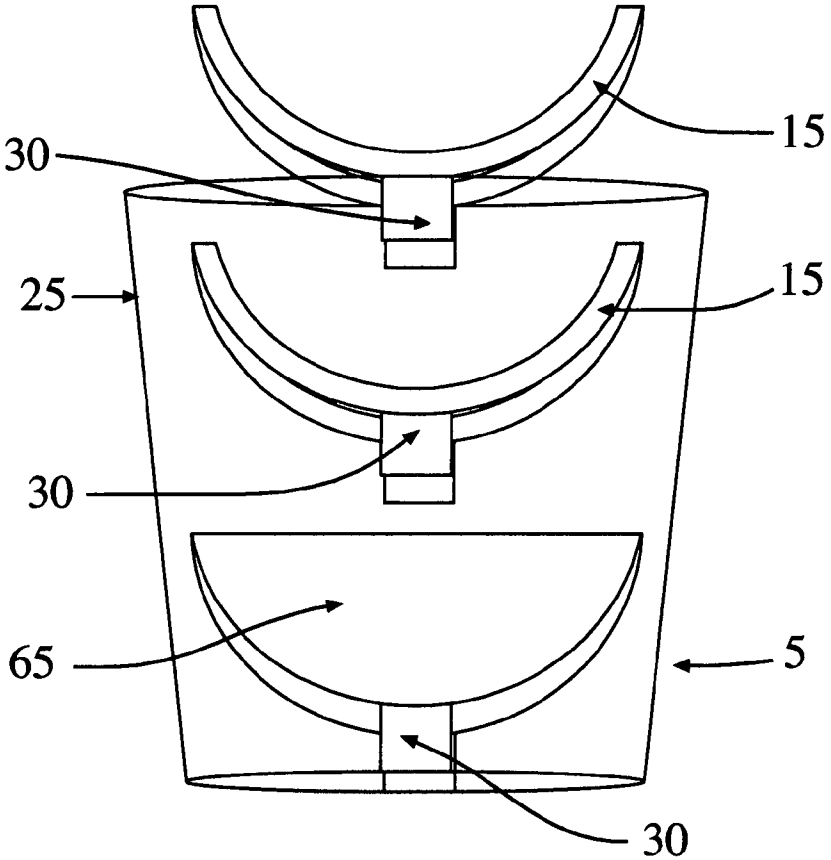
Figure 44B:
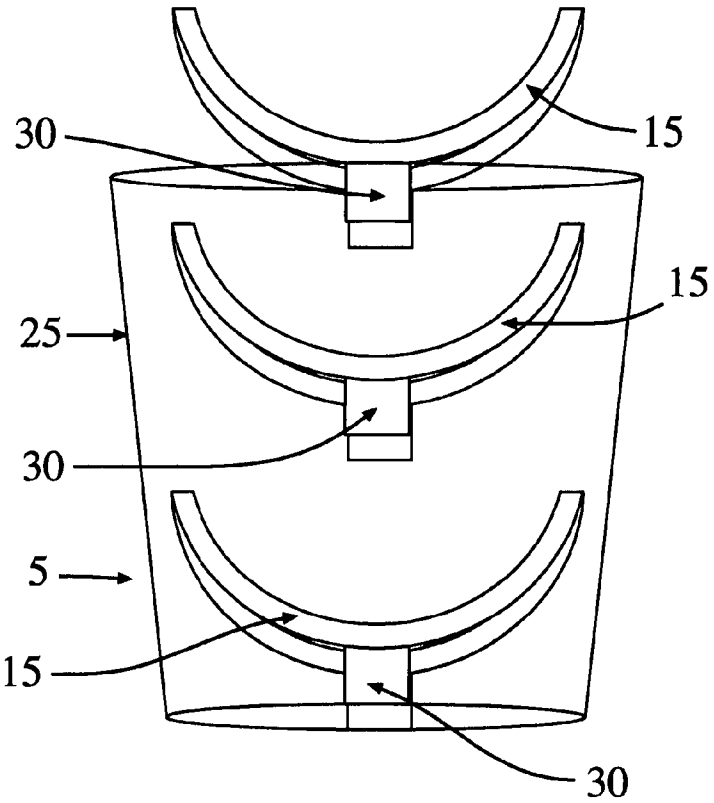
FIGS. 44A-44B illustrate an exemplary alternative embodiment of an insulating sleeve with a ring in which a cup may sit.
Figure 44A:
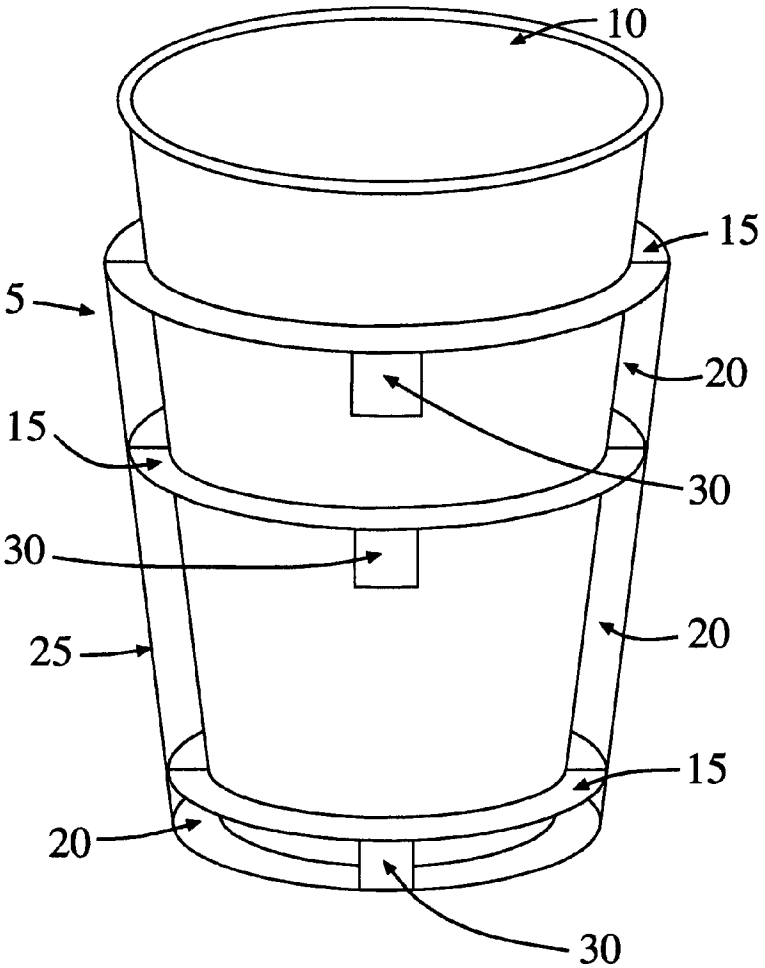
Figure 45B:
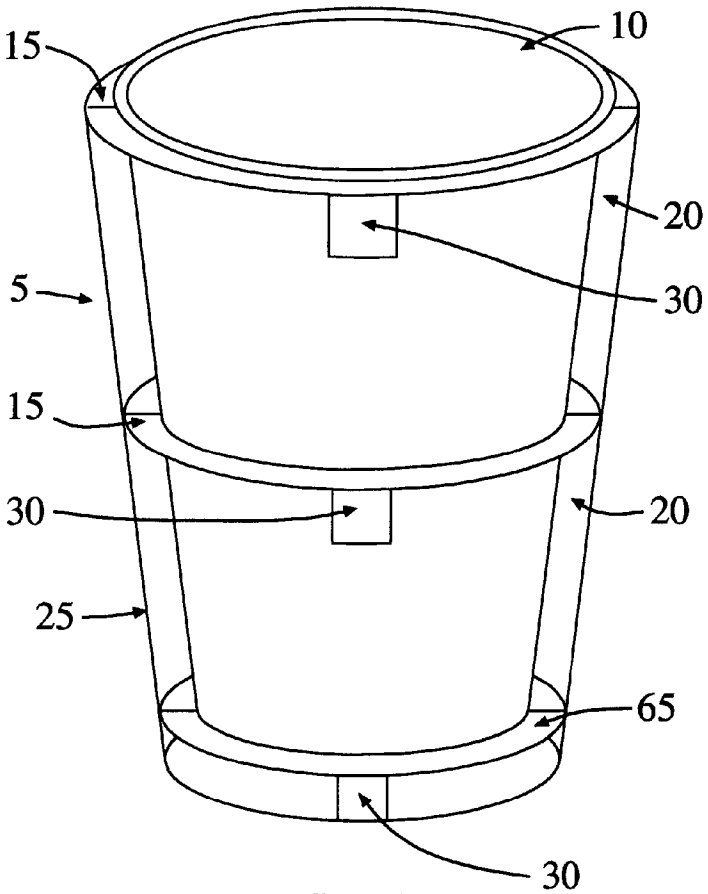
Figure 45A:
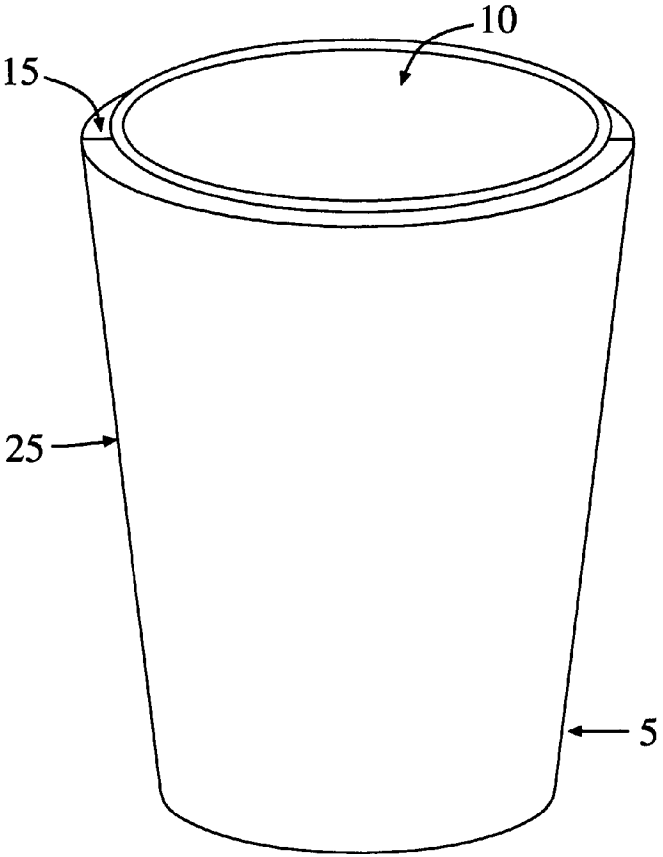
Figure 46B:
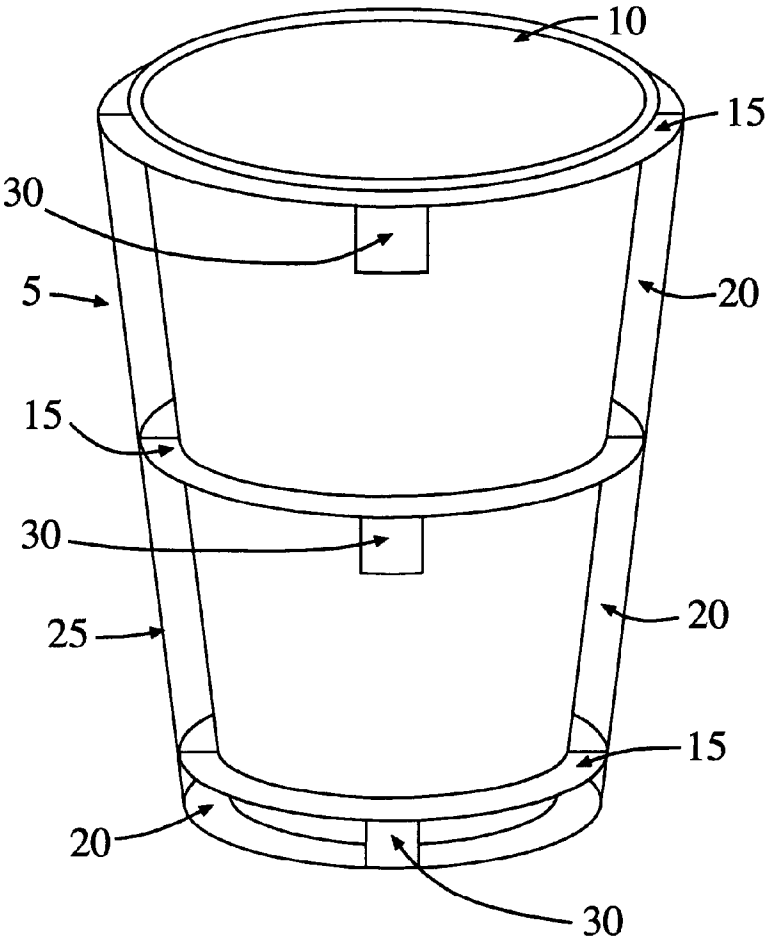
FIG. 46B illustrates an exemplary alternative embodiment of an insulating sleeve with a ring in which a cup may sit.
Figure 46A:
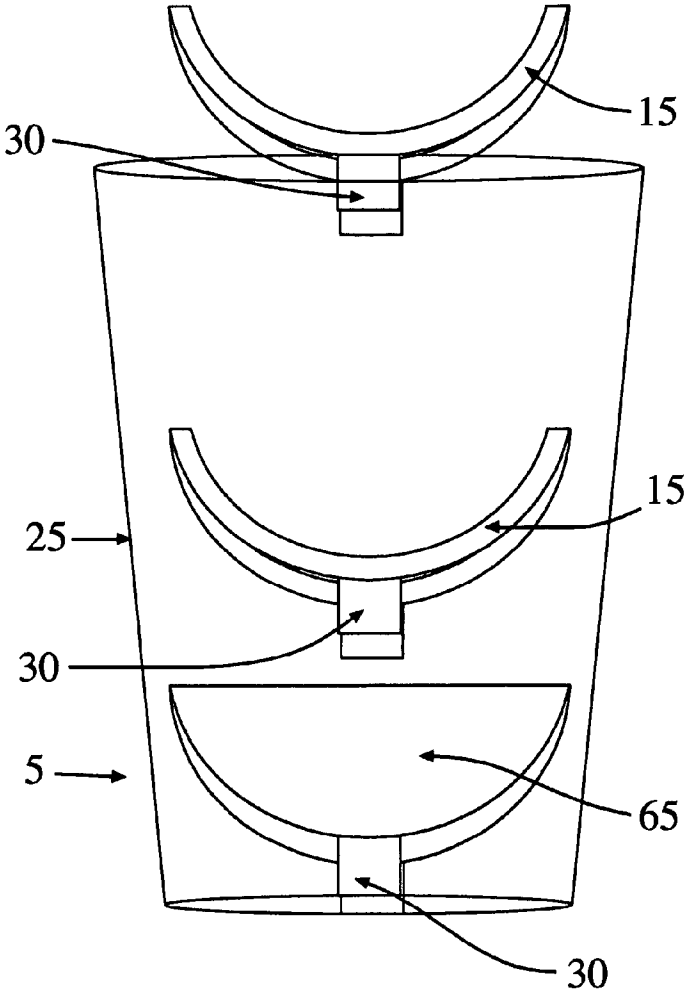
Figure 47B:
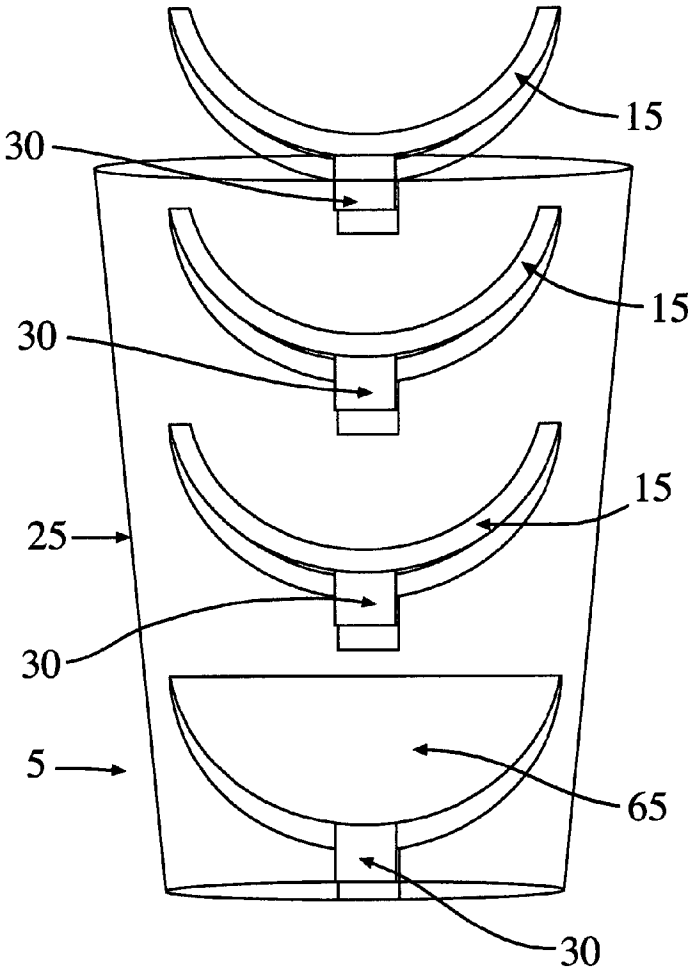
FIGS. 47A-47B illustrate an exemplary alternative embodiment of an insulating sleeve.
Figure 47A:
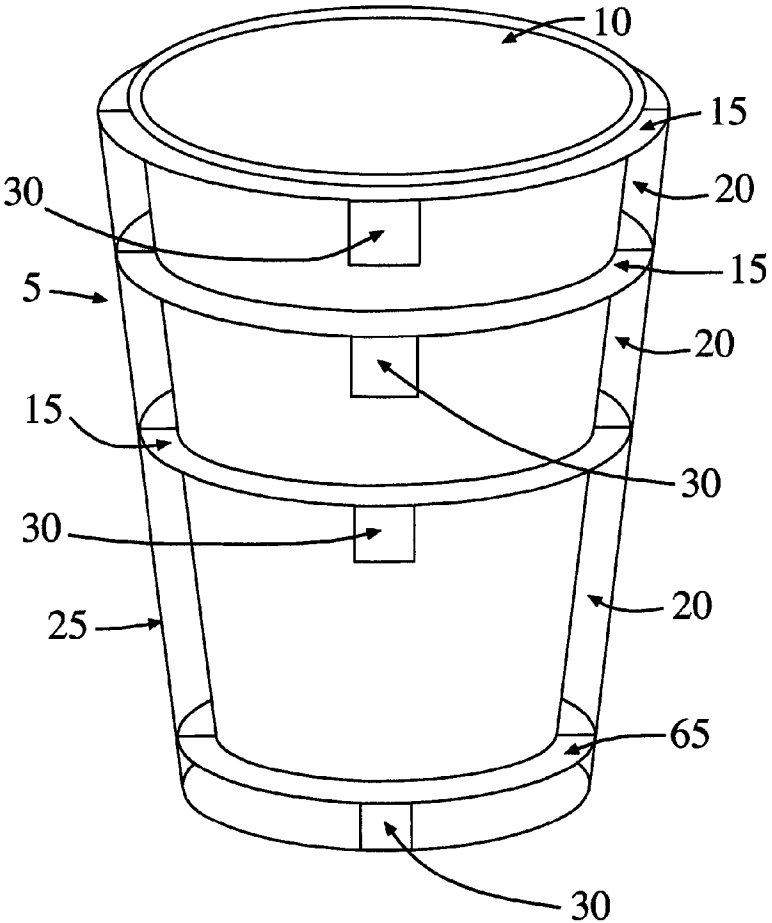
Figure 48B:
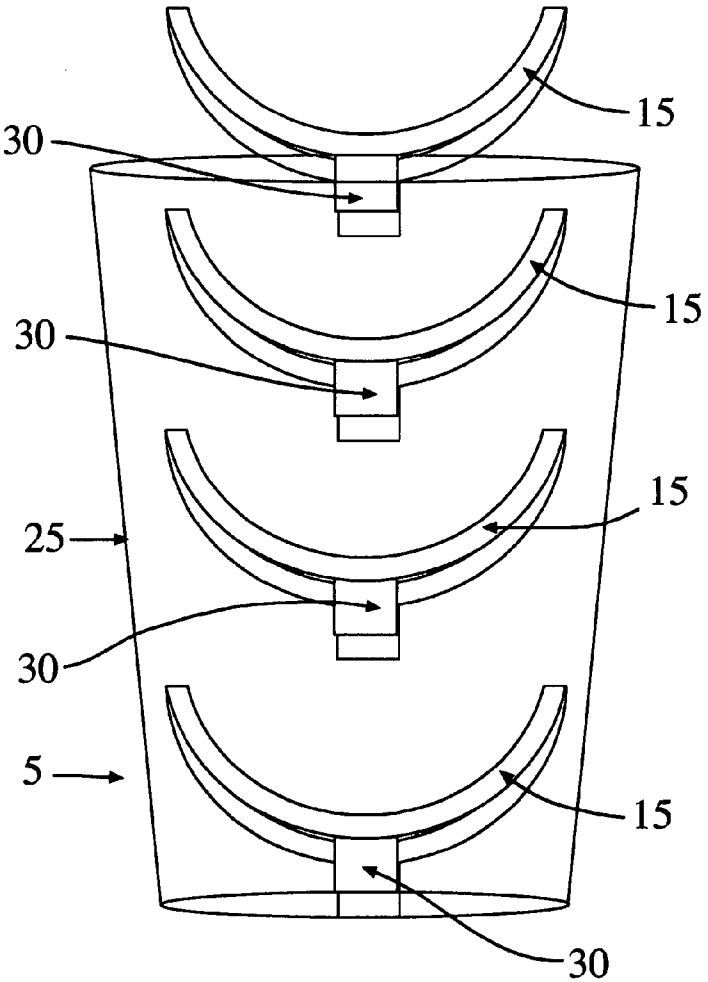
Figure 48A:
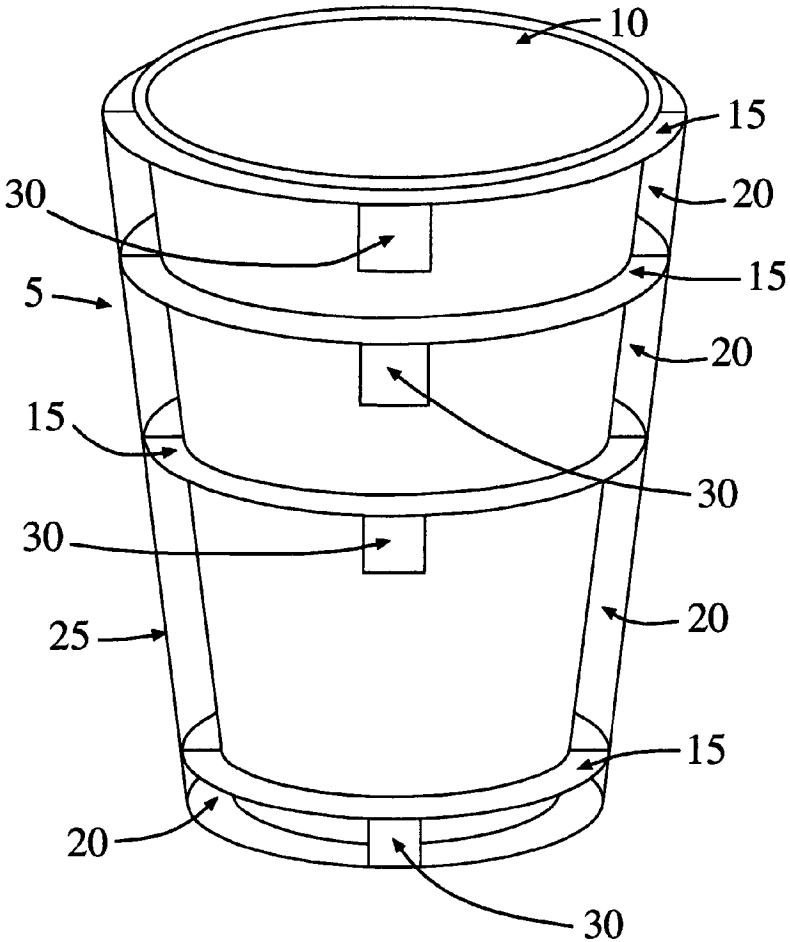
Figure 49B:
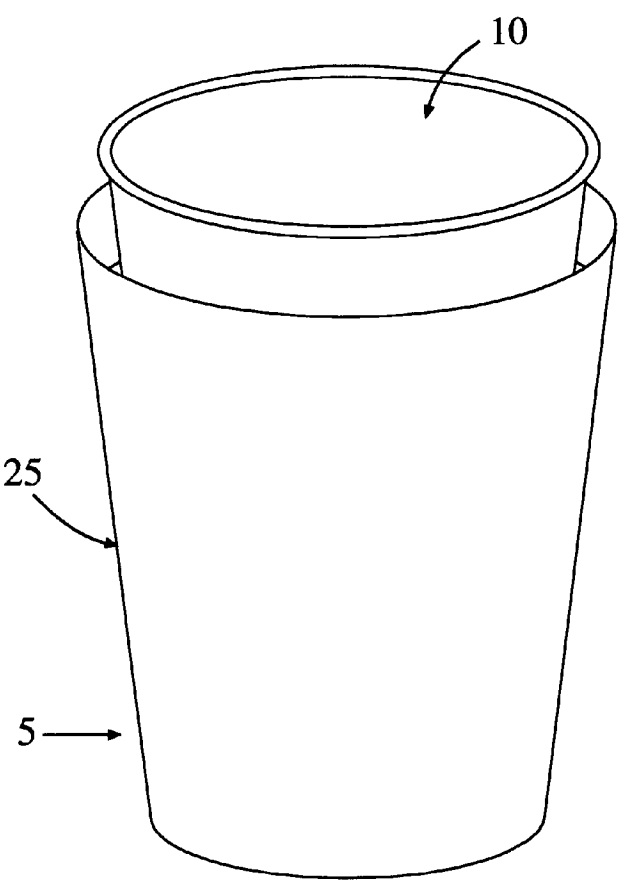
Figure 49A:
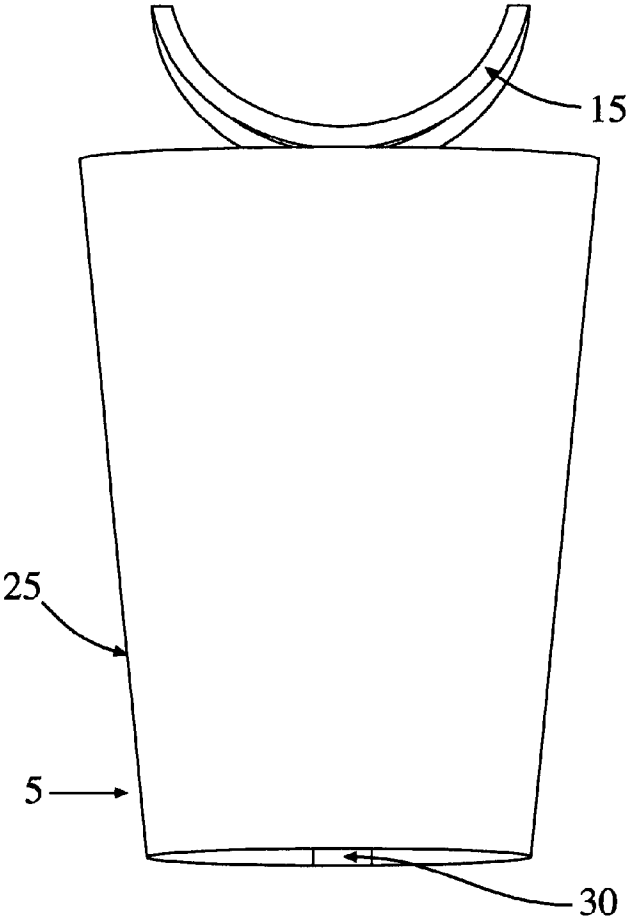
Figure 50B:
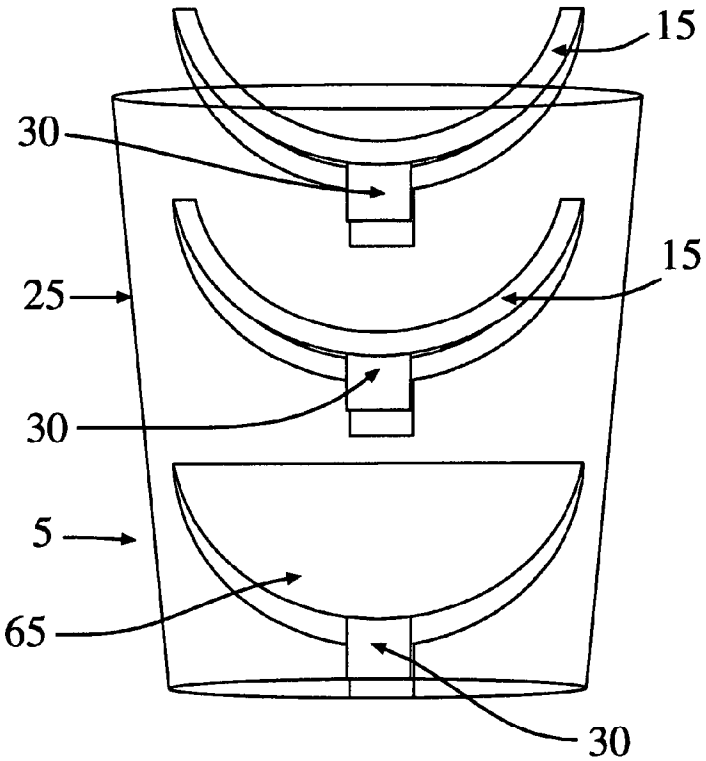
Figure 50A:
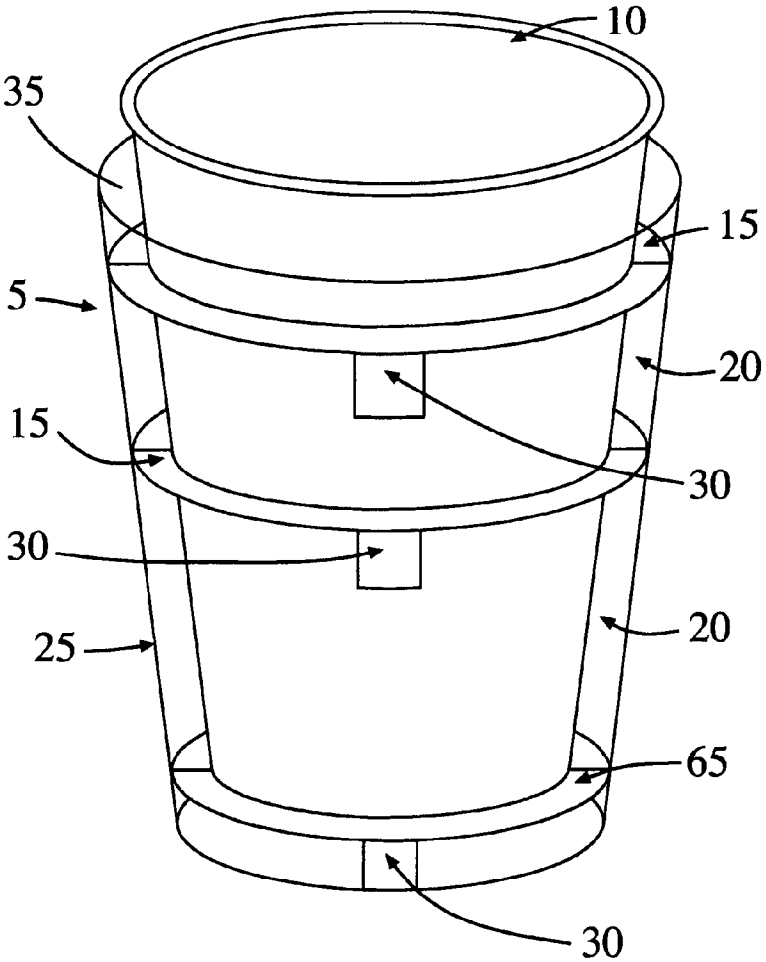
Figure 51B:
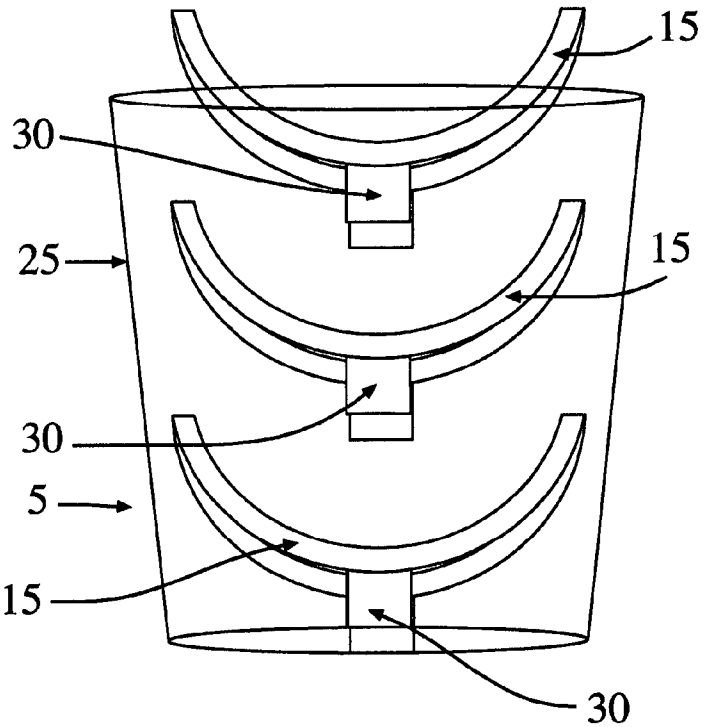
Figure 51A:
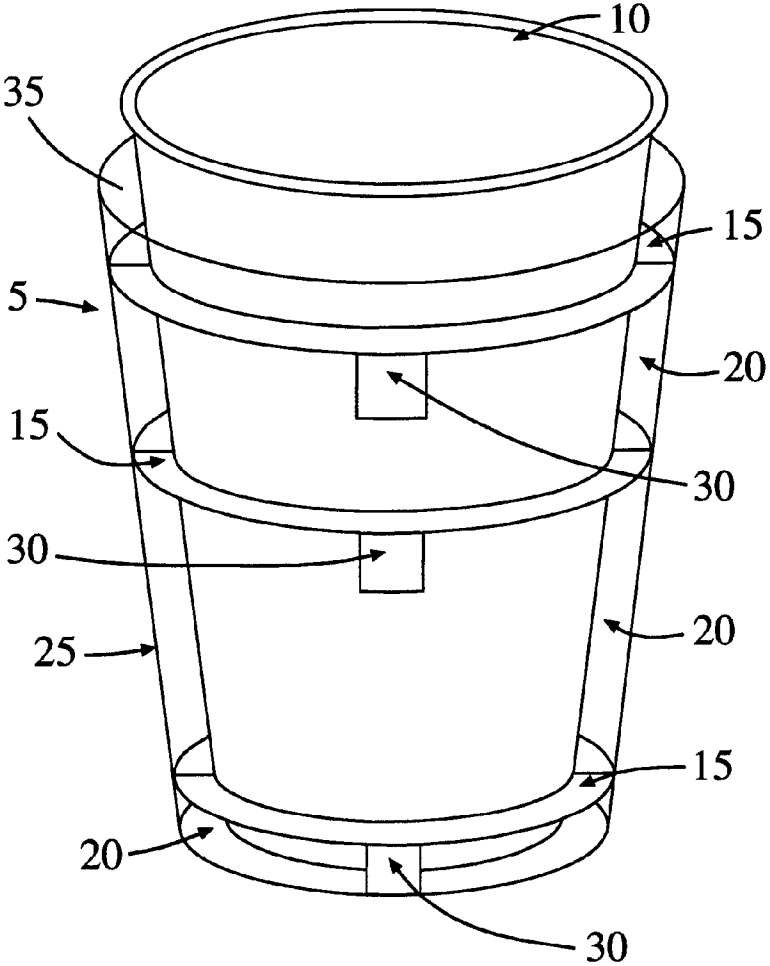
Figure 52B:
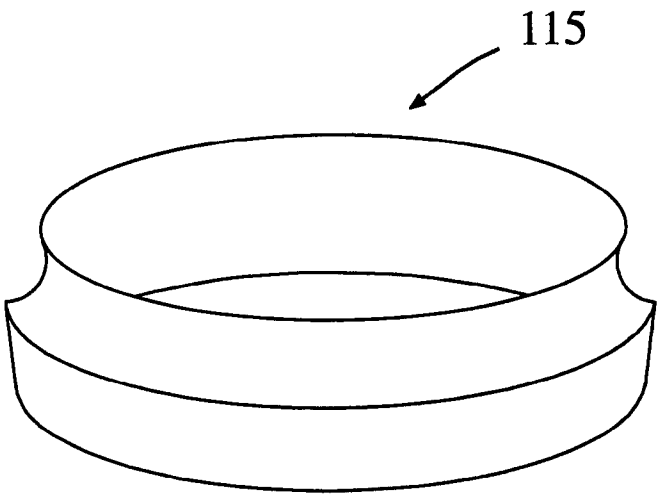
Figure 52A:
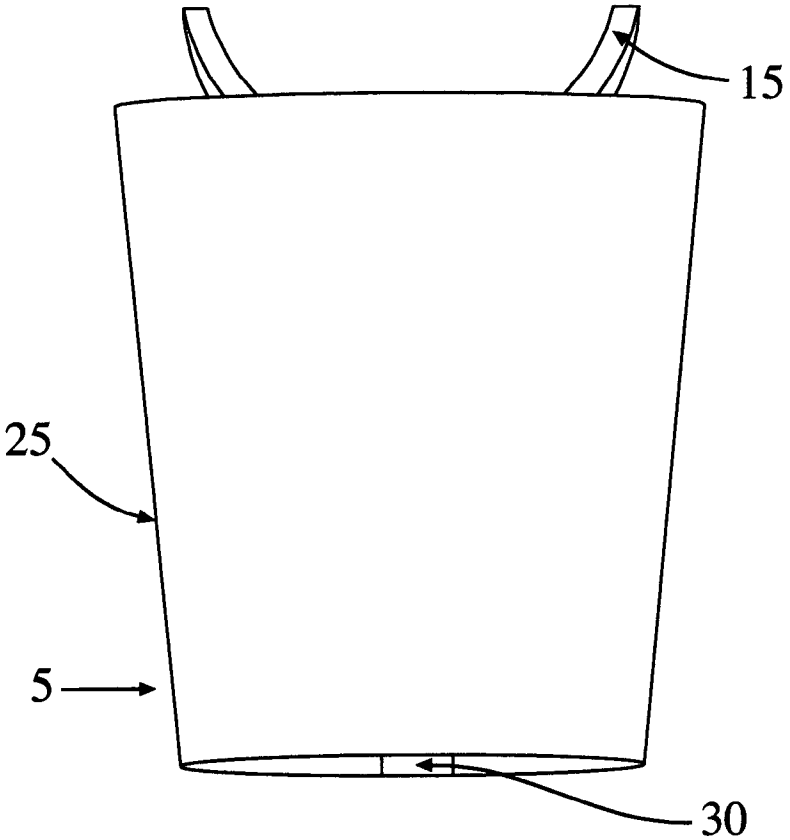

An exemplary embodiment shown in FIG. 35 illustrates a cup 10 with a flat lid 50 comprising an insulating air chamber 20 above the brim plane 90, and a brim clasp 80 coupled to the cup brim. This embodiment can be used for food storage, for example if a chicken restaurant wanted to keep a patron's food warm until it was consumed, the chicken could be placed in the cup, the cup placed in an insulating sleeve, and the insulating lid placed on the top of the cup. The same situation could be made for hamburgers or any other food. In addition, the lid 50 may be connected to another lid to form a clamshell design and keep the food contents warm. In addition, the present invention teaches all combinations of the described arrangement.

Referring now to exemplary embodiments illustrated in FIGS. 36A through 41B where show is a variety of insulating sleeve shapes that provide increased insulation for the cup. The shape of the sleeve may be substantially cylindrical, the walls of the sleeve being respectively parallel, thus creating larger insulating air chambers 20 at the bottom of the sleeve than at the top, when the cup is tapered at the bottom. This shape provides improved insulation at the bottom of the sleeve where the contents of the cup will be for the longest period of time. Furthermore, the present invention teaches placing the support rings 15 in positions so as to minimize the amount of air circulating from the areas next to the empty cup, and areas insulating filled portions of the cup. In addition, the ring 15 provides the sleeve with increased structural support, thus preventing the sleeve from collapsing when gripped or held by a user. Here, the insulating sleeve 5 extends the entire length of the cup 10, so as to insulate substantially the entire cup 10. The substantially cylindrical sleeve also provides a wider more supportive base for the cup, thus preventing potential spills or tipping of the cup while in the sleeve.

Additionally, the present invention teaches the bottom of the sleeve may comprise either a base 65 on which the cup 10 rests, or a support ring 15 through which the cup 10 passes. When the sleeve 5 is substantially cylindrical, the rings 15 must remain concentric, but also compensate for the change of the cup 10 size.

Referring now to FIGS. 42A through 52A, the present invention also teaches a tapered sleeve 5 so as to run substantially parallel to the walls of the cup 10, as show. Alternative exemplary embodiments where the insulating sleeve 5 covers different lengths of the cup 10, including approximately half of the cup's surface, three quarters of the cup's surface, and the entire length of the cup's surface. In addition, as discussed previously, the present invention teaches a support ring 15 that is flush with the top of the insulating sleeve 5, and an alternative embodiment that illustrates the sleeve 25 extending 35 beyond the top ring. Again, the insulating sleeve 5 may be foldable, thus minimizing the volume of shipping or storing several sleeves at one time.

Figure 53B:
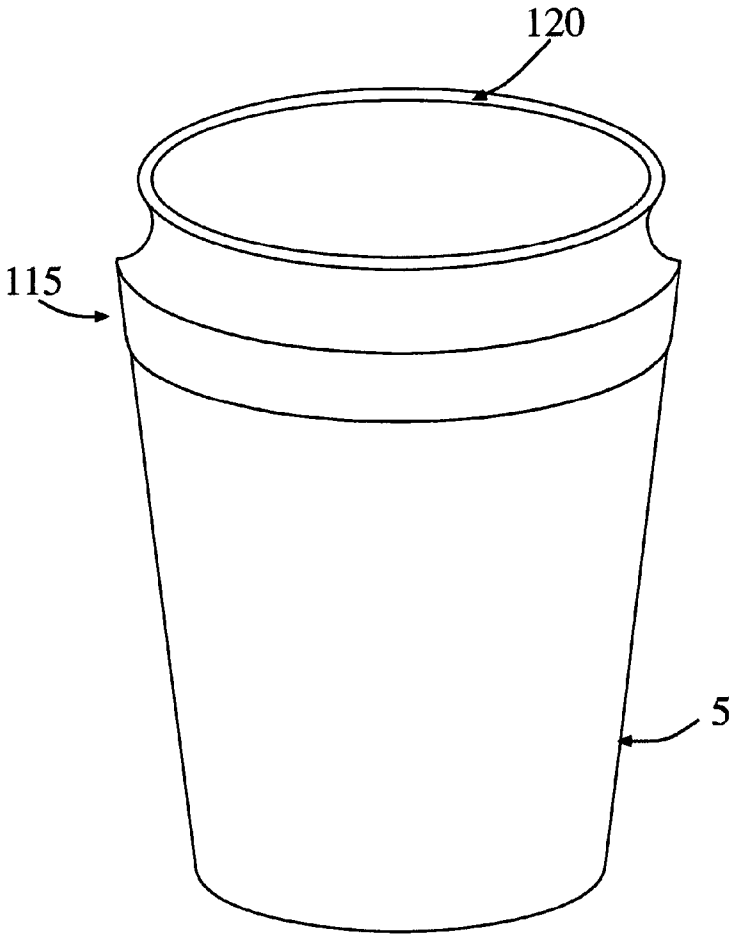
Figure 53A:
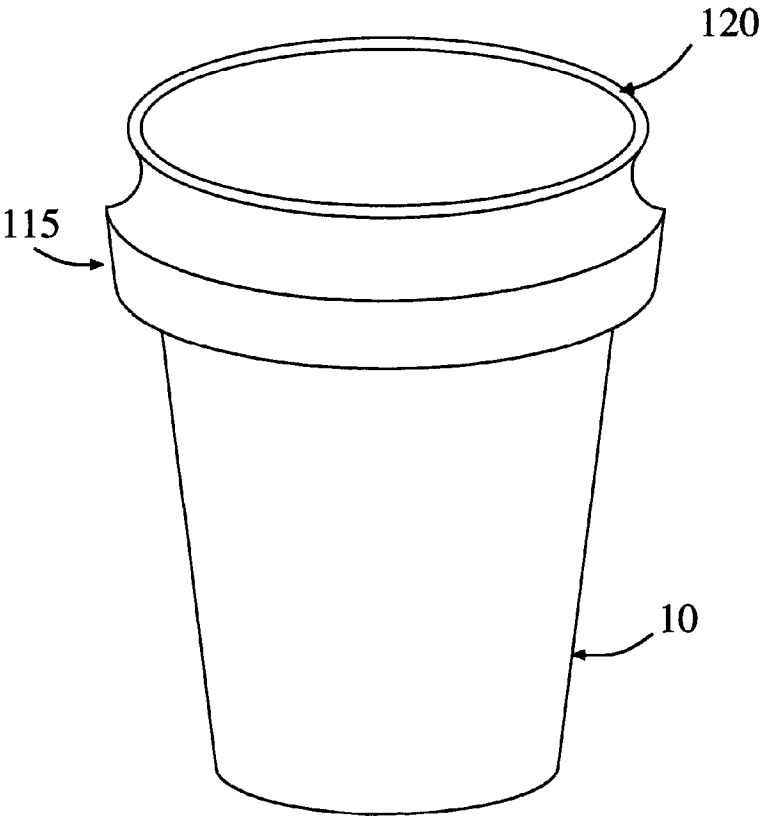
Figure 54B:
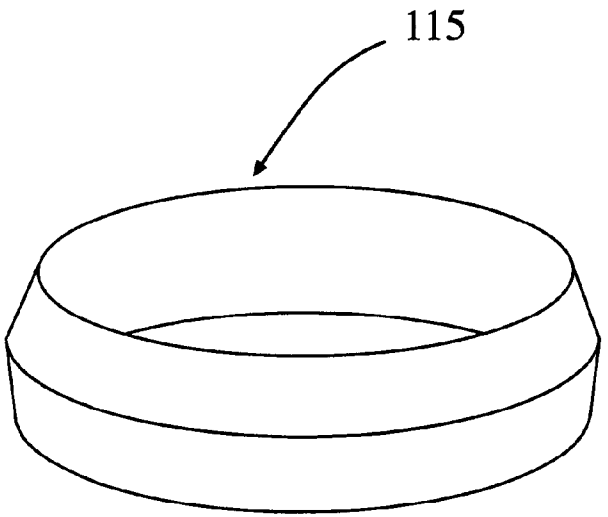
Figure 54A:
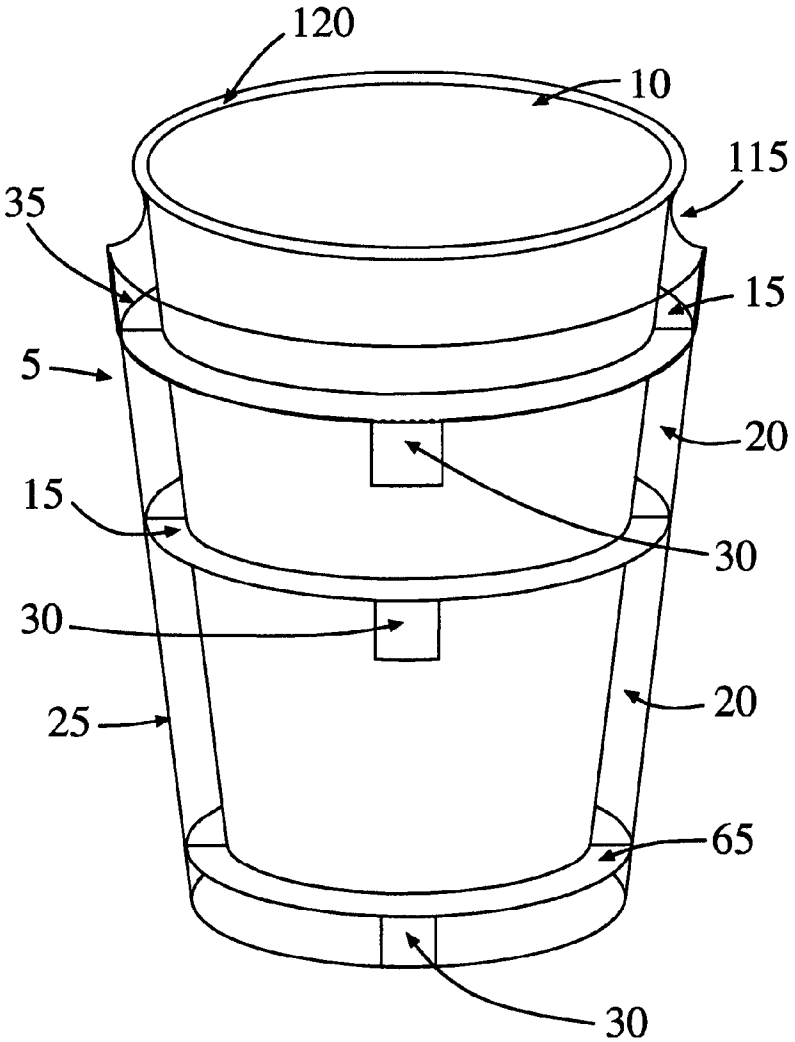
Figure 55B:
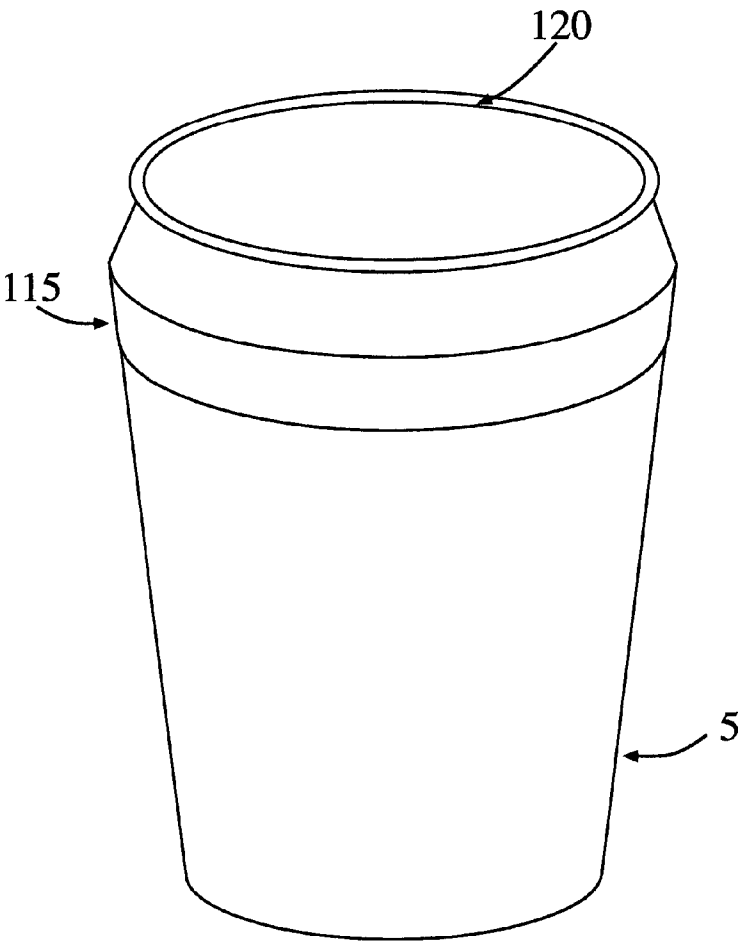
Figure 55A:
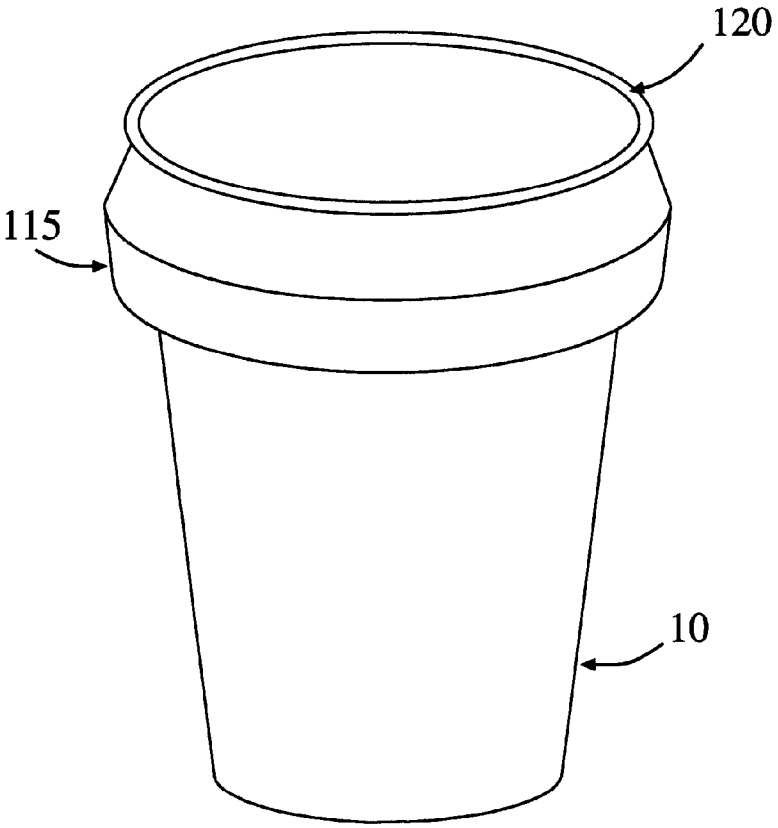
Figure 56B:
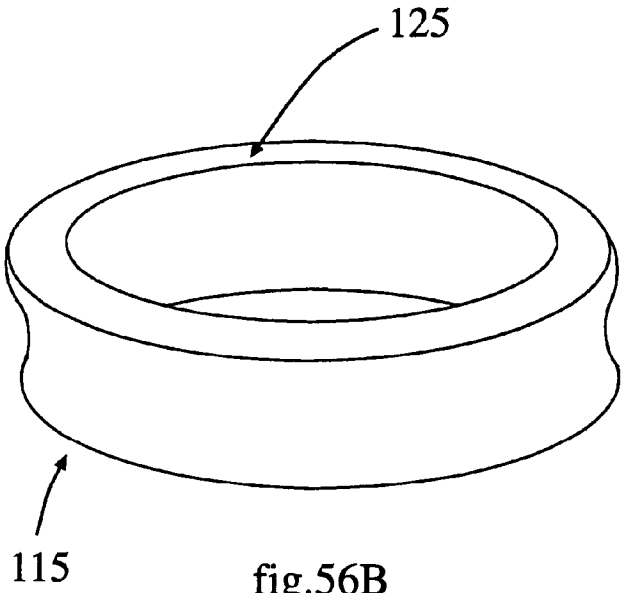
Figure 56A:
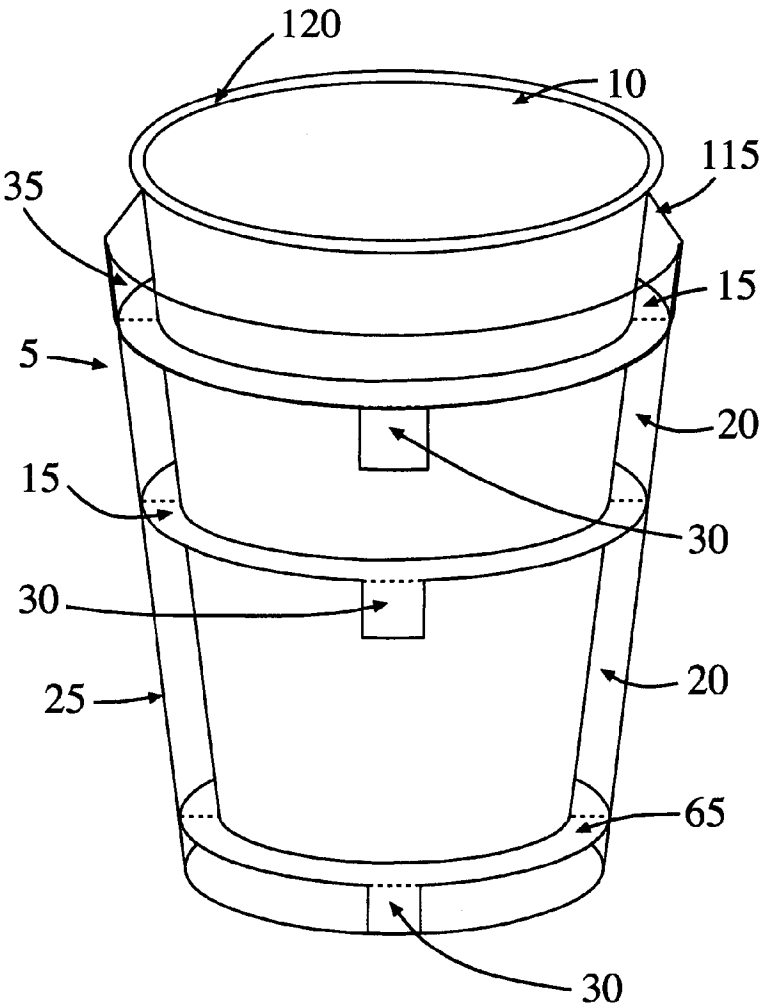
Figure 57B:
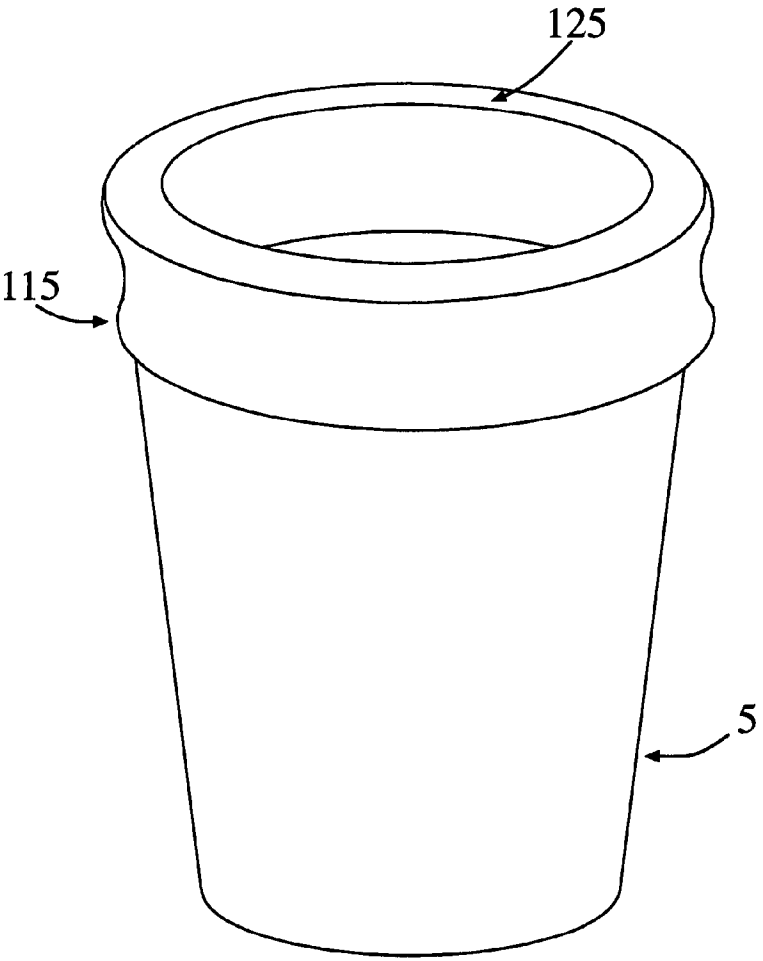
Figure 57A:
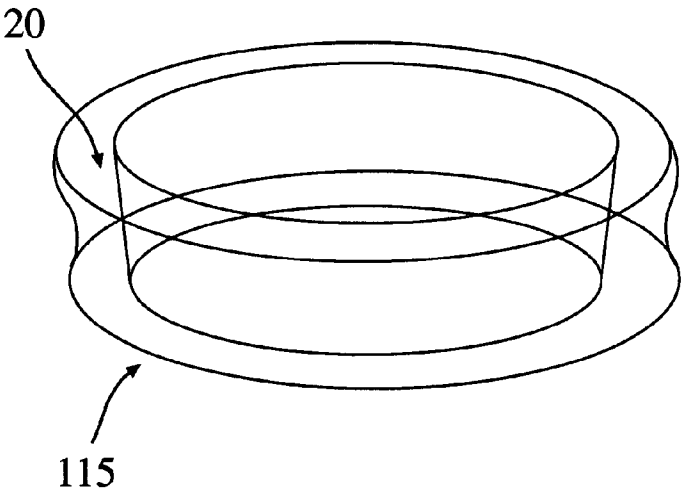
Figure 58:
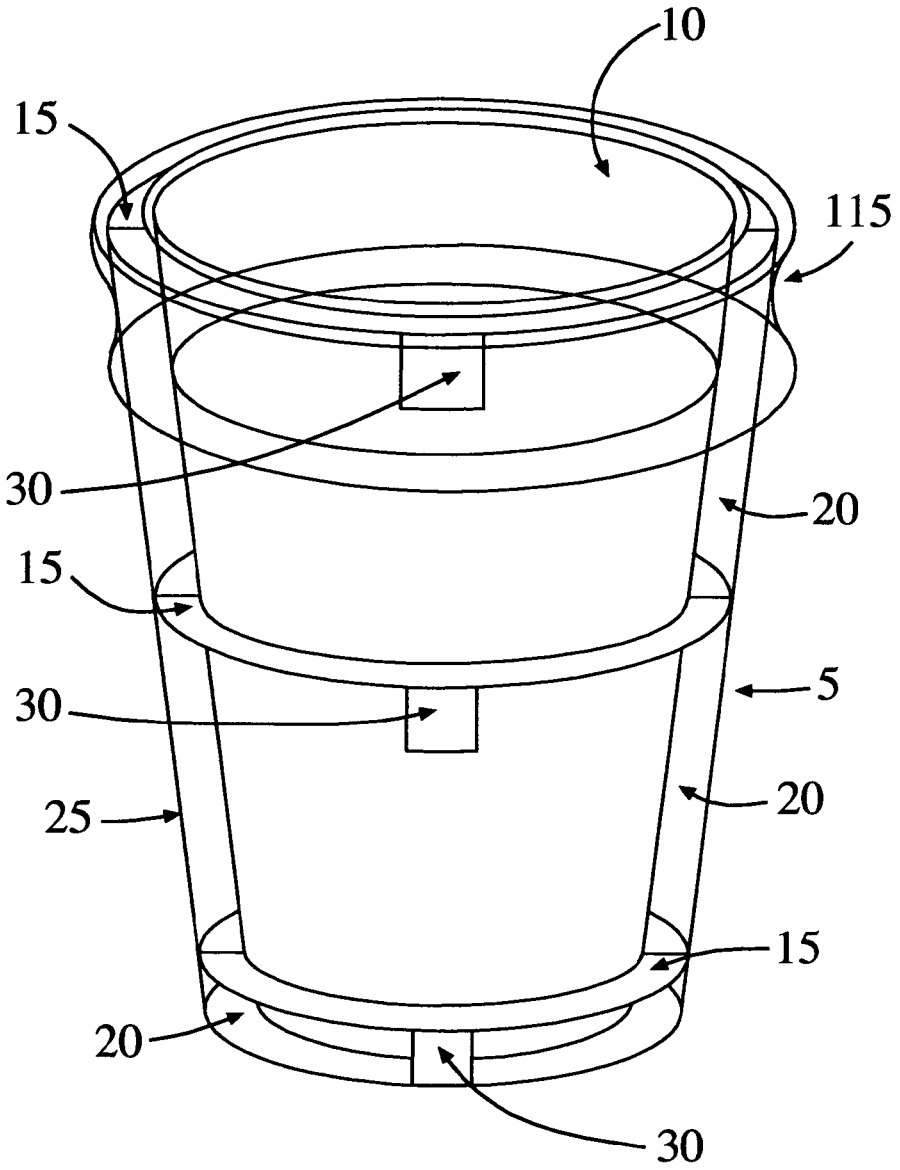

Referring now to FIGS. 52B through 58, an exemplary embodiment of a mouthpiece 115 is illustrated, with alternative embodiments showing the beveled edge in FIGS. 53B, 55B, and wide edge 125 in 57B. The size of the edge may be modified depending on the content of the cup, or to improve the user's comfort when putting the mouthpiece to the mouth. The mouthpiece 115 may provide an additional thermal barrier when used in combination with the sleeve 5 and lid 50 creating an additional insulating air chamber above the highest support ring 15. The mouthpiece may also provide a cooling surface when placed on the brim of a cup by allowing the hot contents of the cup to come into contact with a cool surface before being consumed by the user.

Thus, as discussed herein, the embodiments of the present invention embrace the field insulating devices for food or beverage containers. In particular, the present invention relates to insulating disposable cups by using air as the insulator. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A foldable air insulating system comprising: a cup inserted; and a foldable air insulating sleeve having a substantially outer surface wherein said sleeve forms an insulating air chamber around a medial portion of the cup without enclosing portions of the cup above and below the medial portion of the cup, the air insulating sleeve comprising a support ring medially positioned along the inside of the sleeve dividing the insulating air chamber.

2. A foldable insulating system as recited in claim 1, wherein the system further comprises an insulating lid.

* * * * *